US010023206B2

(12) United States Patent
Bis et al.

(10) Patent No.: US 10,023,206 B2
(45) Date of Patent: Jul. 17, 2018

(54) RAILROAD HOPPER CAR AND DOOR MECHANISM THEREFOR

(71) Applicant: National Steel Car Limited, Hamilton (CA)

(72) Inventors: Tomasz Bis, Ancaster (CA); James Wilfred Forbes, Campbellville (CA)

(73) Assignee: NATIONAL STEEL CAR LIMITED, Ontario (CA)

( * ) Notice: Subject to any disclaimer, the term of this patent is extended or adjusted under 35 U.S.C. 154(b) by 681 days.

(21) Appl. No.: 14/580,871

(22) Filed: Dec. 23, 2014

(65) Prior Publication Data

US 2015/0114253 A1 Apr. 30, 2015

Related U.S. Application Data

(63) Continuation of application No. 13/841,419, filed on Mar. 15, 2013, now Pat. No. 8,915,193, and a continuation of application No. 13/841,321, filed on Mar. 15, 2013, now abandoned, and a continuation of application No. 13/931,062, filed on Jun. 28, 2013, now Pat. No. 8,967,053.

(51) Int. Cl.

| | |
|---|---|
| ***B61D 7/26*** | (2006.01) |
| ***B61D 7/18*** | (2006.01) |
| ***B61D 7/28*** | (2006.01) |

(52) U.S. Cl.

CPC ..... *B61D 7/26* (2013.01); *B61D 7/18* (2013.01); *B61D 7/28* (2013.01)

(58) Field of Classification Search

CPC ..... B61D 7/26; B61D 7/18; B61D 7/28

USPC ..... 105/249, 250, 251, 280, 282.1, 282.2, 105/282.3, 247, 248, 253, 286, 288, 305

See application file for complete search history.

(56) References Cited

U.S. PATENT DOCUMENTS

| | | | |
|---|---|---|---|
| 673,103 | A | 4/1901 | Williamson et al. |
| 682,902 | A | 9/1901 | Muller et al. |
| 688,809 | A | 12/1901 | Hansen |
| 693,132 | A | 2/1902 | Heiden |

(Continued)

FOREIGN PATENT DOCUMENTS

| | | | |
|---|---|---|---|
| CA | 1082524 | A1 | 7/1980 |
| CN | 101486347 | A | 7/2009 |

(Continued)

*Primary Examiner* — Jason C Smith

(74) *Attorney, Agent, or Firm* — Hahn, Loeser & Parks LLP

(57) ABSTRACT

A railroad hopper car discharge outflow is controlled by closure members, at least one of which is movable. The closure members (or doors) are hingeless, being mounted on four bar linkages, such that the distal edge of the doors sweeps predominantly horizontally while the proximal edge of the door moves predominantly upwardly. The doors move through noncircular arcs, such that the size of the vertically projected door opening is abnormally large compared to the clearance heights of the door during opening and closing. The doors are driven by a transverse drive linkage that is driven by a transversely mounted actuator. The actuator may be mounted in an accommodation in the lee of slope sheets between adjacent hoppers in a mid-span portion of the car. Drive from the actuator is carried to a pair of symmetrically mounted doors through drive train linkages.

11 Claims, 47 Drawing Sheets

(56) References Cited

U.S. PATENT DOCUMENTS 1,092,659 A 4/1914 Mettler
1,161,240 A 11/1915 Neikirk
1,297,356 A 3/1919 Junghanns
1,421,439 A 7/1922 Finckh
1,706,353 A 3/1929 Dorey
1,848,901 A 3/1932 Neikirk
2,741,193 A 4/1956 Zimmer
3,137,247 A 6/1964 Hamilton et al.
3,161,146 A 12/1964 Lutts et al.
3,173,381 A * 3/1965 Charles ..... B61D 7/26 105/240
3,298,745 A * 1/1967 Czapiewski ..... B60P 1/56 105/240
3,315,616 A 4/1967 Beaver et al.
3,316,857 A 5/1967 Floehr
3,385,231 A 5/1968 Dorey
3,408,956 A 11/1968 Rebenok et al.
3,447,485 A 6/1969 Dorey
3,455,253 A 7/1969 Floehr
3,511,188 A 5/1970 Danielson
3,577,932 A * 5/1971 Pulcrano ..... B61D 7/20 105/239
3,596,608 A 8/1971 Aquino et al.
3,596,609 A 8/1971 Ortner
3,608,500 A 9/1971 Floehr
3,611,947 A 10/1971 Nagy
3,633,515 A 1/1972 Shaver et al.
3,654,873 A 4/1972 Floehr
3,710,730 A 1/1973 Austgen et al.
3,717,109 A * 2/1973 Miller ..... B61D 7/28 105/250
3,717,110 A 2/1973 Miller
3,772,996 A 11/1973 Schuller
3,786,764 A * 1/1974 Beers, Jr. ..... B61D 7/28 105/240
3,800,711 A 4/1974 Tuttle
3,805,708 A 4/1974 Schuller et al.
3,807,316 A 4/1974 Miller
3,815,514 A 6/1974 Heap
3,818,842 A 6/1974 Heap
3,863,986 A 2/1975 Mentessi
3,902,434 A * 9/1975 Barnard ..... B61D 7/16 105/240
3,931,768 A 1/1976 Price et al.
3,949,681 A * 4/1976 Miller ..... B61D 7/18 105/240
3,994,238 A 11/1976 Adler
4,046,268 A * 9/1977 Adler ..... B61D 7/02 105/241.2
4,106,813 A 8/1978 Goodbary
4,120,409 A 10/1978 vander Werff
4,194,450 A * 3/1980 Miller ..... B61D 7/24 105/253
4,222,333 A * 9/1980 Schuller ..... B61D 7/24 105/250
4,222,334 A * 9/1980 Peterson ..... B61D 7/24 105/250
4,224,877 A 9/1980 Stark et al.
4,232,989 A 11/1980 Miller
4,250,814 A 2/1981 Stark et al.
4,351,243 A * 9/1982 Brouwer ..... B61D 7/04 105/241.2
4,480,954 A * 11/1984 Manstrom ..... B61D 7/02 105/241.2
4,542,701 A 9/1985 Fischer et al.
4,601,244 A * 7/1986 Fischer ..... B61D 7/18 105/240
4,669,392 A * 6/1987 du Plessis ..... B61D 7/30 105/247
4,688,488 A * 8/1987 Adams ..... B61D 7/26 105/240
4,741,274 A * 5/1988 Ferris ..... B61D 7/18 105/240
4,766,820 A * 8/1988 Ritter ..... B61D 7/28 105/240
4,829,908 A * 5/1989 Hallam ..... B61D 7/28 105/240
4,843,974 A 7/1989 Ritter et al.
4,884,511 A * 12/1989 Hallam ..... B61F 1/02 105/247
5,063,858 A 11/1991 Dugge
5,086,709 A 2/1992 Fischer et al.
5,115,748 A * 5/1992 Westlake ..... B61D 7/28 105/240
5,115,758 A 5/1992 Westlake
5,131,722 A * 7/1992 DeCap ..... B60P 1/56 222/502
5,144,895 A * 9/1992 Murray ..... B61D 7/28 105/240
5,163,372 A 11/1992 Galvan et al.
5,249,531 A * 10/1993 Taylor ..... B61D 7/28 105/240
5,261,333 A * 11/1993 Miller ..... B60P 1/56 105/240
5,448,954 A * 9/1995 Joubert ..... B61D 7/30 105/241.2
5,823,118 A * 10/1998 Mønstrom ..... B61D 7/24 105/240
6,019,049 A * 2/2000 Gaydos ..... B61D 7/28 105/250
6,279,487 B1 8/2001 Gaydos et al.
6,405,658 B1 6/2002 Taylor
6,604,469 B1 * 8/2003 Galvan ..... B61D 7/26 105/289
6,745,701 B2 6/2004 Elder
6,955,126 B2 * 10/2005 Taylor ..... B61D 7/28 105/250
6,955,127 B2 * 10/2005 Taylor ..... B61D 7/26 105/299
7,051,661 B2 * 5/2006 Herzog ..... B61D 7/28 105/286
7,080,598 B2 * 7/2006 Creighton ..... B61D 7/28 105/247
7,080,599 B2 * 7/2006 Taylor ..... B61D 7/28 105/288
7,523,708 B2 4/2009 Taylor
7,681,507 B2 3/2010 Herzog et al.
7,735,426 B2 * 6/2010 Creighton ..... B61D 7/02 105/286
8,596,203 B2 12/2013 Forbes et al.
2006/0254456 A1 11/2006 Taylor
2006/0272541 A1 * 12/2006 Taylor ..... B61D 7/24 105/299
2010/0219148 A1 9/2010 Forbes et al.
2010/0251922 A1 10/2010 Forbes et al.
2011/0006592 A1 * 1/2011 Creighton ..... B60T 15/48 303/6.1
2012/0285346 A1 * 11/2012 Forbes ..... B61D 7/28 105/248
2015/0114253 A1 * 4/2015 Bis ..... B61D 7/18 105/251

FOREIGN PATENT DOCUMENTS

EP 0543279 B1 5/1995
EP 1798103 A2 6/2007
GB 1318571 A 5/1973
GB 2013598 A 8/1979

* cited by examiner

RAILROAD HOPPER CAR AND DOOR MECHANISM THEREFOR

This application claims the benefit of priority under 35 USC 119 of Canadian Patent Application 2,810,131 filed Mar. 22, 2013, and also claims the benefit under 35 USC 120 of U.S. patent application Ser. No. 13/841,321 filed Mar. 15, 2013, of U.S. patent application Ser. No. 13/841,419 also filed Mar. 15, 2013, and of co-pending U.S. patent application Ser. No. 13/931,062 filed Jun. 28, 2013 all of the foregoing specifications being incorporated herein by reference.

FIELD OF THE INVENTION

This invention relates to the field of railroad freight cars, and, in particular to railroad freight cars such as may employ bottom unloading gates or doors.

BACKGROUND

There are many kinds of railroad cars for carrying a lading of particulate material, be it sand or gravel aggregate, plastic pellets, grains, ores, potash, coal, or other granular materials. Many of those cars have an upper opening, or accessway of some kind, by which the particulate is loaded, and a lower opening, or accessway, or gate, or door, by which the particulate material exits the car under the influence of gravity. While the inlet opening need not necessarily have a movable gate, the outlet opening requires a governor of some kind that is movable between a closed position for retaining the lading while the lading is being transported, and an open position for releasing the lading at the destination. The terminology "flow through" or "flow through railroad car" or "center flow" car, or the like, may sometimes be used for cars of this nature where lading is introduced at the top, and flows out at the bottom.

Discharge doors for coal gondola cars or other bottom dumping cars may tend to have certain desirable properties. First, to the extent possible it is usually desirable for the door opening to be large so that unloading may tend to be relatively fast, and for the sides of any unloading chute (e.g. slope sheets) to be relatively steep so that the particulate will tend not to hang up on the slope. Further, to the extent that the door can be large and the slope sheets steep, the interior of the car may tend to have a greater lading volume for a given car length. Further still, any increase in lading achieved will tend to be at a relatively low height relative to Top of Rail (TOR) and so may tend to aid in maintaining a low center of gravity. A low center of gravity tends to yield a better riding car that is less prone to derailment, and perhaps less prone to cause as much wear or damage to tracks. Some cars, such as ballast cars, or cars designed for releasing lading between the rails, may tend to benefit from having discharge doors that are oriented longitudinally, such that the discharge lip of the door runs substantially parallel to the longitudinal centerline of the car, and, in opening, the motion of the door may tend to be predominantly in a direction transverse to the centerline of the car.

SUMMARY OF THE INVENTION

In an aspect of the invention there is a railroad hopper car for operation in a rolling direction along railroad tracks. The railroad hopper car has a first hopper. The first hopper having a discharge. A pair of first and second doors mounted to govern egress of lading from said discharge. The doors are movable between a closed position for retaining lading within the first hopper and an open position for permitting egress of lading under the influence of gravity. A mechanical transmission is mounted to drive the doors. The first and second doors are longitudinal doors. The mechanical transmission including a splitting member mounted to the railroad hopper car at a fulcrum. A first linkage connected to the splitting member to a first side of the fulcrum, the first linkage is connected to transmit force from the splitting member to the first door. A second linkage connected to the splitting member to a second side of the fulcrum, the second linkage is connected to transmit force from the splitting member to the second door. An actuator mounted to drive the transmission, the actuator is mounted to act transversely relative to the rolling direction.

In a feature of that aspect of the invention, the first linkage connects to the splitting member at a first distance from the fulcrum, and the splitting member receives drive input from the actuator at a location more distant from the fulcrum than the first distance. In another feature, the first linkage connects to the splitting member at a first distance from the fulcrum, and the second linkage connects to the splitting member at a second distance from the fulcrum, the first and second distances are substantially the same. In another feature, the railroad hopper car having a longitudinal centerline vertical plane, and the fulcrum is mounted substantially at the longitudinal centerline vertical plane. In still another feature, the splitter is a lever, the lever acts in a plane transverse to the rolling direction of the railroad hopper car, and the splitter receives drive input from the actuator at a connection at a height higher than the fulcrum. In still another feature, the actuator is mounted to the hopper car at a height higher than the fulcrum. In yet another feature, the railroad hopper car has a second hopper mounted longitudinally adjacent the first hopper, and the actuator and the transmission are mounted between the first and second hoppers. In again another feature, the railroad hopper car has first and second side sills, the first hopper is mounted between the first and second side sills, and the actuator is carried at a height higher than the side sills. In a further feature, the transmission is a first transmission, the actuator is a first actuator, and the second hopper has a second pair of first and second doors mounted to govern egress of lading from a discharge of the second hopper. The first transmission and a second transmission are both mounted between the first and second hoppers. The first actuator and a second actuator are both mounted between the first and second hoppers. In another feature the railroad hopper car has stub center sills.

In another feature, the railroad hopper car has a longitudinal centerline plane. The first door is a moving member of a four bar linkage. The first door has a proximal margin and a distal margin. In the closed position of the door the proximal margin is transversely outboard of the distal margin. A short linkage of the four bar linkage links the proximal margin of the first door to the railroad hopper car. A long linkage of the four bar linkage links the distal margin of the first door to the railroad hopper car. The transmission includes a first crank operable to drive the first door. In operation the short linkage counter-rotates relative to the crank.

In another feature, the railroad hopper car having a longitudinal vertical centerline plane. The first linkage connects to the splitting member at a first distance from the fulcrum, and the splitting member receives drive input from the actuator at a location more distant from the fulcrum than the first distance. The second linkage connects to the splitting member at a second distance from the fulcrum, the first and second distances are substantially the same. The fulcrum is mounted substantially at the central plane. The splitter is a lever, the lever acts in a transverse plane of the railroad hopper car, and the splitter receives drive input from the actuator at a connection at a height higher than the fulcrum. In another feature, the actuator is mounted to the railroad hopper car at a height higher than the fulcrum. In still another feature, the railroad hopper car has a second hopper mounted longitudinally adjacent the first hopper, and the actuator and the transmission are mounted between the first and second hoppers. The railroad hopper car has first and second side sills, the first hopper is mounted between the first and second side sills, and the actuator is carried at a height higher than the side sills. The transmission is a first transmission, the actuator is a first actuator, the second hopper has a second pair of first and second doors mounted to govern egress of lading from a discharge of the second hopper. The first transmission and a second transmission are both mounted between the first and second hoppers. The first actuator and a second actuator are both mounted between the first and second hoppers. In another feature, the car has stub center sills.

In another aspect of the invention there is a railroad hopper car for rolling along railroad tracks in a longitudinal direction. The railroad hopper car has a first end section and a second end section. A hopper is mounted between the first and second end sections. The hopper has a bottom discharge. A door is mounted to govern egress of lading from the hopper. The door is movable transverse to the longitudinal direction between a first position for retaining lading in the hopper, and a second position permitting gravity influenced egress of lading from the bottom discharge of the hopper. The door defines a linkage of a four-bar linkage. There is a first door actuator and a second door actuator. The first and second door actuators are jointly operable to move the door.

In a feature of that aspect of the invention, the door has a first end and a second end, the first end of the door is more proximate to the first end section of the hopper car than is the second end of the door. The first door actuator is mounted to drive the first end of the door, and the second door actuator is mounted to drive the second end of the door. In another feature, the first and second door actuators are pneumatic actuators. In another feature, the hopper has a first slope sheet and a second slope sheet, the first and second slope sheets are downwardly convergent, the first slope sheet is more proximate to the first end section of the hopper car than is the second slope sheet; and the first door actuator is mounted in a lee of the first slope sheet. In still another feature, the door is a full-length hopper door. In a further feature, the bottom discharge of the hopper has a length, L, in the longitudinal direction, and a width, W, cross-wise to the longitudinal direction, and the ratio of L/W is greater than 1.5. In still another feature, the first end section of the railroad hopper car has a stub center sill. In a further feature, the first and second door actuators are mounted transversely whereby the first and second door actuators drive motion that is predominantly cross-wise to the longitudinal direction. In another feature, the first door actuator is mounted to the first end section and the second door actuator is mounted to the second end section. In another feature, the hopper has a first end slope sheet overhanging the first end section, the first end section has a main bolster, and the first door actuator is mounted in a lee of the first end slope sheet and longitudinally inboard of the main bolster. In a further feature, a stub wall extends upwardly of the main bolster to meet the first end slope sheet, a first machinery space is defined between the stub wall and the first end slope sheet, and the first door actuator is mounted in the first machinery space. In a yet further feature, a second machinery space is defined at the second end section and the second door actuator is mounted in the second machinery space.

In an aspect of the invention there is a railroad hopper car for rolling motion along railroad track in a longitudinal direction. The hopper car has a longitudinal centerline. The hopper car has a first hopper and a second hopper. The second hopper is longitudinally adjacent to the first hopper. The first hopper is a single-door hopper. The second hopper is a single-door hopper. There is a first door. The first door is the single-door of the first hopper. There is a second door. The second door is the single-door of the second hopper. The first door and the second door move in opposite transverse directions during respective opening thereof.

In a feature of that aspect of the invention the first door is movable between a first position in which the first door obstructs egress of lading from the first hopper, and a second position in which the first door permits egress of lading from the first hopper under the influence of gravity. The second hopper has a second door. The second door is movable between a first position in which the second door obstructs egress of lading from the second hopper, and a second position in which the second door permits egress of lading from the second hopper under the influence of gravity. The first and second doors are each longitudinal doors. In the first respective positions the first and second doors straddle the longitudinal centerline.

In another feature, the first hopper has a first discharge opening, the second hopper has a second discharge opening, and the first and second discharge openings are longitudinally aligned. In a further feature, the first and second doors are each moving elements of a four bar linkage. In another feature, the first and second doors are operated by a common transmission. In an additional feature, the transmission is mounted between the first and second hoppers. In another additional feature, the first and second hoppers have adjacent, mutually inclined slope sheets, and the transmission is sheltered in the lee of the slope sheets. In a still further additional feature, the transmission has an externally operable input. In still another further feature, the externally operable input is a lever having an externally accessible extremity for engaging an external trackside actuator as the hopper car is rolling on railroad tracks. In another feature the externally operable input is a first externally operable input, and the transmission also has a second externally operable input.

In another feature the first externally operable input is operable to open the first and second doors, and the second externally operable input is operable to close the first and second doors. In a further feature, the transmission includes a lever, the lever is pivotally mounted to the hopper car. The lever has a first end defining the first externally operable input. The lever has a second end defining the second externally operable input. In a further feature, the first end of the lever is externally accessible from a first side of the hopper car to turn the lever in a first direction as the hopper car passes a first trackside engagement apparatus to open the first and second doors. In another feature, the second end of the lever is externally accessible from a second, opposite, side of the hopper car to turn the lever in a second, opposite, direction to close the first and second doors as the hopper car passes a second trackside engagement apparatus.

In still another feature, the lever is a first lever and the transmission includes a second lever, the second lever is an output lever connected through a linkage member to drive the first door. In a further feature, the first lever is at a first height. The second lever is at a second height. The first height is greater than the second height. The first lever is connected to the second lever by a predominantly upwardly standing torque shaft. In another feature the transmission includes at least one releasable lock for holding at least the first door in one of (a) an open position; and (b) a closed position.

In another feature, there is an auxiliary over-ride operable to selectively drive the doors to each of open and closed positions. In still another feature there is an auxiliary over-ride drive operable to engage the transmission. In an additional feature, the auxiliary drive has a first configuration for driving the doors to an open position. The auxiliary drive has a second configuration for driving the doors to a closed position. The transmission is unobstructed by the auxiliary drive when the auxiliary drive is not in use. In a further feature, the auxiliary drive comprises a drive screw and a cross-head, the externally operable input defines a clevis, and the cross-head and screw mating with the externally operable input.

In another feature, the first door includes a hollow-section longitudinally running reinforcement, and the reinforcement straddles the centerline when the first door is closed. In a further additional feature, the first door defines one bar of a four bar linkage, the reinforcement runs from end-to-end of the first door, and the reinforcement has linkage fittings mounted at either end thereof by which to connect with pivoting links of the four bar linkage.

In another aspect of the invention there is a railroad hopper car for rolling motion along railroad track in a longitudinal direction. The hopper car has a longitudinal centerline. The hopper car has a first hopper and a second hopper. The first hopper is longitudinally adjacent to the second hopper. The first hopper has a first door. The first door is movable between a first position in which the first door obstructs egress of lading from the first hopper, and a second position in which the first door permits egress of lading from the first hopper under the influence of gravity. The second hopper has a second door. The second door is movable between a first position in which the second door obstructs egress of lading from the second hopper, and a second position in which the second door permits egress of lading from the second hopper under the influence of gravity. The first and second doors each are a longitudinal door. The first and second doors each are movable transversely between their respective first and second positions. In the first position the first and second doors straddle the longitudinal centerline, and in the second position the first door moves transversely toward a first side of the longitudinal centerline and the second door moves transversely toward a second side of the longitudinal centerline.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
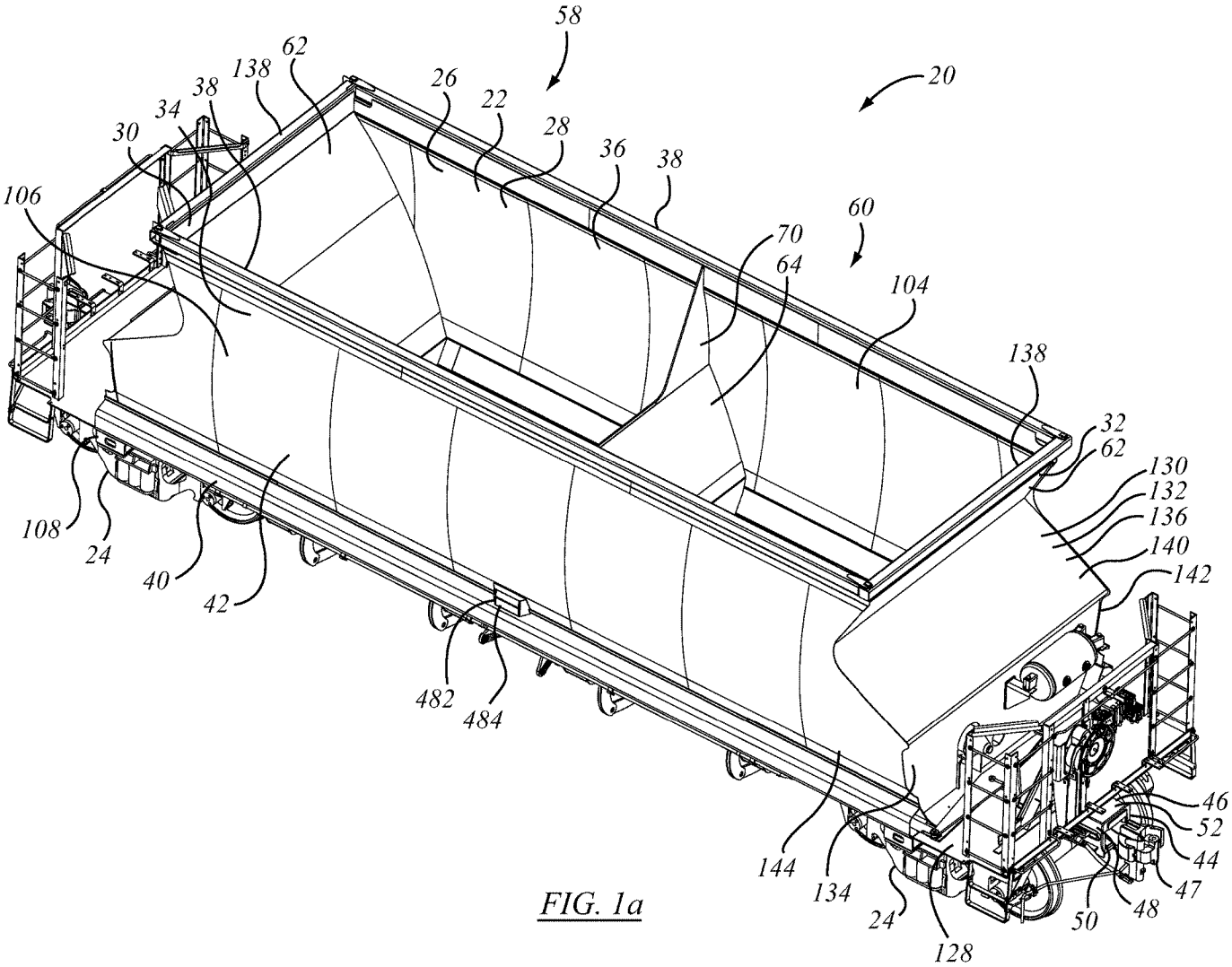
FIG. 1*a* is a general arrangement, an isometric view, from above, of an embodiment of a railroad freight car according to an aspect of the invention.
Figure 1B:
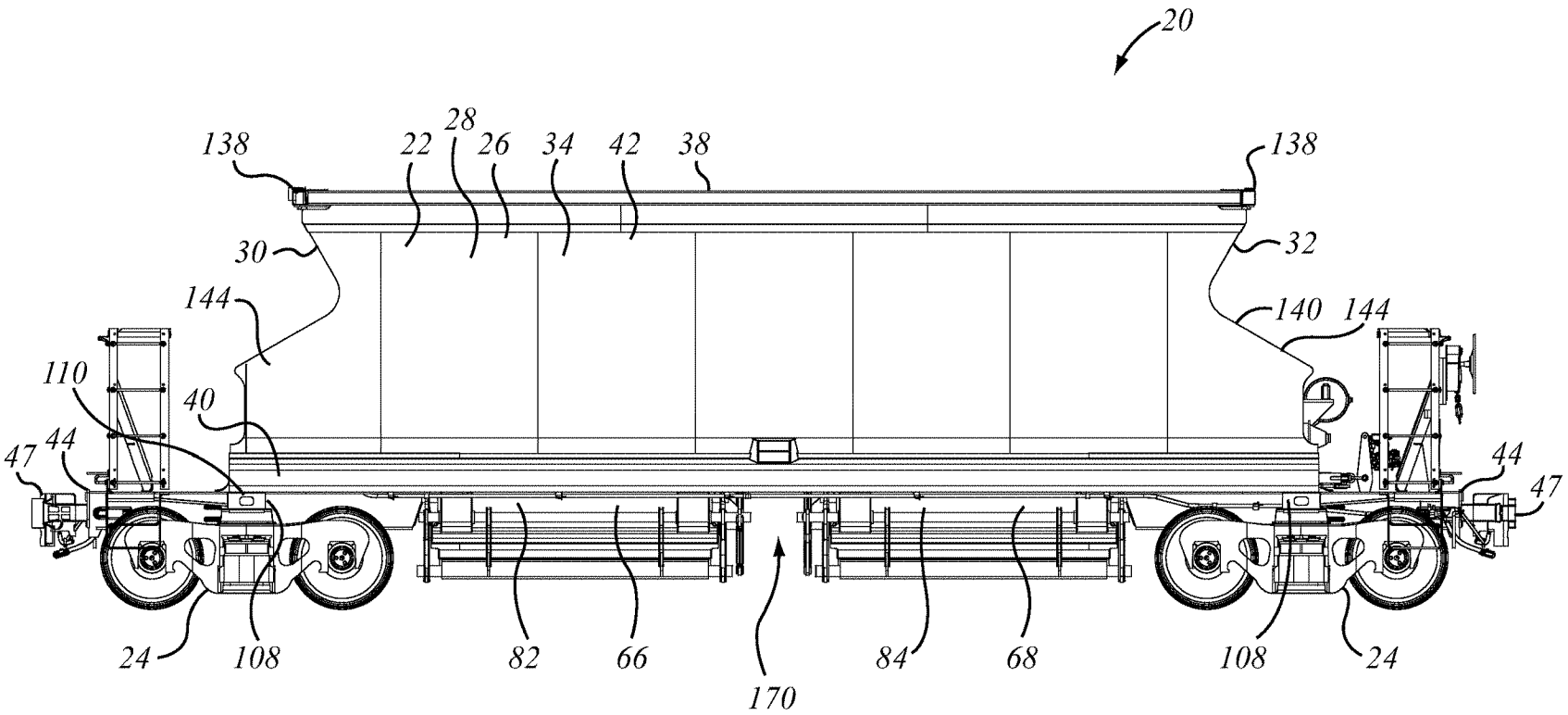
FIG. 1*b* is a side view of the railroad freight car of FIG. 1*a;*
Figure 1C:
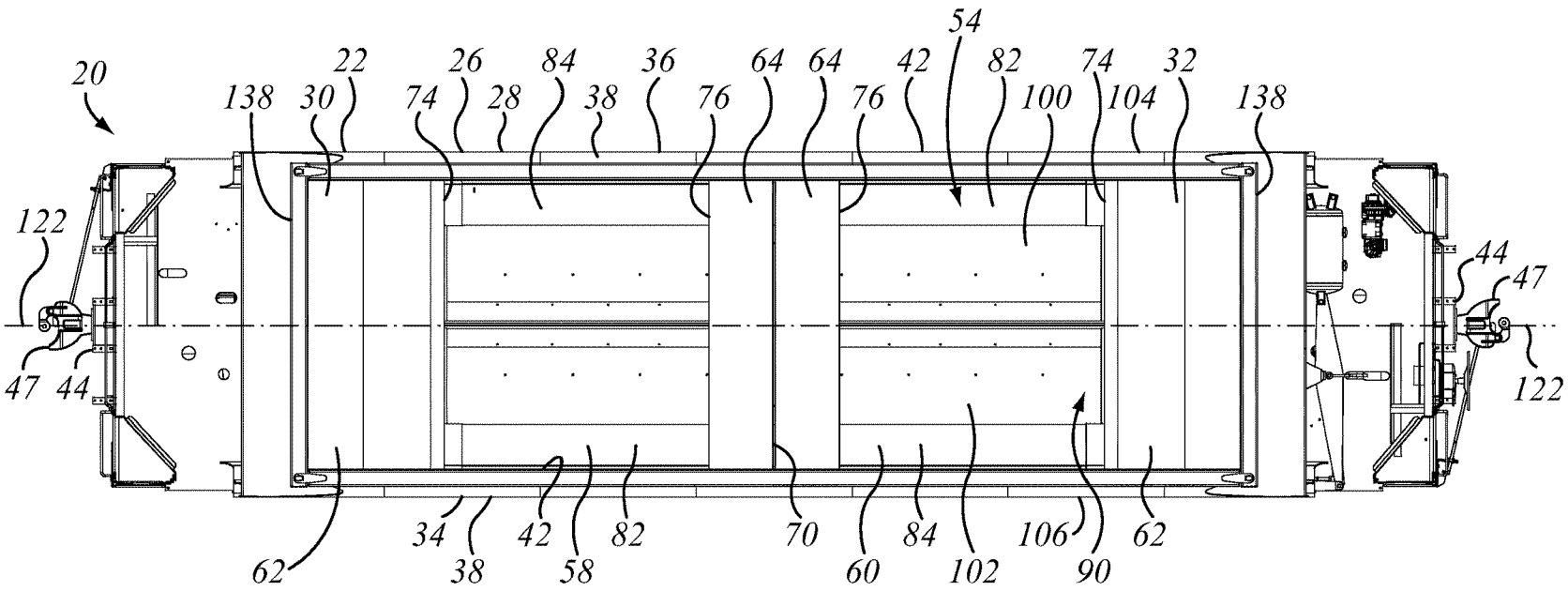
FIG. 1*c* is a top view of the railroad freight car of FIG. 1*a;*
Figure 1D:
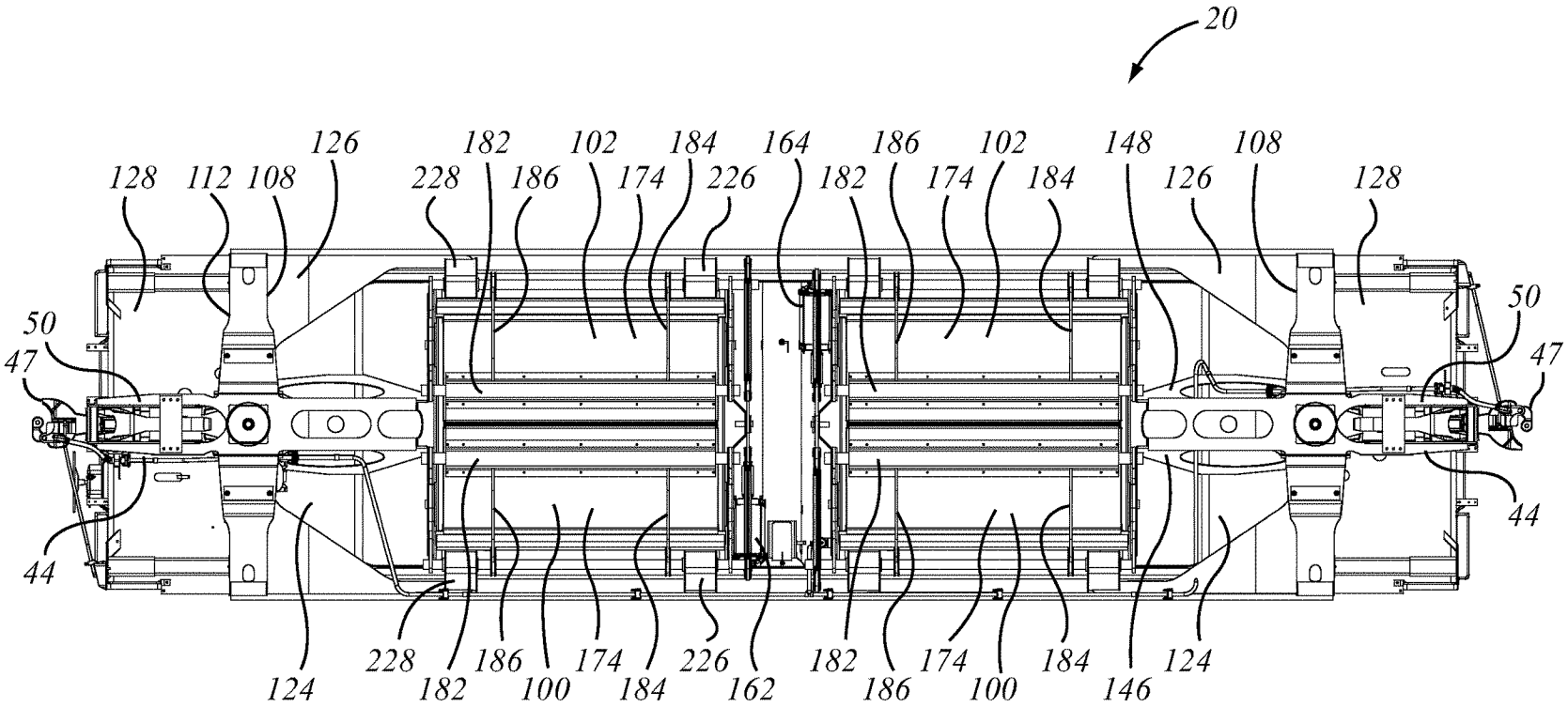
FIG. 1*d* is a bottom view of the railroad freight car of FIG. 1*a*, without showing the trucks, and with the hopper doors in a closed position.
Figure 1E:
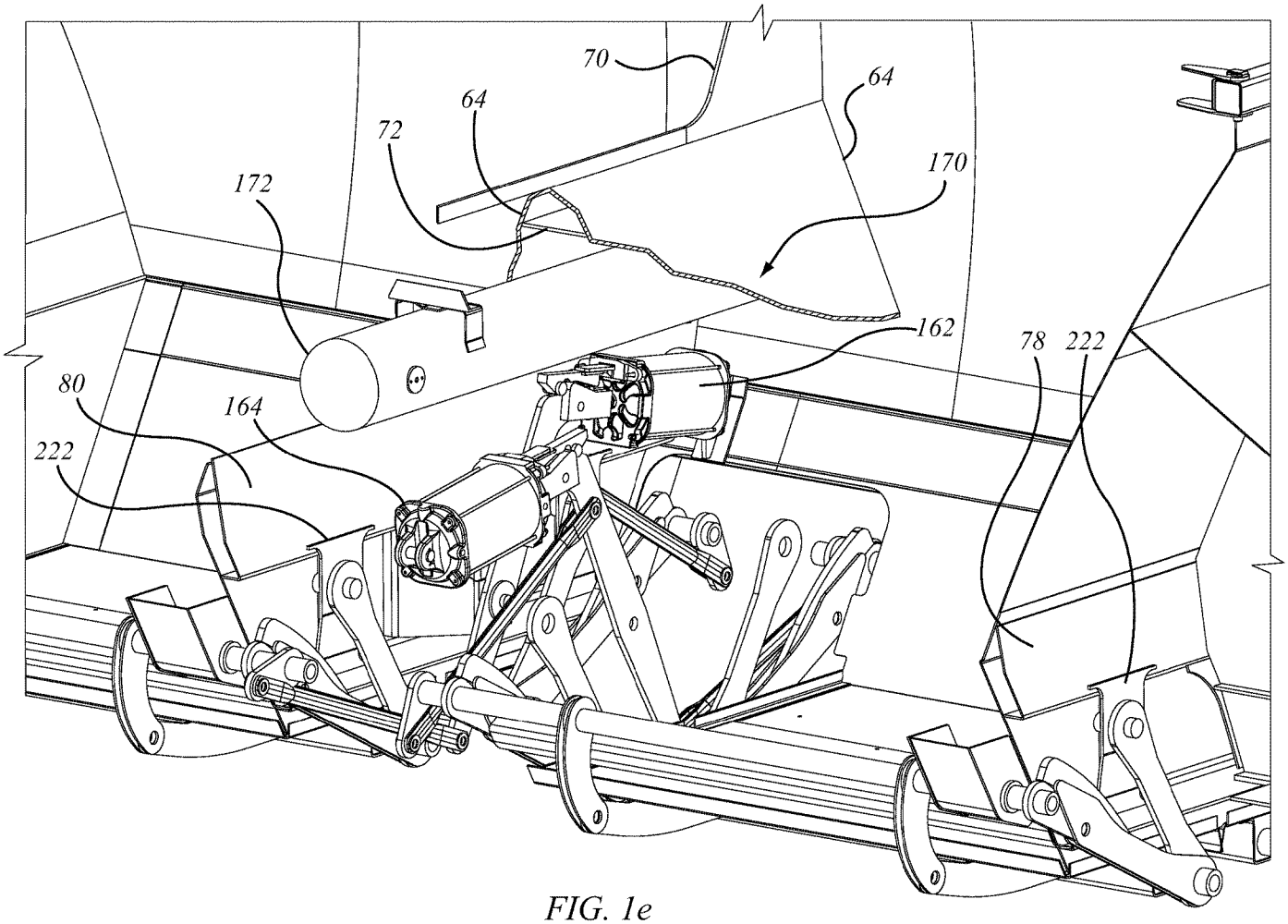
FIG. 1*e* is a perspective view, from above and to one side and one end, of the door opening mechanism of the railroad freight car of FIG. 1*a*, with foreground structure being removed, and with the slope sheets and ridge plate assembly internal gusset plate in cut away.

The description that follows, and the embodiments described therein, are provided by way of illustration of an example, or examples, of particular embodiments of the principles, aspects, or features of the present invention (or inventions, as may be). These examples are provided for the purposes of explanation, and not of limitation, of those principles and of the invention. In the specification, like parts are marked throughout the descriptive text and the drawings with the same respective reference numerals. The drawings are generally to scale, and may be taken as being to scale unless otherwise noted. Unless noted otherwise, the structural members of the car may be taken as being fabricated from steel, most typically mild steel of 50 kpsi or ksi (thousand of pounds per square inch) yield strength. The structure may be of welded construction, most typically, but may alternatively include mechanical fasteners such as Huck™ bolts, rivets, and so on. The structure need not be entirely, or even partially, mild steel, but could include other grades of steel in particular locations, such as the discharge sections, may include consumable wear plates, or plates of greater hardness and wear resistance. In some instances, some or all portions of the primary structure may be made of stainless steel, aluminum, or engineered plastics and composites. Nonetheless, most commonly welded mild steel construction may be assumed as the default condition.

The terminology used in this specification is thought to be consistent with the customary and ordinary meanings of those terms as they would be understood by a person of ordinary skill in the railroad industry in North America. Following from the decision of the Federal Circuit in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, in earlier publications by persons not employed by the USPTO or any other Patent Office), demonstrating how the terms are used and understood by persons of ordinary skill in the art, or by way of expert evidence of a person or persons having at least 10 years experience in the railroad industry in North America or in other territories of the former British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction or rolling direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The terms "longitudinally inboard" and "longitudinally outboard" refer to distances taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, except as otherwise noted a description of one half of the car may generally also be intended to describe the other half as well, allowing for differences between right hand and left hand parts. Similarly, where male and female parts engage, such as a ball and socket connection, a pin and bushing, a pin and slot, and so on, the male and female engaging part relationship may be interchangeable or reversible, the choice being somewhat arbitrary. Therefore unless otherwise noted, or unless the context requires otherwise, interchangeability or reversibility of mating male and female parts may be assumed as a default without requiring further description of the reverse arrangement. In this description, the abbreviation kspi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

Bottom dumping gondola cars may tend to have either longitudinal doors or transverse doors. The term "longitudinal door" means a door that is oriented such that the doors operate on hinges or axes of rotation that are parallel to the direction of travel (i.e., the "longitudinal direction") of the railroad car generally. An example of a car with longitudinal doors is U.S. Pat. No. 3,633,515 to Shaver et al., issued Jan. 11, 1972. By contrast, "transverse doors" are doors for which the axes of rotation of the hinges or other pivots tend to be predominantly cross-wise to the direction of travel, most often precisely perpendicular to it on a horizontal axis. An example of a car having transverse doors is shown in US Patent Publication No. 2008/0066642 of Forbes et al., published Mar. 20, 2008.

This specification discusses four bar linkages. One kind of four bar linkage has a reference, or base, member defining the first link; a second link pivotally connected to the base member; a fourth link pivotally connected to the base member; and a third link pivotally connected to the distal ends of the second and fourth links. A drive input to any one of the second, third. or fourth links relative to the fixed base will then cause motion of all of the second, third, and fourth links relative to the reference member. In the discussion that follows, the base link is taken to be the underframe or body structure of the railcar generally, that frame of reference being taken as a datum during opening or closing of the various doors. Of course, the nominally "stationary" datum may itself be rolling, perhaps slowly, along a railroad track as the lading is being disgorged. In the examples given below the actual door panel that blocks the outlet opening of the car is the third link, namely the link that is pivotally connected to the ends of the second and fourth, links, linkages, or pivot arms, rather than being directly connected to the frame of reference. Most typically some kind of driving mechanism is connected between the first link, (i.e., the rigid structure of the railroad car defining the datum or base or frame of reference), and one of the moving links, be it the second or fourth links, or the output member, or third link, of the four bar linkage. Whatever bar of the linkage is driven, the remaining moving members are then slave linkages whose position is dictated uniquely by the input motion and displacement of the driven member relative to the datum. Most often the driven member is one of the second or fourth links.

Four bar linkages are often analyzed as if the linkage lies in a plane. Indeed, to the extent that out-of-plane forces are either non-existent or symmetrical and opposite (and therefore balanced), the forces and motions in question can be considered to be wholly or predominantly in a particular plane. In the examples herein, where the doors are "longitudinal doors" as defined above, the action of the forces, and the displacements, whether translational or rotational, may tend to be considered as occurring in a transverse, or cross-wise, vertical plane.

In the examples of FIGS. 1*a* to 5*g*, the drive force is imparted by an actuator, which may be in the form of a pneumatic piston mounted to act cross-wise to the longitudinal centerline of the car. It acts through a drive shaft or ram or cylinder or piston that is mounted to reciprocate in that plane. The reciprocation is pure linear translation with respect to the actuator body, but since that body is itself pivotally mounted to the structure, the output action may not be linear but may be on a curve in the transverse plane. The drive piston transmits both motion and power through a splitter to drive connecting rods, or links, which impart motion and drive power to the door panels near the distal edges of those panels through their mounts on the distal edge backing-beam or reinforcement members adjacent the door edges. The linkages rotate about their base pivot mounts in parallel y-z planes, the axes of the pivots extending in the x-direction (i.e. longitudinally).

FIGS. 1*a*-3*d* show respective views of an example of a railroad freight cars indicated as 20. Although an open-topped hopper car is shown, the illustrations are intended to convey that the features and aspects of the invention (or inventions, as may be) are pertinent to a range of railroad freight cars, rather than a single embodiment. While car 20 may be suitable for a variety of general purpose uses, it may be taken as being symbolic of, and in some ways a generic example of, flow through cars, in which lading is introduced by gravity flow from above, and removed by gravity discharge through gated or valved outlets below. "Flow through", or "center flow" cars may include open-topped hopper cars, grain cars, plastic pellet cars, potash cars, ore cars, coal gondolas, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. In either case car 20 may be symmetrical about both its longitudinal and transverse, or lateral, centerline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car having releasable couplers 47 at each end, as shown, or it may be a multi-unit car having two or more car body units, where the multiple car body units may be connected at substantially permanent articulated connectors, or draw bars. To the extent that car 20 may carry relatively dense materials, draw bar connections in a unit train might be employed. Car body 22, and the various structural members and fittings described herein may be understood to be typically of metal construction, whether welded or Huck™ bolted, or riveted together, the metal members being most typically steel, stainless steel, or aluminum, as may be appropriate. Some car builders have also used reinforced plastic composites for car elements, and those materials could also be employed where suitable. Car body 22 may have a lading containment vessel or shell 26 such as may include an upstanding peripheral wall structure 28 which may have a pair of opposed first and second end walls 30, 32 that extend cross-wise, and a pair of first and second side walls 34, 36 that extend lengthwise, the end walls 30, 32 and side walls 34, 36 co-operating to define a generally rectangular form of peripheral wall structure 28 as seen from above. Wall structure 28 may include top chords 38 running along the top of the walls, and side sills 40 running fore-and-aft (i.e., lengthwise) along lower portions of the side sheets 42 of side walls 34, 36. Car 20 may have stub center sills 44 at either end, in which case side walls 34, 36 may act as deep beams, and may carry vertical loads to main bolsters 108 that extend laterally from the centerplates. In the case of a single, stand-alone car unit, draft gear and releasable couplers 47 may be mounted at either end of the center sill. Stub center sill 44 has first and second, or left and right hand vertical webs 46, 48, a bottom flange 50, and a top flange or top cover plate 52, those four elements being arranged in the conventional manner to define a substantially rectangular hollow tube. Cover plate 52 is carried at a height in the range of something such as 41 to 43 inches above TOR, such that the coupler and draft gear sit in the coupler pocket with a coupler centerline height for a light (i.e., unladen) car with unworn wheels of 34½ inches above TOR, the standard AAR undeflected coupler height. In a center flow, or flow through car, the upper portion of the car may typically include means by which to admit lading under a gravity drop system. Such an intake 54, or entryway may be a large rectangular opening such as bounded by top chords 38, or the car may have one or more hatches, whether covered or uncovered.

Looking at the structure generally, car 20 may have two hoppers, or hopper assemblies, or hopper sections, identified generally and generically as a first hopper 58 and a second hopper 60. Each hopper has an end slope sheet 62 sloped in the longitudinal direction, and an intermediate slope sheet 64 also sloped in the longitudinal direction. These slope sheets slope upwardly, and away from, a respective first or second hopper discharge section 66, 68. As may be appreciated, the interior or intermediate slope sheets 64 of hoppers 58 and 60 run upwardly and inwardly toward each other, more or less symmetrically, to meet at what is, roughly speaking, a common apex. More precisely, they engage opposite sides of a ridge plate assembly 70 that runs cross-wise between side walls 34, 36. Ridge plate assembly 70 may be made substantially as shown and described herein (or as in US Patent Publication No. 2010/0132587 of Forbes et al.) and lies along the central plane of car 20. It is not necessary that end slope sheets 62 be inclined at the same angle as intermediate slope sheets 64. Those slopes may be different. That is, the slope of end slope sheet 62 is substantially shallower than the slope of the intermediate slope sheets 64. It may be noted that a flat member, or gusset, or plate 72 is mounted beneath ridge plate assembly 70 between the two adjacent intermediate slope sheets 64, such that a triangular tube is formed that extends across car 20 from side wall 34 to side wall 36.

In the embodiment shown in FIGS. 1*a*-3*d*, the lower margins 74, 76 of slope sheets 62, 64, respectively, terminate at a level corresponding to the height of side sills 40, such that margins 74, 76 and side sills 40 co-operate to define a generally rectangular opening giving on to hopper discharge sections 66, 68 of first hopper 58 and second hopper 60, respectively. A lateral stiffener in the form of a hollow section beam 78, 80 runs cross-wise from side sill to side sill along lower margin 74, 76. Each hopper discharge section 66, 68 has a four sided shape that includes first and second side wall sheets or walls, or side wall members 82, 84 that depend downward on an inward decline from side sills 40, and first and second end walls, or wall members 86, 88 that run cross-wise across the car, and may extend in substantially vertical planes downwardly from lower margins 74, 76 respectively. The bottom margins of wall members 82, 84, 86, and 88 define a generally rectangular opening 90. Egress of lading from opening 90 is controlled by governors, namely outlet doors or gates, indicated generally as first and second (or left and right hand) doors 100, 102. These doors 100, 102 may be symmetrical, such that a description of one serves also to describe the other.

Full Length Side Sills

Side walls 34, 36 act as long deep side beams 104, 106 that carry the vertical loads of hoppers 58, 60, said walls having upper flanges formed by top chords 38, bottom flanges formed by side sills 40 and webs defined by side sheets 42. The vertical loads transferred into the side beams are then carried into stub center sills 44 at the locations of the end stub wall assemblies 130 and main bolsters 108 at the truck centers. Main bolsters 108 each include an upper, or main, flange 110, a lower flange 112, and a web 114.

Car 20 has a shear plate 128 that extends over (or may define) the top cover of stub center sill 44, extending across the full width of car 20 from side sill to side sill, such that it underlies side sills 40 and overlies main bolster 108 (or defines the upper flange thereof). Outboard of main bolster 108, shear plate 128 extends to the end sill of car 20. Inboard of main bolster 108, shear plate 128 has triangular portions 126 that taper outwardly to underlie the side sills, leaving an opening 124 beneath end slope sheet 62.

End Wall Defines Deep Lateral Beam

An end wall, or end wall assembly 130 of car 20 includes a deep, predominantly upwardly extending, transversely running shear web, member, panel, or wall, 132. Wall 132 has a lower portion 134 and an upper portion 136. Lower portion 134 lies in a predominantly vertical cross-wise plane. Upper portion 136 is bent relative to lower portion 134, and extends on an upwardly inclined plane to meet, and mate with, end slope sheet 62. The lower margin of lower portion 134 of wall 132 extends upwardly from shear plate 128. The lower margin of lower portion 134 of wall 132 is rooted at, or mates with, or is aligned with, upper or main flange 110 of main bolster 108. In effect, end wall top chord 138, end slope sheet 62, beam 78, wall 132, and flange 110 co-operate to define a deep beam or deep beam assembly 140 that extends across car 20 from side sill to side sill. The ends of beam 140 are capped by the wings, or shear web panel extensions 142, 144 of the side sheets 42. Further, support webs in the nature of elephant ears 146, 148 meet center sill cover plate 52 directly above respective center sill webs 46, 48, and are angled on an outwardly splayed slope slightly away from each other, extending upwardly to meet and reinforce end slope sheet 62 and end wall 132, thus providing load paths by which vertical portions of the shear load from side beams 104, 106 and the lading are resolved into stub center sill 44.

Large, Low, Substantially Horizontal Hopper Discharge Opening

Figure 2A:
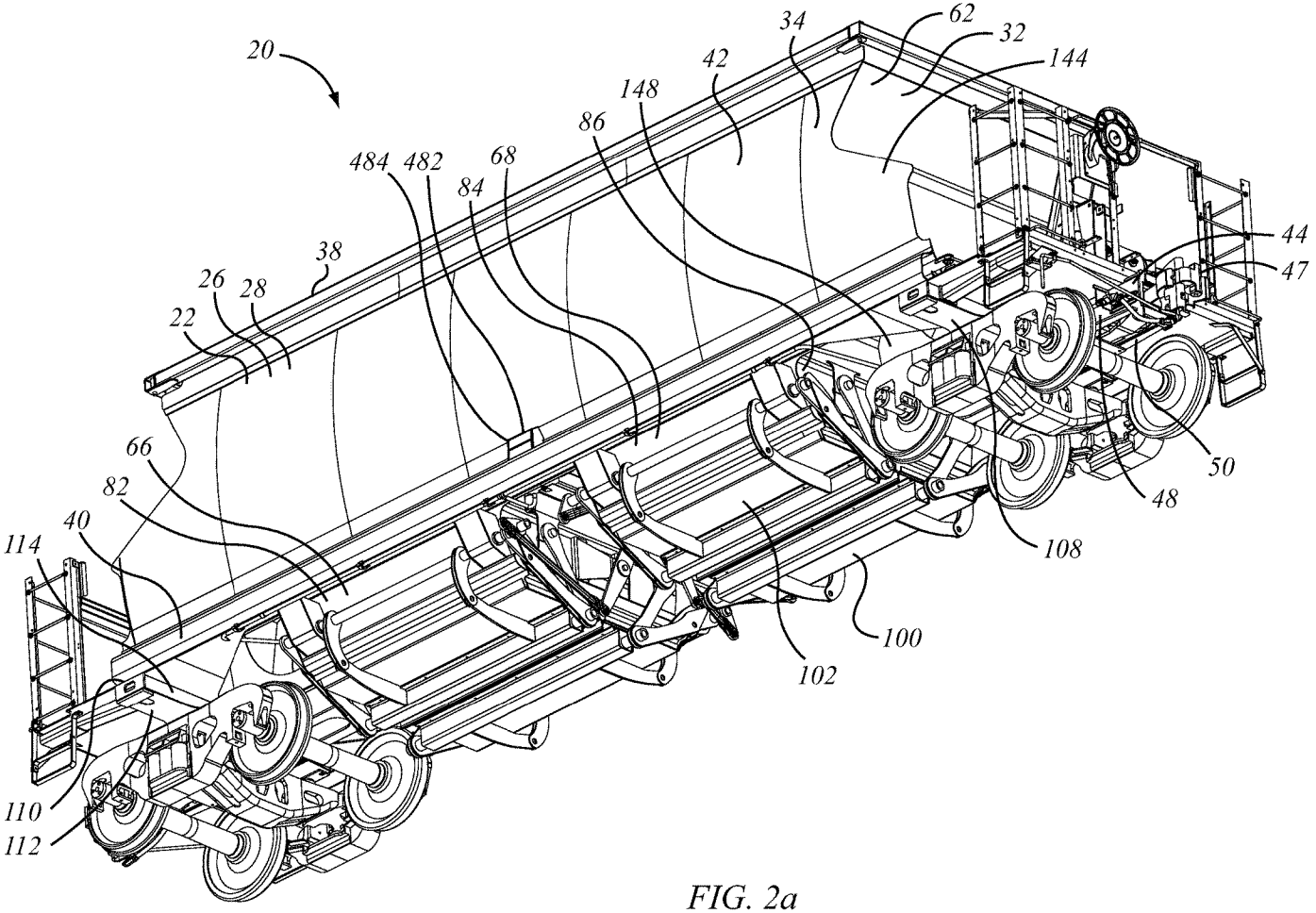
FIG. 2*a* is an isometric view, from underneath, of the railroad freight car of FIG. 1*a;*
Figure 2B:
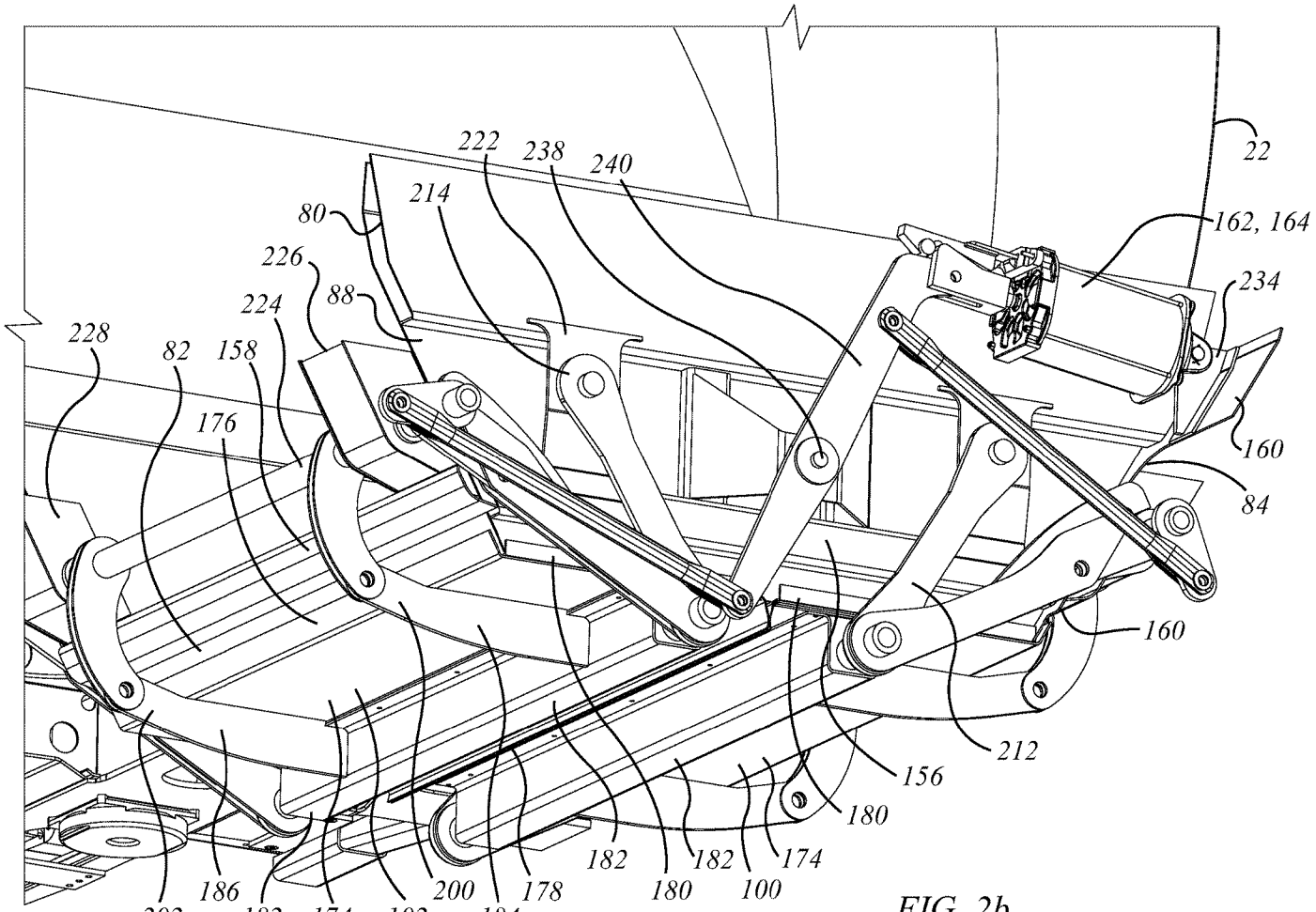
FIG. 2*b* is a perspective view, from underneath near the car centerline and to one side, of one hopper of the railroad freight car of FIG. 1*a*, foreground structure being removed to show the relationship of door operation members with the discharge doors in a closed position at the driven end.
Figure 2C:
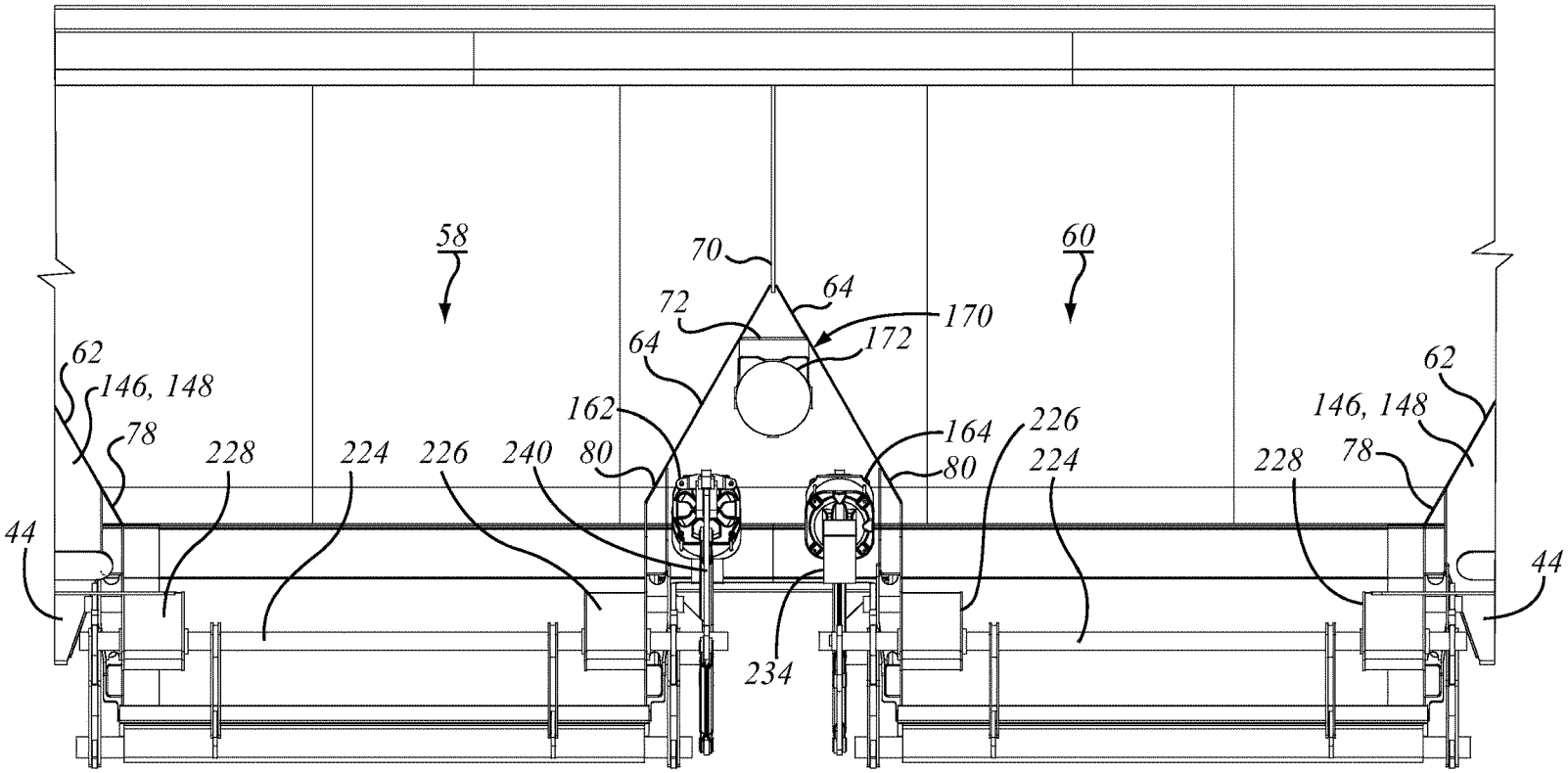
FIG. 2*c* is a side view, with foreground structure being removed to show the machinery of the railroad freight car of FIG. 1*a;*
Figure 3A:
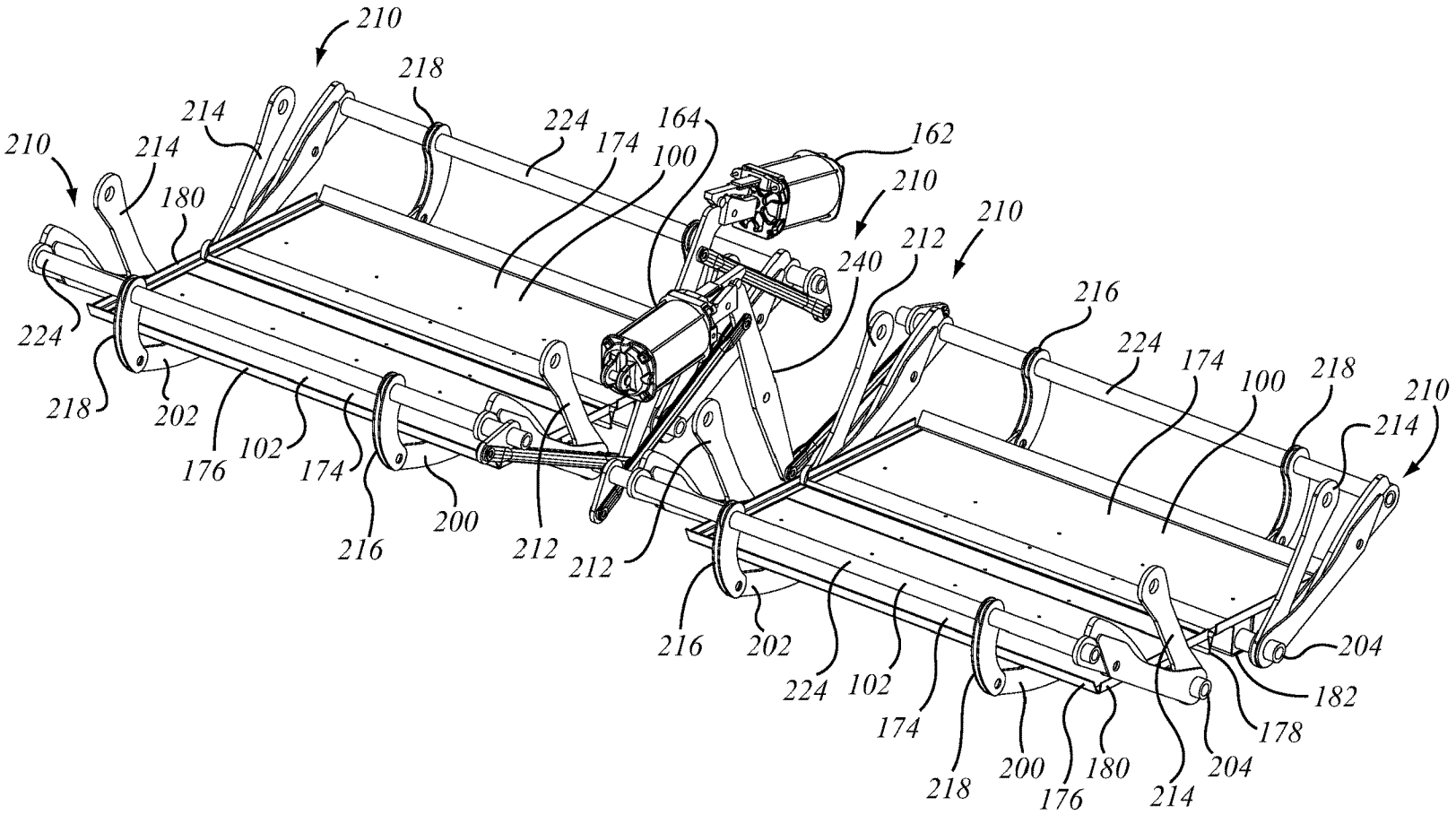
FIG. 3*a* is a perspective view of the doors of FIG. 1*c* in a closed position, with all surrounding structure removed.
Figure 3B:
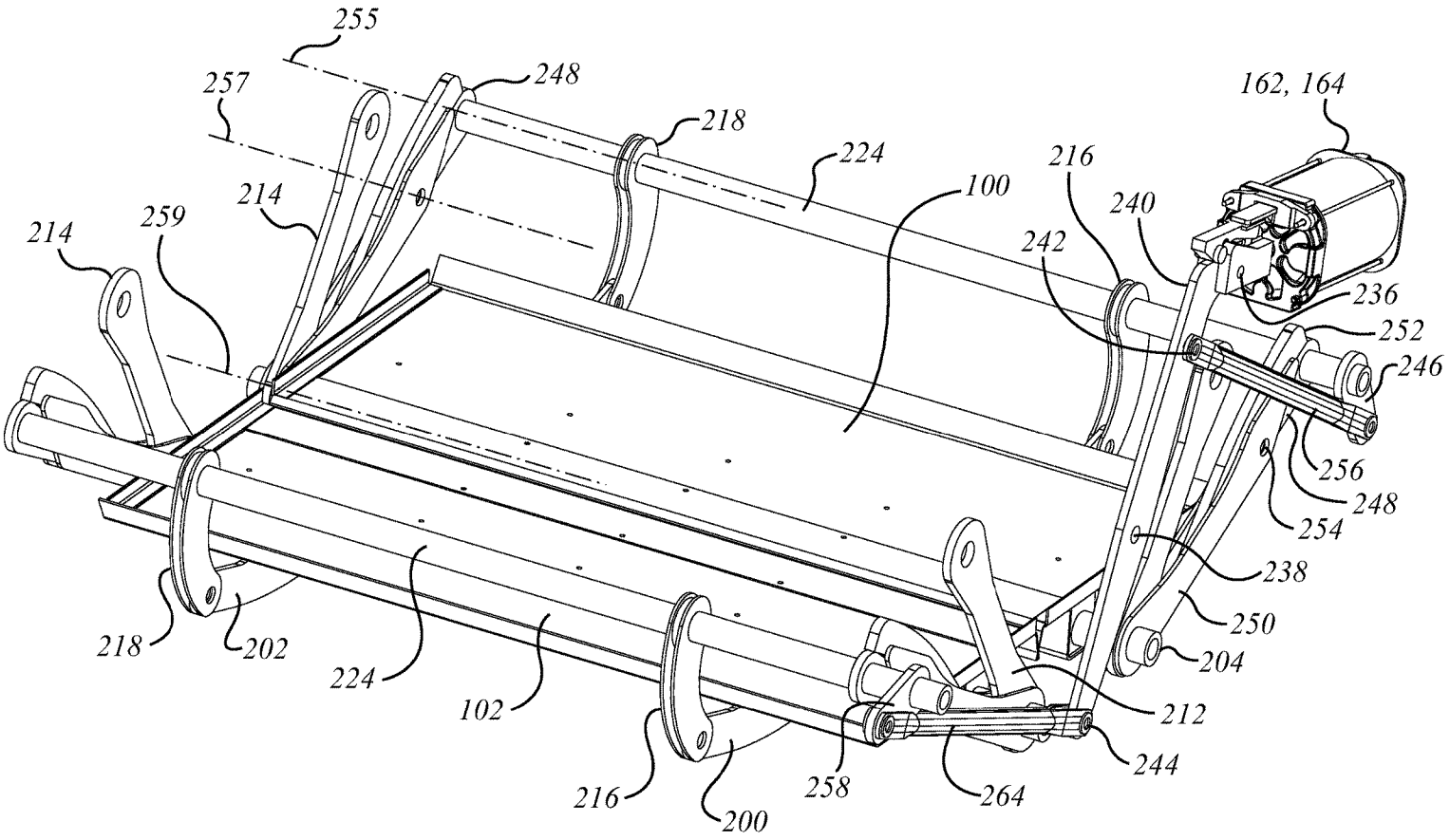
FIG. 3*b* is an enlarged view of a single pair of doors of FIG. 3*a;*
Figure 3C:
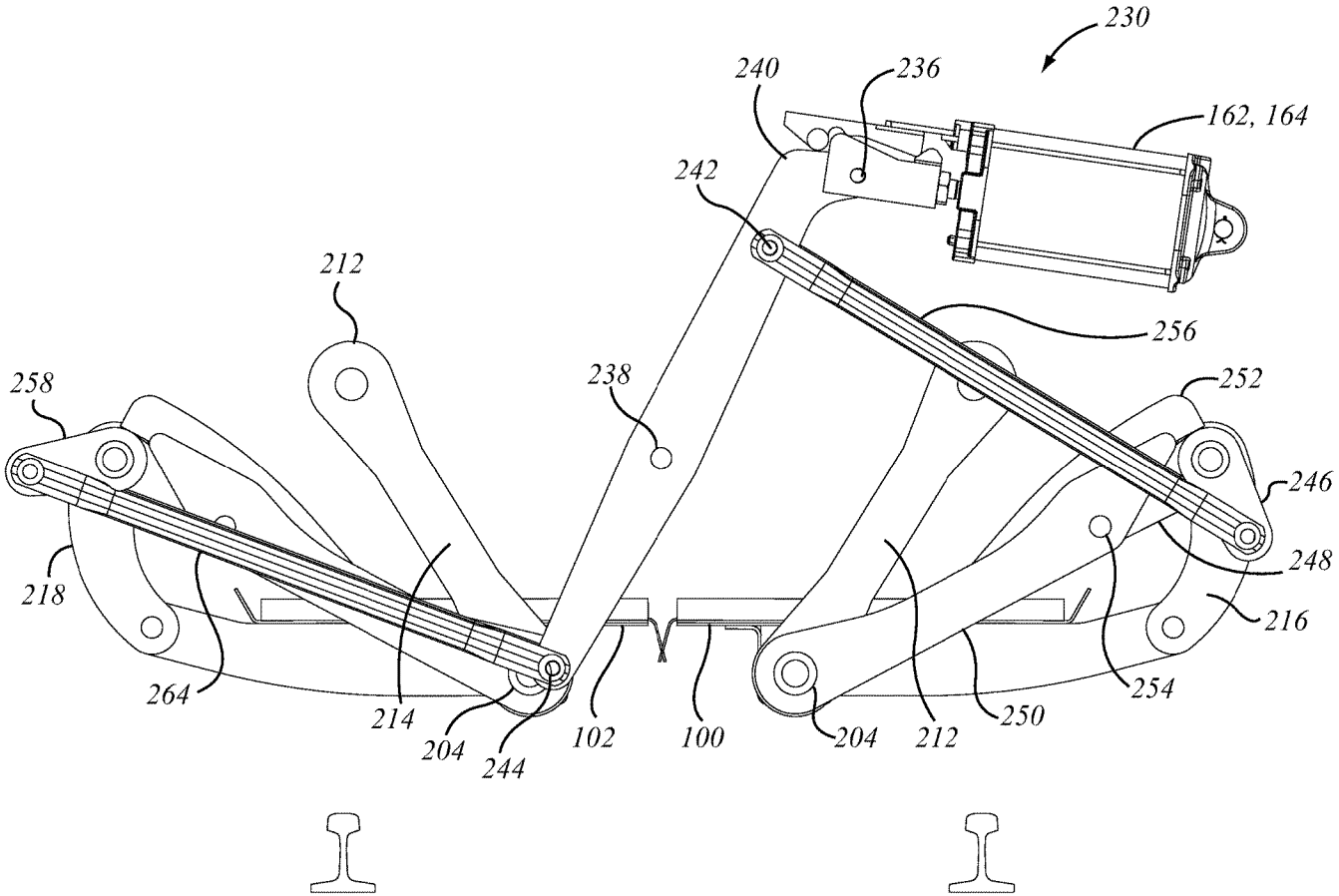
FIG. 3*c* is a view taken on the centerline of the railroad freight car of FIG. 1*a*, with trucks removed, showing the door operating apparatus of FIG. 3*b* in the closed position.
Figure 3D:
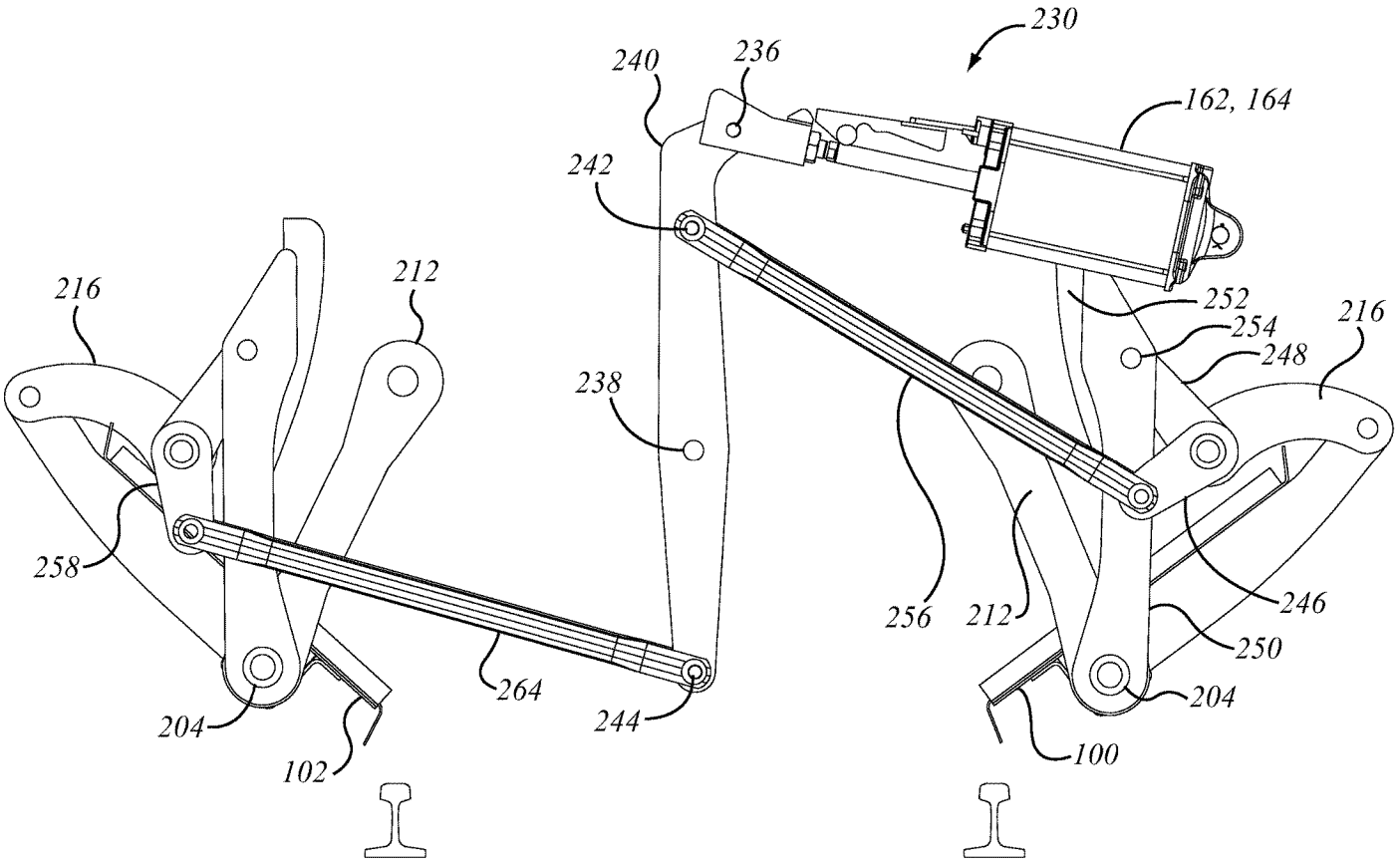
FIG. 3*d* is the same view as FIG. 3*c*, with the door operating apparatus in the fully open position.

It may also be noted that the lower margins of the stationary structure of the hopper discharge sections are reinforced by hollow structural sections, those on end wall members 86, 88 being identified as hollow structural sections or hollow beams 156 and those on the sloped, laterally downwardly convergent side wall members 82, 84 being identified as hollow structural sections, or reinforcements or hollow beams 158. As can be seen in FIG. 2*b*, side sheets 82, 84 have members or extension portions identified as ears, or wings 160, that extend over, and cap, the ends of the hollow section beams 78, 80, and 156 near the top and bottom margins of hopper discharge sections 66, 68. Further, considering the rectangular picture frame defined by the lower margins of the four sheets that define the rectangular discharge opening 90, several feature may be noted. First, the opening is longer than wide. That is, it has a length, L, in the lengthwise direction of car 20, and a width, W, in the cross-wise direction. The ratio of L/W may be greater than 3:2 such that each of doors 100, 102 may be three times as long as it is wide. In one embodiment the length of the doors may be over 100 inches, and may be about 103 inches, such that two hoppers have a combined opening length of over 200 inches. In this car of FIGS. 1*a*-3*d* the truck center distance may be less than 500 inches, and in one embodiment is between 385 and 400 inches. Thus the ratio of door length to truck center length is greater than 1:2, and may be in the range of as much as roughly 7:13. The length may be even greater, being roughly 155 inches, such that two doors give a total door length of more than half and in one embodiment as much as roughly ⅝ of the truck center spacing. Nonetheless, the width of the opening is less than 60 inches wide, and in one embodiment is approximately 60 inches wide. Expressed differently, the opening is less than half the overall width of the car, and in one embodiment is roughly 5/11 of the width of the car. Expressed differently, the width is less than the gauge width of the tracks, and, in some embodiments may be in the range of ½ to as much as 1 times the gauge width. Furthermore, the height of the opening above TOR is low. It need not be that the entire opening, or the periphery of the opening defined by lower margins of walls 82, 84, 86, and 88, is planar or lies in a unique horizontal plane. For example, the opening 90 of car 20 is not precisely planar, but is angled slightly upwardly away from the car centerline, the angle in one embodiment being of the order of less than 40 degrees. However, taking the opening 90 as being substantially planar and horizontal, the height of the midpoint of the periphery of the opening 90 on the centerline of car 20 the structure may in one embodiment lie as little as 8 inches above TOR. That is to say, the opening width of the discharge over the mating double doors 100, 102 is more than four times, and in one embodiment more than seven times, the clearance height from top of rail to the lip of the opening of the stationary structure, and in one embodiment is more than 8-½ times the clearance height (e.g., 70" width, 8" clearance). These various ratios are measures of, or proxies for, a physical property of functional significance, namely they are measures of the extent to which a very large, substantially horizontal gate opening permits the car to have a low center of gravity while laded; potentially permits the car to have a larger volume of lading than otherwise (depending on the density of the lading); permits the lading to be discharged more quickly given that the opening is larger and at the same time lower than the center sill, and permits the lading to be discharged with more accuracy and less spread than might otherwise be the case if discharged from a greater height above TOR.

Internal Machinery Accommodation Between Hoppers

In terms of stationary structure, it may be recalled that interior slope sheets 64 of hoppers 58 and 60 meet at ridge plate assembly 70. As such there is a sheltered machinery space 170 defined between the two hopper discharge sections beneath, or in the lee of, interior slope sheets 64 of adjacent hoppers 58, 60, and, indeed, below plate 72 which forms the bottom closing member of the triangular tube. Although this description is written in the context of a car having two hoppers, the same commentary would apply to a car having any number of hoppers greater than one where the internal slope sheets of two adjacent hoppers meet to form a somewhat protected space. In existing open topped hopper cars the space under the slope sheets is often where so called "elephant ears" or triangular planar shear plates are located, those planar shear plates having one vertex running along the center sill cover plate over one of the center sill webs, a second vertex running upwardly on a diagonal along the back of one of the intermediate slope sheets and a third vertex running upward on a similar diagonal on the back of the other intermediate slope sheet. In the instant car 20, machinery space 170 is free of such shear plates or elephant ears, or planar web members, such as would otherwise obstruct the space.

Since machinery space 170 is unobstructed, door drives in the nature of pneumatic cylinders, or pneumatic actuators, 162 and 164 may be located in the accommodation so defined. Location of actuators 162, 164 in this accommodation may tend to mean that the actuators are not fit into a tight or difficult machinery space over one of the end sections of the car, competing for space with the brake reservoirs or other equipment. It may also mean that there is better access for servicing and maintenance, and it may mean that the drive train to operate the doors is shorter and more direct than it might otherwise be, because the actuator is immediately beside the mechanism that it is intended to drive, and, in a substantially transverse installation as shown, the actuator is aligned predominantly in the direction of action of force that is desired, making a more compact drive train generally. An extra pressurized air reservoir 172 for operating actuators 162, 164 may also be mounted in the machinery space. Air reservoir 172 may have the form or a cylindrical reservoir mounted transversely at the top of machinery space 170 above actuators 162, 164, and may have, for example, a volume of 80 gal. (i.e., twice the typical 40 gal. brake reservoir volume). Since air reservoir 172 is mounted with actuators 162, 164 in machinery space 170, the air pipe distance between them is very short. Actuation may tend to be more rapid without the lag that might otherwise occur with a more distant reservoir.

Door Structure

As noted, the left and right hand doors 100, 102 are symmetrical, such that a description of one is equally a description of the other. The main portion of door 100 (or 102, as may be) is a sheet or pan 174, which may have a turned-up proximal flange 176 and a turned-down distal lip 178, as indicated. Door pan 174 may also have turned up lateral edges 180, the door length (in the x-direction, or longitudinal direction) of car 20 being suited to the opening defined by the lower margins of the hopper discharge section, be it 66 or 68, the upturned lateral edges seating to either side of the fore-and-aft lower margins of the hopper discharge section to form a seal therealong when the door is closed. Pan 174 is reinforced by a long-direction hollow channel 182, oriented parallel to the x-direction of the car. Channel 182 is welded toes-in to form a hollow section. Pan sheet 174 is also reinforced by, and carried by, first and second reinforcements 184, 186 that run across the outward side thereof from the proximal edge to channel 182. The proximal ends of reinforcements 184, 186 extend beyond proximal edge flange 176, and curl upwardly partially therearound to define mounting lugs 200, 202. Further, spindles, or stub shafts 204 are mounted at the ends of C-channel 182 and define connection interfaces, or connection points for both the door suspension members and the door drive train.

Door Linkages

Doors 100 and 102 are suspended from a set of pivotally movable members or links such as may be generally identified as door support linkages 210. Those linkages include a pair of first and second, near end and far end distal linkages, or arms 212, 214, and a pair of first and second, near and far, proximal, short, linkages, or arms 216, 218. As may be noted, the distal linkages, or arms, 212, 214 are longer than the proximal arms 216, 218. Arms 212, 214 have respective first ends pivotally mounted to the upper lateral hopper section support member, namely hollow section beams 78, 80, respectively, at mounting lugs, or feet, 222. This is the stationary, or reference or datum end of the link. The other end of arms 212, 214 is the pivot mount at the connection interface defined at stub shaft 204, which may be termed the distant or swinging end. Similarly, the "fixed" or base, or reference, end of short arms 216, 218 is mounted to a rotational angular motion and torque transmitting member identified as torque tube 224, and the "free" or swinging ends of short arms 216, 218 pick up on mounting lugs 200, 202. Short arms 216, 218 are not rigidly fixed to torque tube 224, but rather are mounted to rotate independently of it. Torque tube 224 is itself mounted for rotation to a pair of first and second (or near and far) mounting fittings or brackets, or pedestals, or reinforcement members or lugs 226, 228, which may themselves have the form of tapering hollow channel sections mounted toes-in to the outside face of the inwardly inclined side sloping sheets of the hopper discharge sections, those hollow sections also defining discharge section reinforcements extending from one end connected to side sill 40, and a second, lower end welded to hollow structural reinforcement 158.

As may be noted, the resultant structure defines a four-bar linkage. The first bar, or base, or datum, is the stationary structure whose position is rigidly fixed as part of the car body, namely the stationary structure of discharge section 66, 68, which includes the footings of mounts of the linkages. The pair of long arm links 212, 214 forms the second bar of the four bar linkage. The pair of short arm links 216, 218 forms the fourth bar of the four bar linkage, and the door panel itself forms the third bar of the four bar linkage. As may be noted, this four-bar linkage is movable between a first position (namely the closed position, shown in FIG. 3*c*) and a second position (namely the fully open position shown in FIG. 3*d*).

In this motion, the long arm link moves through a significantly smaller angular displacement than the short arm link, the long arm moving through roughly 35 to 45 degrees of arc (e.g. approximately 40 degrees), and the short arm link moving through 120 to 150 degrees of arc (e.g. approximately 135 degrees). At the starting position of the motion, both the short and long arms are on angles inward of vertical, such that as the motion begins, both the short and long arms move toward a vertical orientation, and, in so doing, their respective "free" pivot interfaces move in a direction of motion that has both an outward and downward component of motion. That is, dz/dy at both free pivot interfaces is negative; dy being the movement of the interface in the y, or lateral, direction (with the +y direction being defined as a laterally outboard direction) and dz being defined as the movement of the interface in the z, or vertical, direction (with the +z direction being defined as an upward direction). As will be understood, the +y direction for door 100 will be opposite the +y direction for door 102. Thus, since there is a −z component of motion, the initial motion serves to "lift" or "unseat" the pan, i.e., move it away from the seat, while the door is also moving predominantly laterally outboard in the +y direction. In this initial stage of motion, the absolute value of dz/dy is also considerably less than 1; that is, the motion is more strongly horizontal than vertical. This horizontal predominance increases as the swinging arms move toward their respective vertical positions. Once past the vertical, the respective pivot connections (or "free" pivot interfaces) begin to move upward while moving laterally outward. The angular displacement of the short arm is more rapid, and its motion is soon predominantly upward (dz/dy>1), and continues so throughout the remainder of the stroke. While this occurs, the longer arm continues its predominantly horizontal motion on a less rapidly changing angular displacement and less strongly positive dz/dy. The effect is that the door panel itself tilts from a very nearly completely horizontal condition to a tipped, inclined position. At the end of the motion, the inside lip of the door may be positioned substantially directly above the rail, or just laterally shy of the inside of the rail bullnose, such that lading exiting the hopper discharge may tend to fall between the rails.

As will be appreciated, returning the four-bar linkage from the second position (e.g. the fully open position shown in FIG. 3*d*) to the first position (e.g. the closed position, shown in FIG. 3*c*) is substantially the inverse of the motion described above.

Drive Train

The motion of the four bar linkage in the opening direction may be commenced by a transmission or drive train 230, the same drive train being used to close the doors in the other direction once the lading has been discharged.

The drive train includes drive actuators, 162, 164 noted above. Those actuators may be cylindrical rams, such as pneumatic cylinders. One end of each cylinder is pivotally mounted to a base, or reference, or datum or body lug 234. In the embodiment illustrated, the piston of each actuator is oriented inboard toward the center of the car, and the back or the actuator is oriented outboard toward side sill 40. The second end of each actuator is pivotally mounted to an output lever 240 at an output pivot connection 236. Output lever 240 has a fixed fulcrum or pivot 238 mounted on a pedestal or footing mounted to the face of end wall 88.

Output lever 240 has two other pivotal connections namely first and second output interface connections, 242 and 244. The fulcrum, namely fixed pivot 238, is located mid-way between pivotal connections 242 and 244. Push rods, or connecting rods, or links 256 and 264 respectively extend from connections 242 and 244 to the crank arms 246, 258 of the left and right hand doors. Pivotal connection 244 is located at the distal end of output lever 240. Pivot connection 236 is located at the opposite end of output lever 240 from connection 244. Lever 240 is effectively a force and motion splitting device. That is, the input at 236 transmits a total input moment equal to the sum of the output at 242 and 244. Inasmuch as the geometry is symmetrical, the output transmitted to the cranks 246, 258 driving the pairs of left and right hand doors is also matched. In this embodiment the fulcrum, pivot 238, is located on the longitudinal centerline 122 of the car. The input from each respective actuator is predominantly transverse, and is transmitted to the splitter, i.e., lever 240, at a height greater than the height of the fulcrum 238.

A driving arm or crank arm or crank 246 is pivotally mounted to the near end of torque tube 224. A connecting member in the nature of a drag link or push rod 256 has a first pivotal connection to output lever 240 at connection 242, and a second pivotal connection at the distal tip of crank 246. The drive train includes two further members, the first being a driven arm 248 and the second being a follower or slave link 250. In normal, or automatic, or power-driven mode, driven arm 248 is connected to crank 246, such that when crank 246 turns, driven arm 248 turns through the same angle and transmits force and motion to slave link 250, which, in turn, drives the door, be it 100 or 102. Motion of connection 236 caused by actuator 162 (or 164, as may be) will therefore necessarily cause crank 246 to move. As may be understood, in tripping door 100 (or 102) to open, member 256 acts in tension as a drag link. In closing door 100, member 256 acts in compression as a connecting rod or push rod. Follower 250 is pivotally joined at a connection 254 at one end to the distal tip of driven arm 248, and also pivotally connected to stub shaft 204. Rotation of driven arm 248 will move the location of connection 254, which will, in turn cause stub shaft 204 to move, opening or closing door 100 (or 102). Follower 250 also has an over-center lock in the form of a finger or abutment 252. When driven arm 248 is moved to an over center condition with respect to follower 250 (i.e., the pivot axes at 255, 257, and 259 pass through a condition of planar alignment) abutment 252 engages driven arm 248 preventing further motion. As the near end of door 100 (or 102) moves, consequent motion occurs in the links of the four bar linkage of the door. Torque tube 224 may tend to force driven arms 248 at both ends of torque tube 224 to move in unison, and thereby to discourage twisting of the door.

A similar crank arm 258 is mounted to torque tube 224 of door 102, and functions in the same manner, though of opposite hand. Force and motion are transmitted to crank 258 from second output interface connection pivot 244 of output lever 240 by means of a second transmission member in the nature of a drag link or push rod 264. Thus motion of the cylinder of actuator 162 (or 164, as may be) results in laterally outboard motion of drag links 256 and 264 in opposite directions on their respective sides of car 20, such that doors 100 and 102 operate at the same time in a coordinated, substantially symmetrical manner. It may be noted that output lever 240 is also a force divider in the sense that the single force (and motion) received from actuator 162 (or 164, as may be) is split and distributed to the right and left hand portions of the drive train. As may be noted, in each case the crank counter-rotates relative to the short, outboard, links 216, 218 of the four bar linkage. That is, as crank 246 (or 258) turns clockwise, the short linkages 216, 218 turn counter-clockwise.

The net result is a mid-car installation that does not compete for space with the brake cylinder or brake reservoir over the truck shear plate. Instead, the mounting is sheltered under the slope sheets above the level of the side sills in a relatively protected location, in which the actuators are also located above the fulcrum of the output divider. The output divider has a single input and two outputs, each of which drives a pushrod connected directly to the respective crank without additional intermediate linkages or connections.

In the embodiment of FIGS. 4*a*-4*h*, an open top hopper car 320 is substantially similar to open-topped hopper car 20, and may be taken as having the same structural features unless noted otherwise. It differs therefrom to the extent that hopper car 320 has a car body 322 that has a single hopper 324 with full-length left and right hand doors 326, 328. It will be appreciated that car 320 does not have intermediate slope-sheets, and therefore lacks a mid-car machinery space such as machinery space 170. In this instance there is a machinery space defined longitudinally inboard of stub wall 330 (and therefore longitudinally inboard of main bolster 108), in the lee of sloped end sheet 332. Main shear plate 334 tapers forwardly of main bolster 108 inboard thereof to underlie the side sills longitudinally to the location of a stiffening frame or stiffening box 336 to which the drive cranks 246, 258 are pivotally mounted. The geometry of the four bar linkage, and of doors 326, 328 may be taken as being the same as that of doors 100, 102, except that doors 326, 328 (and hopper discharge section 338) are much longer than doors 100, 102 (and either of hopper discharge sections 66, 68), and that there are four second linkages, or short arms, 216 (or 218), rather than two. The four short arms are not joined by a common torque tube, although they could be. Since the door is very long, it may be generally be prone to twisting in torsion about the x-axis (or longitudinal axis). For the purposes of describing doors 326, 328, "very long" means that the length, L, of the doors is greater than 50% of the overall trucks center distance, (i.e., the truck center distance, D, is the distance from the center of the web of one main bolster to the center of the web the other main bolster). In the embodiment shown, the ratio of L/D is about ⅔. The ratio of L/W is greater than 3:1; where W is the width of the door, in the cross-wise direction. To discourage torsional twisting of doors 326, 328, car 320 has actuators 340, 342 mounted at both ends of the doors, such that both ends of each door are driven, rather than relying on one end to follow as a slave linkage.

Figure 4A:
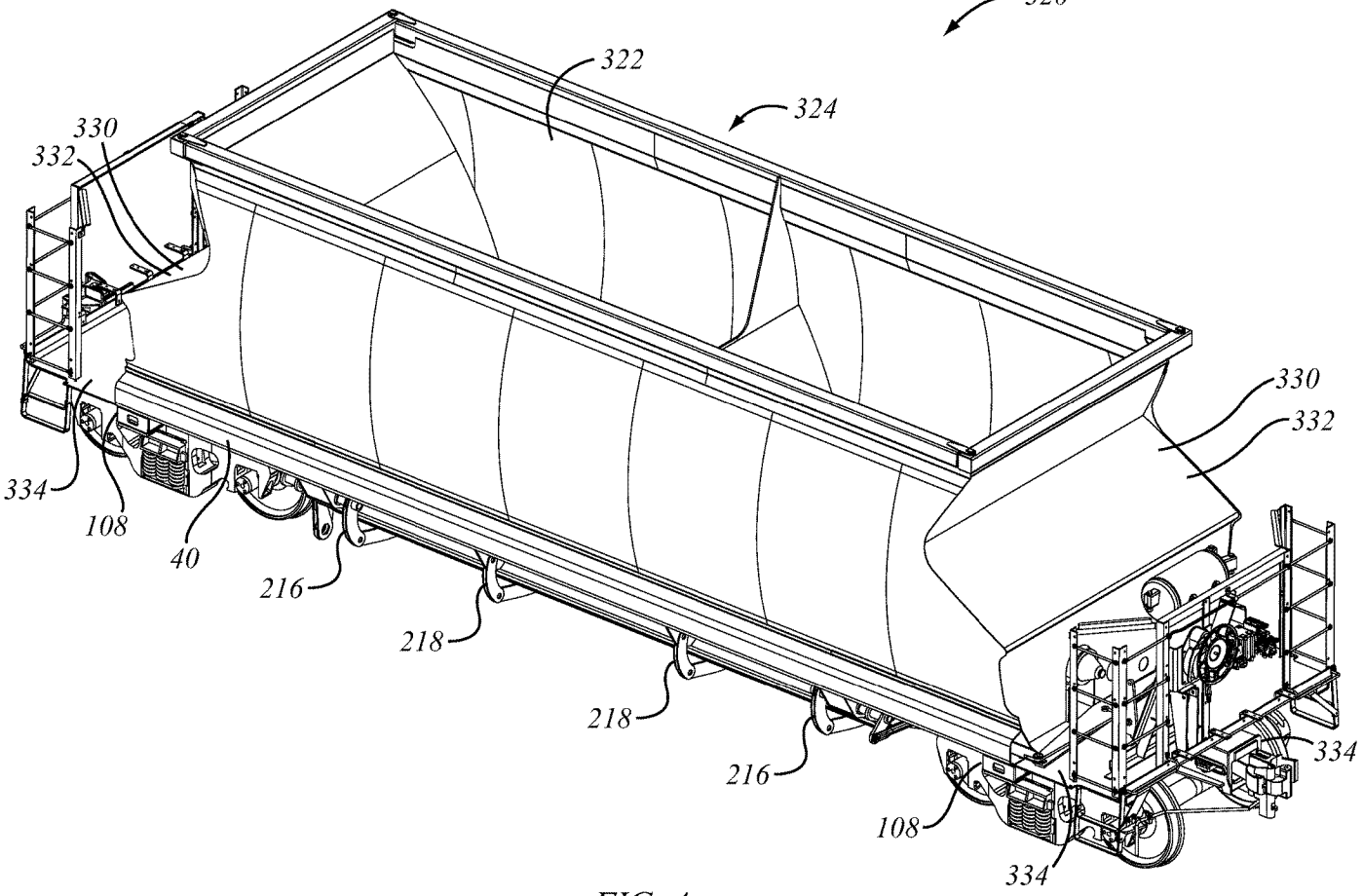
FIG. 4*a* shows an isometric view of another embodiment of a railroad freight car similar to that of FIG. 1*a;*
Figure 4B:
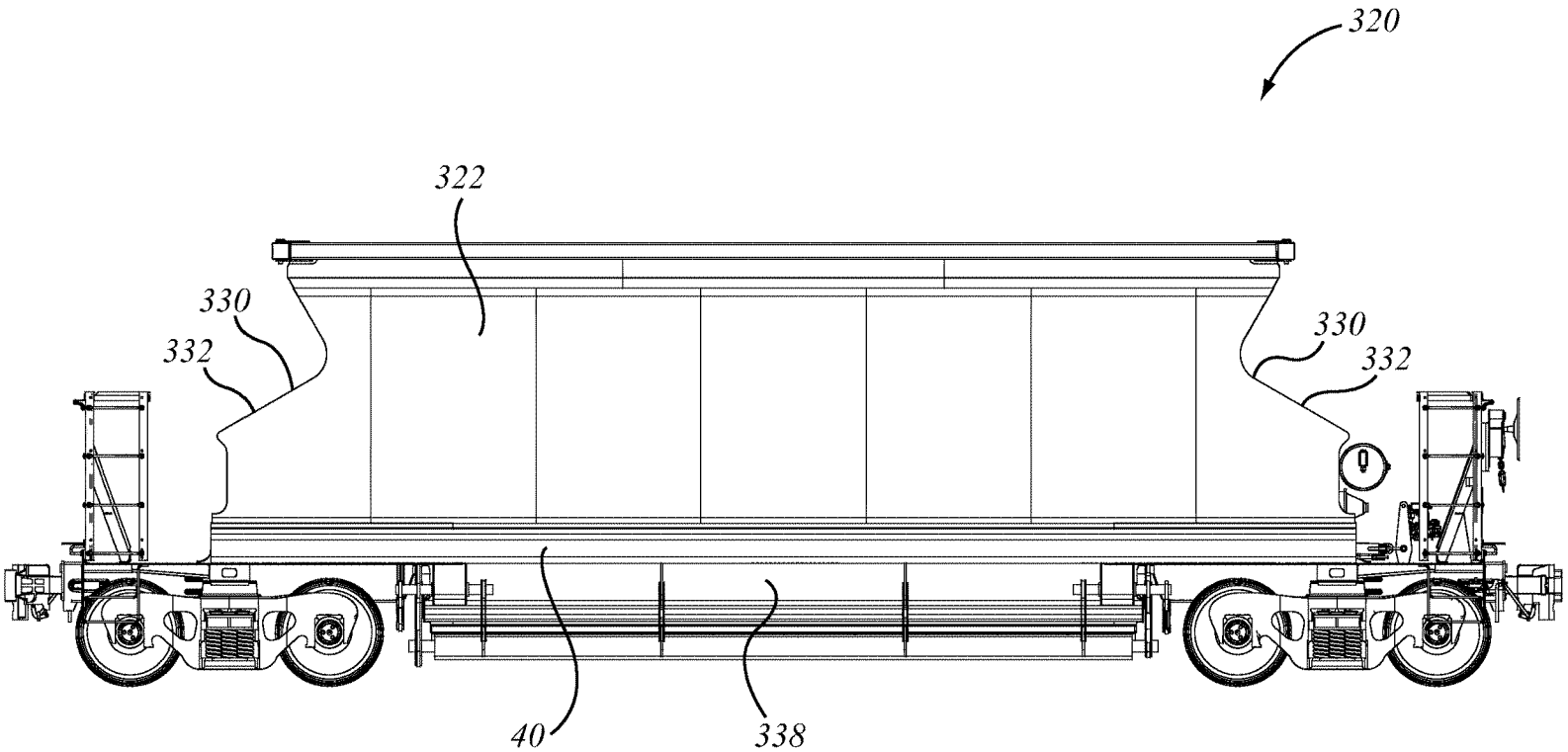
FIG. 4*b* shows side view of the railroad freight car of FIG. 4*a;*
Figure 4C:
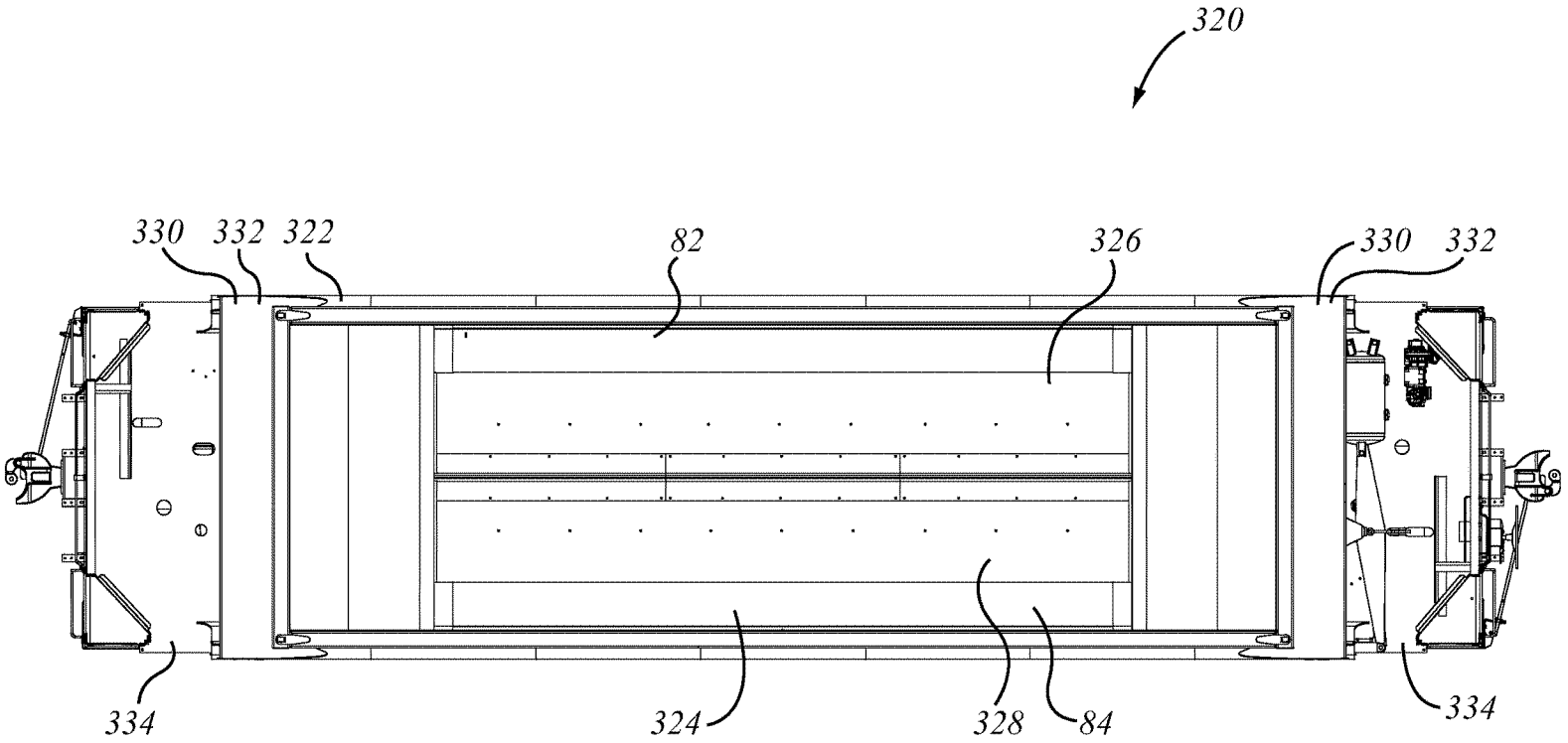
FIG. 4*c* shows a top view of the railroad freight car of FIG. 4*a;*
Figure 4D:
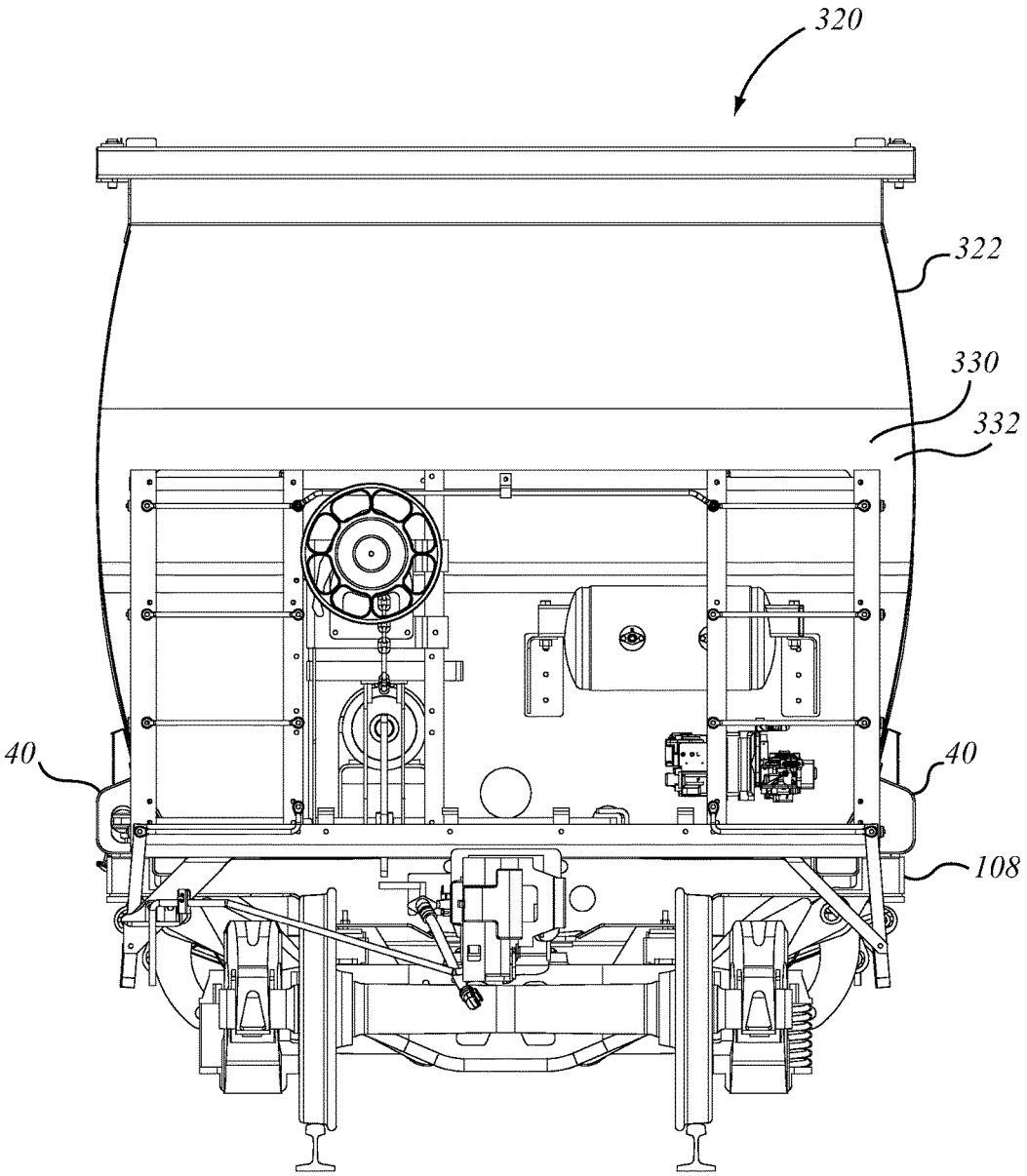
FIG. 4*d* shows an end view of the railroad freight car of FIG. 4*a;*
Figure 4E:
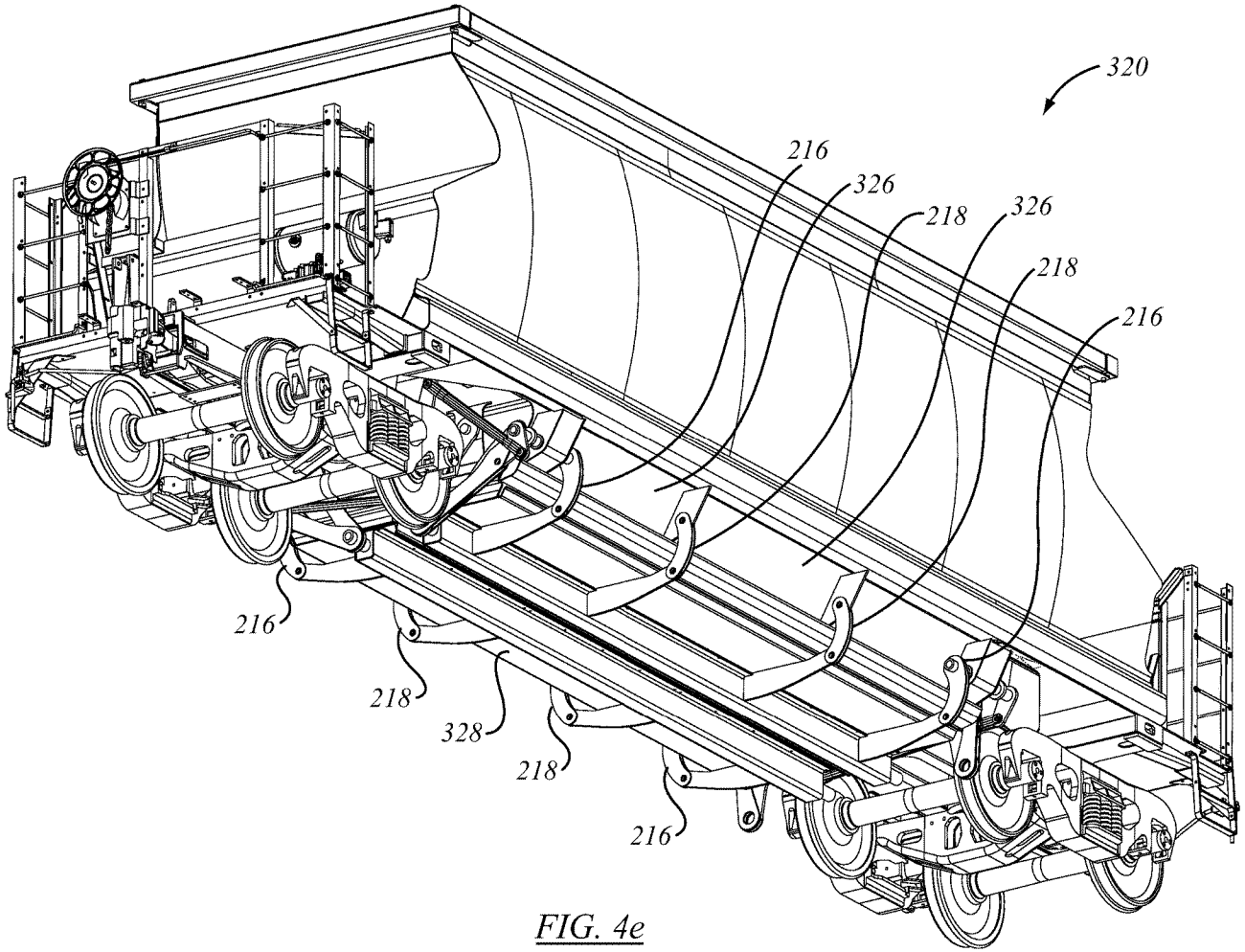
FIG. 4*e* shows an isometric view, from underneath, of the railroad freight car of FIG. 4*a;*
Figure 4F:
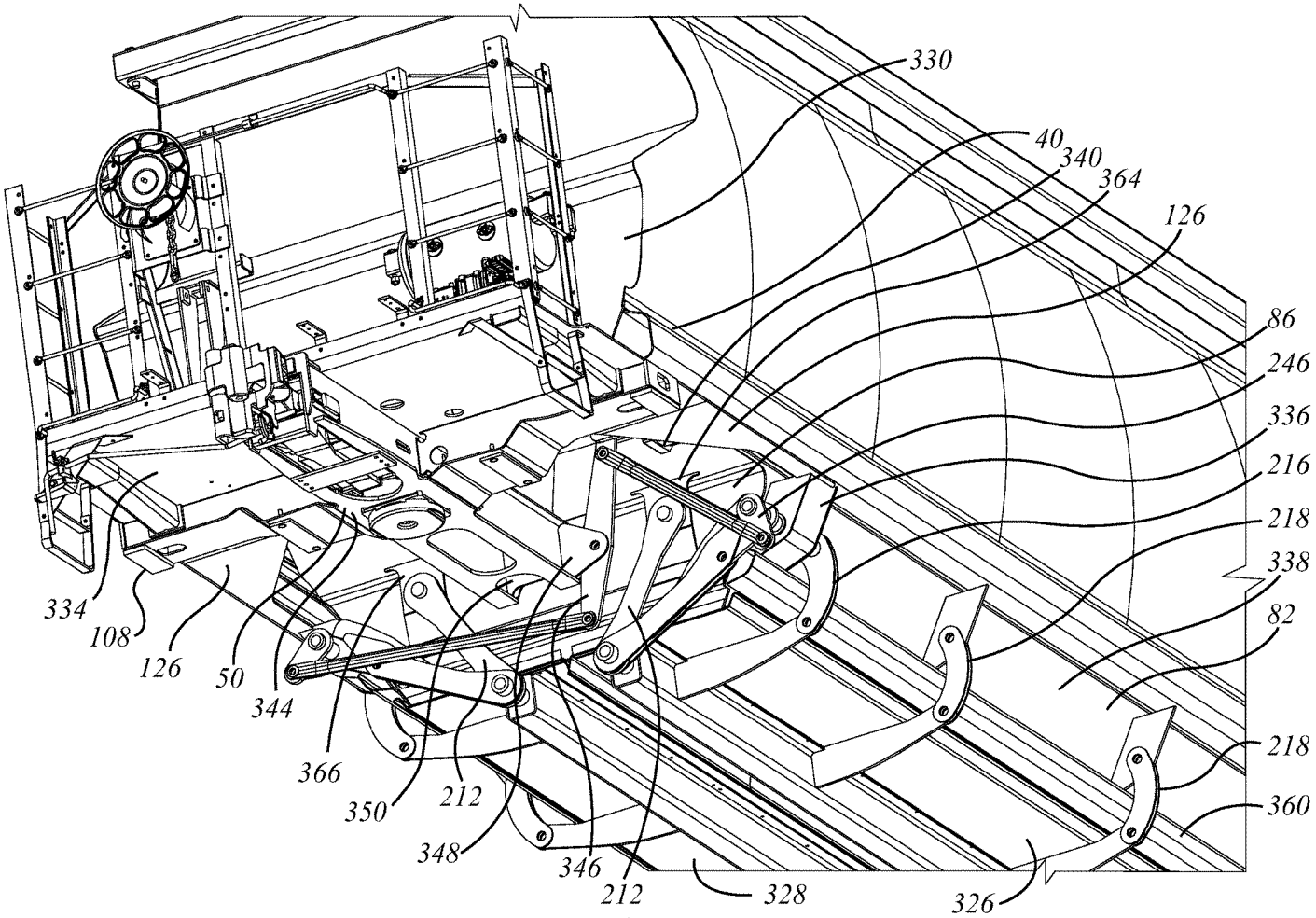
FIG. 4*f* shows an enlarged detail of FIG. 4*e*, with the trucks removed.
Figure 4G:
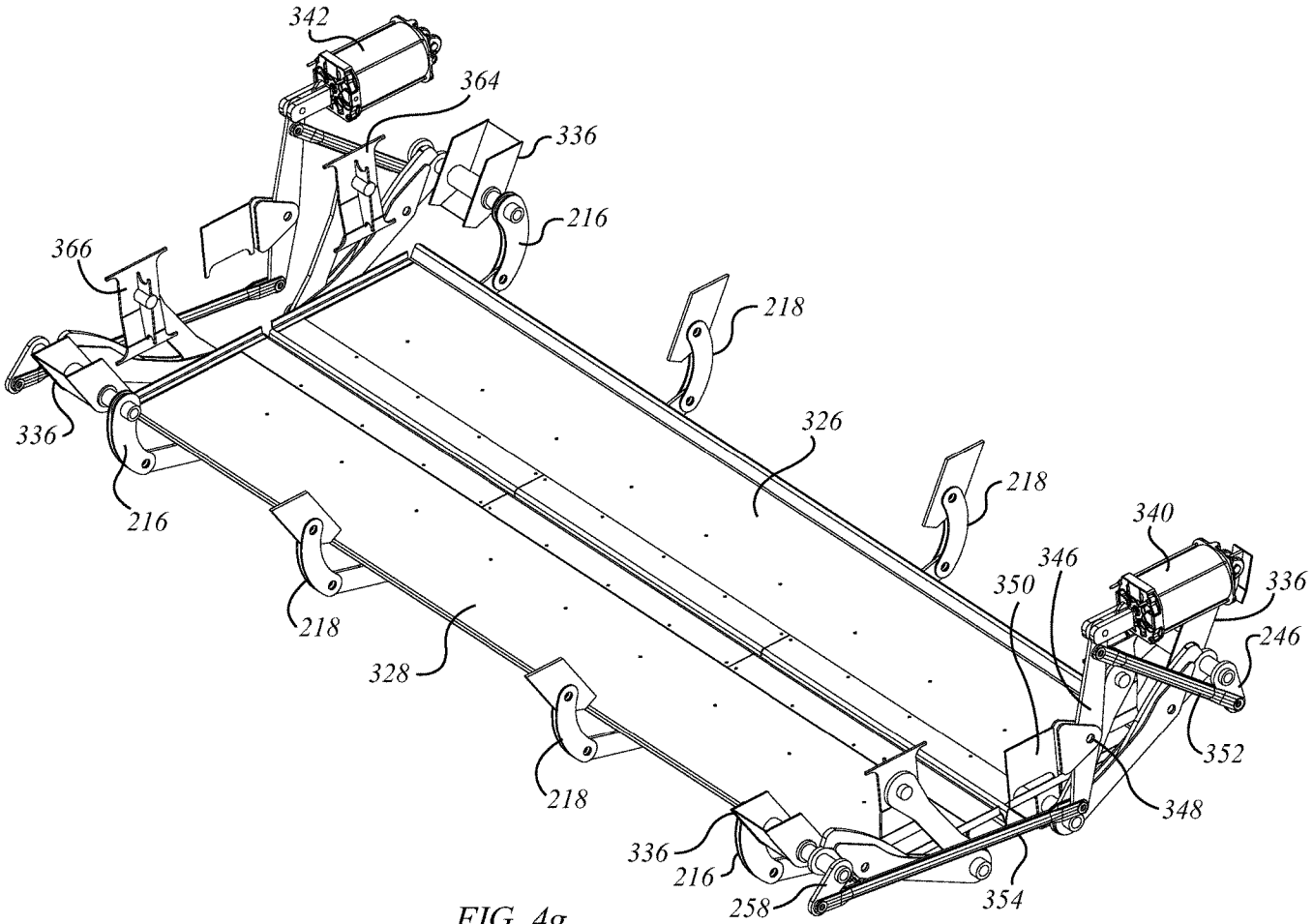
FIG. 4*g* shows a perspective view, from above and to one side and one end, of the doors of FIG. 4*c*, in a closed position and with all surrounding structure removed.
Figure 4H:
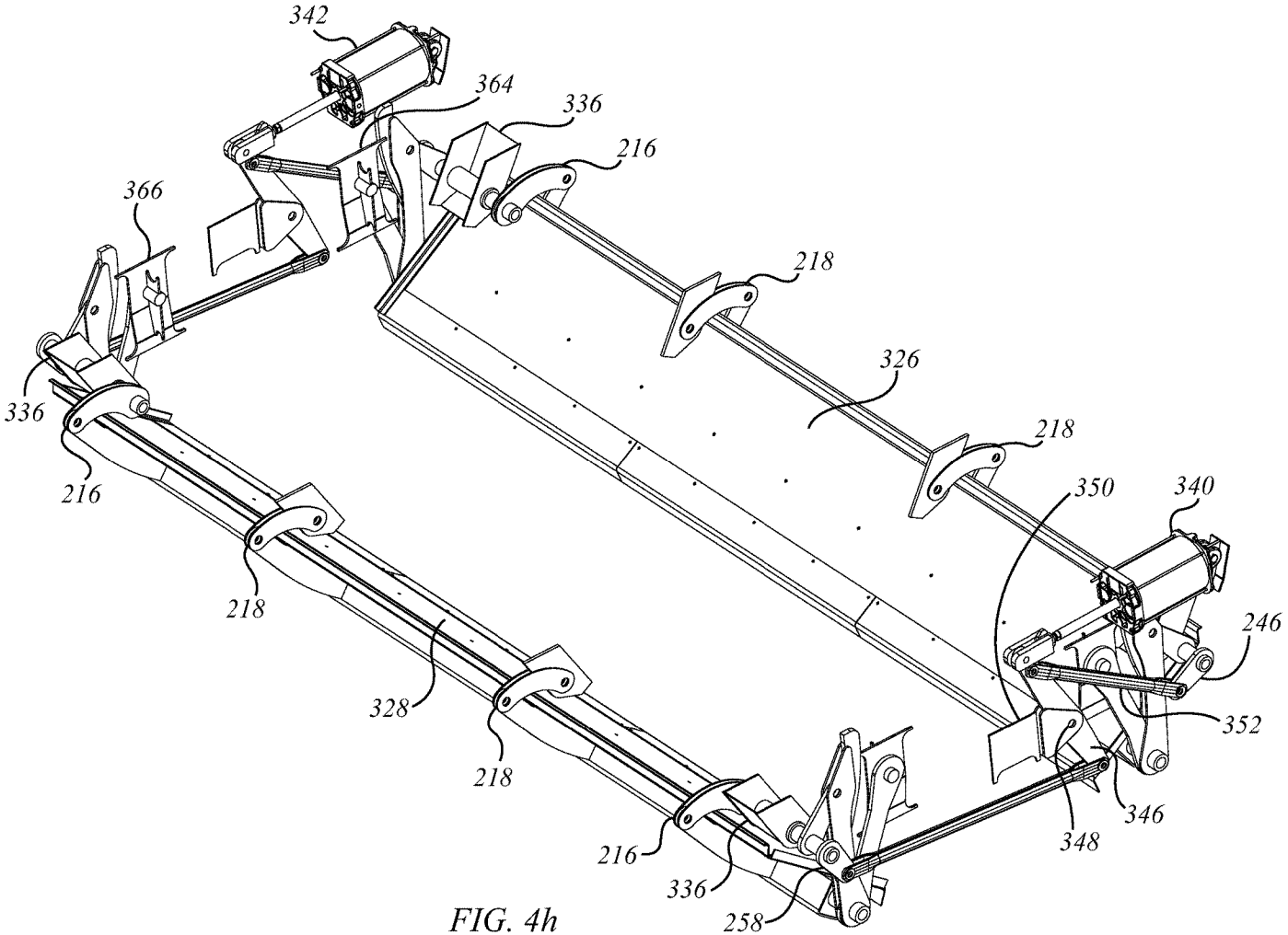
FIG. 4*h* shows a perspective view, of the doors of FIG. 4*g*, in an open position.

The presence of stub sill 344 requires placement of the splitter lever 346 off-center, as illustrated in FIG. 4*f*. That is, fulcrum mount 348 is mounted to a side web of stub sill 344 inboard of the truck center closely adjacent to end wall member 86. A cross-wise internal shear web 350 is mounted within stub sill 344, co-planar with mount 348 to provide shear web continuity. A first end of splitter lever 346 extends upwardly of bottom flange 50 of stub sill 344, and a first connecting rod 352 is pivotally connected from between that first end of lever 346 and crank 246. A second connecting rod pivot connection is located to the other side of the fulcrum, the first and second connecting rod pivot connections being equidistant from the fulcrum. A second connecting rod 354 extends between that second connecting rod pivot connection and crank 258. The actuator input pivot connection is located at the far end of lever 346. As before, motion of the actuator drives lever 346, which drives the connecting rods, which turns cranks 246 and 258, operating doors 326, 328 accordingly.

Other features may also be noted in FIG. 4*f*. For example, the tapering triangular portion 126 of main shear plate 334 is seen extending longitudinally inboard of main bolster 108, the tapered end underlying side sill 40. In view of the great length of doors 326 and 328, the bottom reinforcement of the lower margin of wall member 82 is reinforced by a substantial closed section hollow structural member 360, which may be in the form of a pressed or roll-formed channel section welded toes-in to the lower margin of wall member 82. Rather than being mounted on a common torque-tube, the short linkage arms 218 may be mounted to angles or gussets mounted to the outside of wall member 82, and that extend from side sill 40 to member 360. The large mounting box frame 336 that defines the pivot support for the end short linkage arm 216 and the crank 246 (or 258) at the end of the car are shown as 336, and the mounting box frames for the long, inboard linkage arms 212 are shown as 364, 366. As can be seen, actuator 340 (or 342) is mounted above the level of main shear plate 334, (and, therefore, above the level of the upper flange of the center sill, namely stub sill 344) and above the level of the bottom flange of side sill 40, tucked away in a compact installation in the lee of the end slope sheet, inboard of end stub wall 330 in a relatively protected location in a machinery space in which it does not compete for space with the brakes and brake reservoir.

The installation of FIG. 4*f* is shown in the context of a car having a single set of, long, left and right hand doors on a single long discharge section. However, such an end installation could also be used in a car having internal slope sheets, such as car 20, where it is desired to have a powered-door transmission at both ends of a longitudinal door (or doors), whether to provide faster actuation, to deal with doors having greater inertia, or to avoid twisting e.g., of a door having low torsional stiffness about the x-axis. It may also be noted that the installation of FIG. 4*f* can be used at a mid-car location in the lee of a pair of internal slope sheets in a car having a straight-through center sill (as opposed to stub center sills), in each case the actuators being mounted above the fulcrum of the splitting lever.

In the embodiment of FIGS. 5*a*-5*f*, a hopper car 420 is substantially similar to open-topped hopper car 20, and may be taken as having the same structural features unless noted otherwise. It differs therefrom to the extent that hopper car 420 has a single door 400 or 402 for each of hoppers 458 or 460, respectively, includes one actuator 462 for opening and closing both doors 400, 402 simultaneously, and is provided with a roof 404. To accommodate this configuration, doors 400, 402 extend laterally across the entirety of rectangular openings 490, 492 of hoppers 458, 460, respectively. Roof 404 need not be included and car 420 may be an open-topped hopper car in some embodiments.

In the previously described embodiment of hopper car 20, one actuator 162 (or 164, as may be) simultaneously opened or closed two doors 100, 102 spaced longitudinally from the actuator 162 in the same direction. In the embodiment of car 420, one actuator 462 simultaneously opens or closes two doors 400, 402 spaced longitudinally from the actuator 462 in opposite directions. Resultantly, while the doors 100, 102 were predominately offset in a lateral direction from one another in car 20, the doors 400, 402 are predominately offset in a longitudinal direction from one another in car 420. With the exception of the offset in the longitudinal direction, the motion of the four bar linkage of doors 400, 402 is similar to that of linkage of doors 100, 102.

The motion of the four bar linkage in the opening direction may be commenced by a transmission or drive train 430, the same drive train being used to close the doors in the other direction once the lading has been discharged. The drive train includes drive actuator 462, noted above. Actuator 462 may be a cylindrical ram, such as a pneumatic cylinder. One end of the cylinder is pivotally mounted to a base, or reference, or datum, or body lug 434. In the embodiment illustrated, the piston of the actuator is oriented inboard toward the center of the car, and the back of the actuator is oriented outboard toward side sill 40. The second end of each actuator is pivotally mounted to an output lever 440 at an output pivot connection 436. Output lever 440 has a fixed fulcrum or pivot 438 mounted centrally on a support frame 494. Support frame 494 spans the longitudinal space between hoppers 458, 460 is mounted to hollow structural sections 156 on the end wall 86.

Output lever 440 has two other pivotal connections namely first and second output interface connections, 442 and 444, which may be pivotal connections. The fulcrum, namely fixed pivot 438, is located mid-way between pivotal connections 442 and 444. Push rods, or connecting rods, or links 456 and 464 respectively extend from connections 442 and 444 to the crank arms 446, 448 of the front and back doors 400, 402. Second output interface connection 444 is located at the distal end of output lever 440. Pivot connection 436 is located at the opposite end of output lever 440 from connection 444. Lever 440 is effectively a force and motion splitting device. That is, the input at 436 transmits a total input moment equal to the sum of the output at 442 and 444. Inasmuch as the geometry is symmetrical, the output transmitted to the cranks 446, 448 driving the front and back doors is also matched. In this embodiment the fulcrum, pivot 438, is located on the longitudinal centerline 422 of the car. The input from actuator 462 is predominantly transverse, and is transmitted to the splitter, i.e., lever 440, at a height greater than the height of the fulcrum 438.

A driving arm or crank arm or crank 446 is pivotally mounted to the near end of torque tube 424. A connecting member in the nature of a drag link or push rod 456 has a first output interface connection to output lever 440 at connection 442, and a second output interface connection at the distal tip of crank 446. The drive train includes two further members, the first being a driven arm 452 and the second being a follower or slave link 450. In normal, or automatic, or power-driven mode, driven arm 452 is connected to crank 446 (or 448, as may be), such that when crank 446 turns, driven arm 452 turns through the same angle and transmits force and motion to slave link 450, which, in turn, drives the door, be it 400 or 402. Motion of connection 436 caused by actuator 462 will therefore necessarily cause cranks 446 and 448 to move. As may be understood, in tripping door 400 to open, member 456 acts in tension as a drag link. In closing door 400, member 456 acts in compression as a connecting rod or push rod. Follower 450 is pivotally joined at a connection 454 at one end to the distal tip of driven arm 452, and also pivotally connected to stub shaft 406. Rotation of driven arm 452 will move the location of connection 454, which will, in turn cause stub shaft 406 to move, opening or closing door 400. Follower 450 also has an over-center lock in the form of a finger or abutment 466. When driven arm 452 is moved to an over center condition with respect to follower 450 (i.e., the pivot axes at 455, 457, and 459 pass through a condition of planar alignment) abutment 466 engages driven arm 452 preventing further motion. As the near end of door 400 moves, consequent motion occurs in the links of the four bar linkage of the door. Torque tube 424 may tend to force driven arms 452 at both ends of torque tube 424 to move in unison, and thereby to discourage twisting of the door.

A similar crank arm 448 is mounted to torque tube 424 of door 402, and functions in the same manner, though of opposite hand. Force and motion are transmitted to crank 448 from second output interface connection pivot 444 of output lever 440 by means of a second transmission member in the nature of a drag link or push rod 464. Thus motion of the cylinder of actuator 462 results in laterally outboard motion of drag links 456 and 464 in opposite directions on their respective sides of car 420, such that doors 400 and 402 operate at the same time in a coordinated, substantially symmetrical manner. It may be noted that output lever 440 is also a force divider in the sense that the single force (and motion) received from actuator 462 is split and distributed to the right and left hand portions of the drive train. As may be noted, in each case the crank counter-rotates relative to the short, outboard, links 416, 418 of the four bar linkage. That is, as crank 446 (or 448) turns clockwise, the short linkage 416 (or 418) turns counter-clockwise.

The net result is a mid-car installation that does not compete for space with the brake cylinder or brake reservoir over the truck shear plate. Instead, the mounting is sheltered under the slope sheets above the level of the side sills in a relatively protected location, in which the actuators are also located above the fulcrum of the output divider. The output divider has a single input and two outputs, each of which drives a pushrod connected directly to the respective crank without additional intermediate linkages or connections.

The doors in the various cars may be operated by a control unit that is connected to operate the valves of the system causing the actuators to advance or retract, as may be. Such a control unit may be used on any of cars 20, 320, or 420. In this instance a control box, or controller is indicated as 480. Controller 480 may be mounted in the lee of the slope sheets closely adjacent to whichever actuator it is intended to control, such that the various air pipes may be kept short, such as may reduce lag time in reaction to commands. Controller 480 may have an external actuation interface member 482, that is, a member defining an interface such that the controller may be operated externally to car 20, 320, or 420. In the examples shown, external actuation interface member 482 may have the form of a magnetic field sensor 484 such as may be mounted on an outside portion of the car. In the examples of FIGS. 1*a*, and 2*a*, magnetic sensor 484 is mounted to the side of the car above side sill 40 at a mid-car, or mid-span location immediately adjacent to controller 480. When exposed to a magnetic signal of a first polarity, the doors open; when exposed to signals of the opposite polarity, the doors close. An unloading facility may have magnetic signal emitting devices at track-side such that as the car rolls past, the signals are received and the doors open and close accordingly. It may be that the signal sensor may also need a coded recognition signal to prevent inadvertent or unauthorized opening and closing of the doors.

Figure 5A:
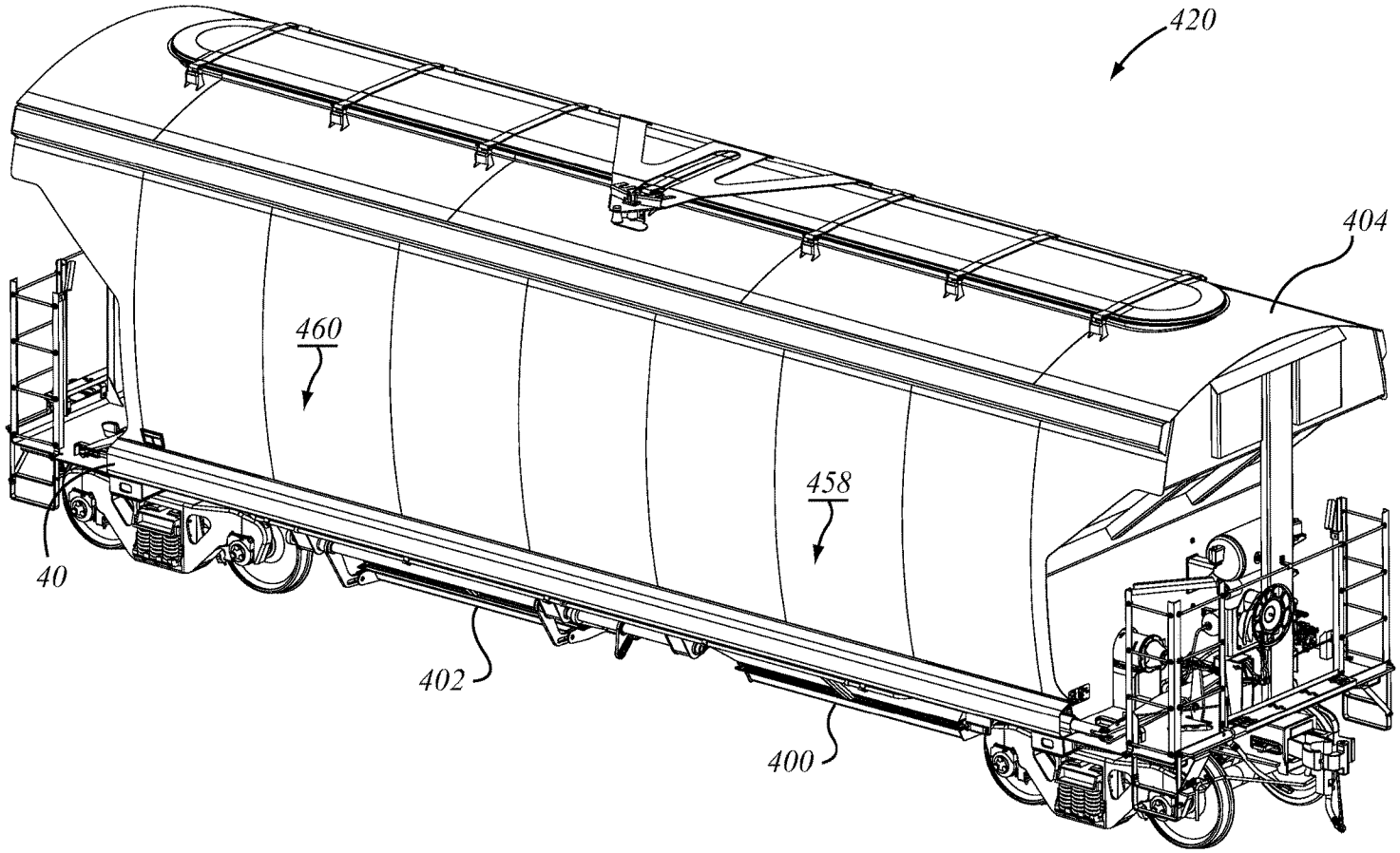
FIG. 5*a* shows an isometric view of another embodiment of a railroad freight car similar to that of FIG. 1*a;*
Figure 5B:
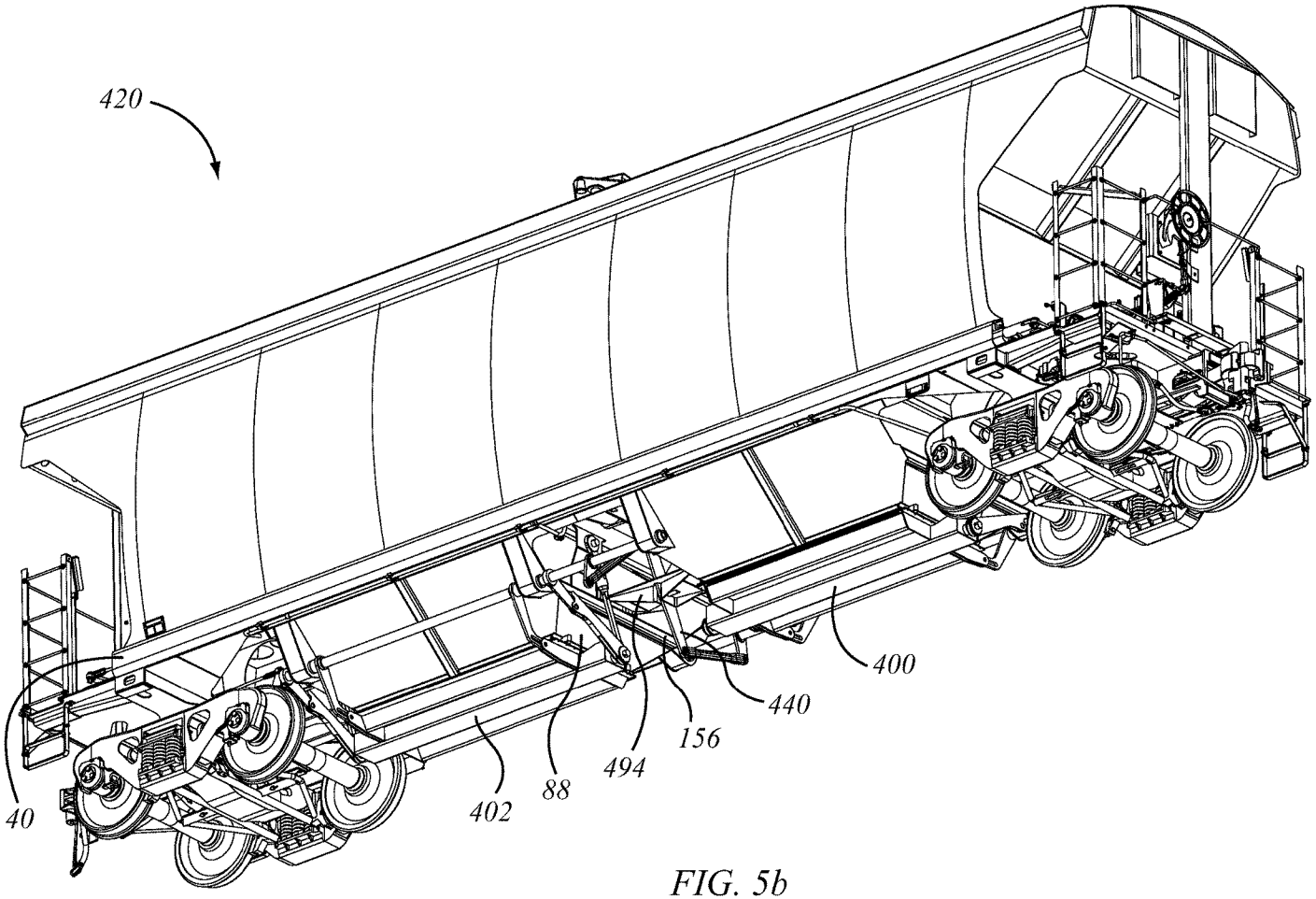
FIG. 5*b* shows an isometric view, from below, of the railroad freight car of FIG. 5*a;*
Figure 5C:
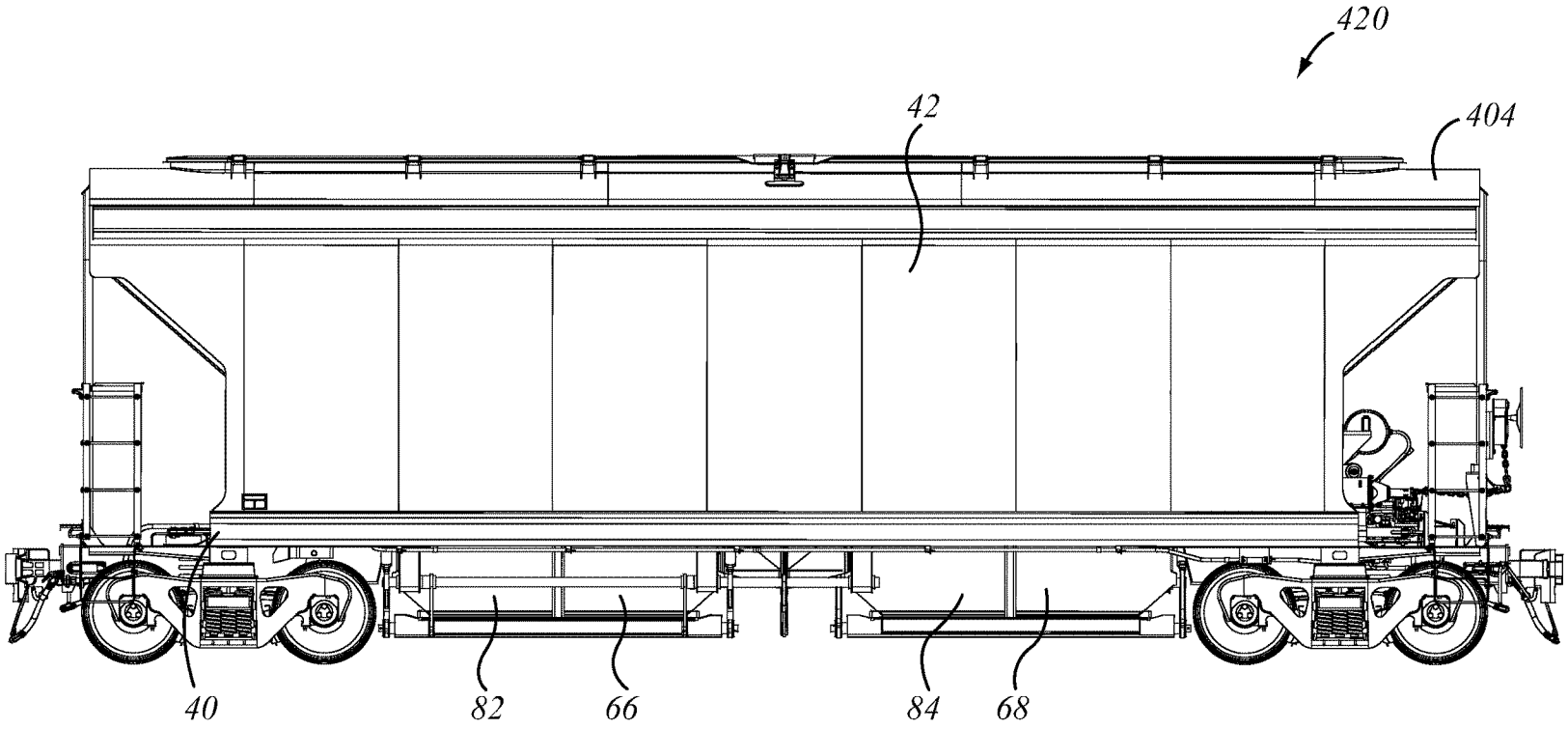
FIG. 5*c* shows a side view of the railroad freight car of FIG. 5*a;*
Figure 5D:
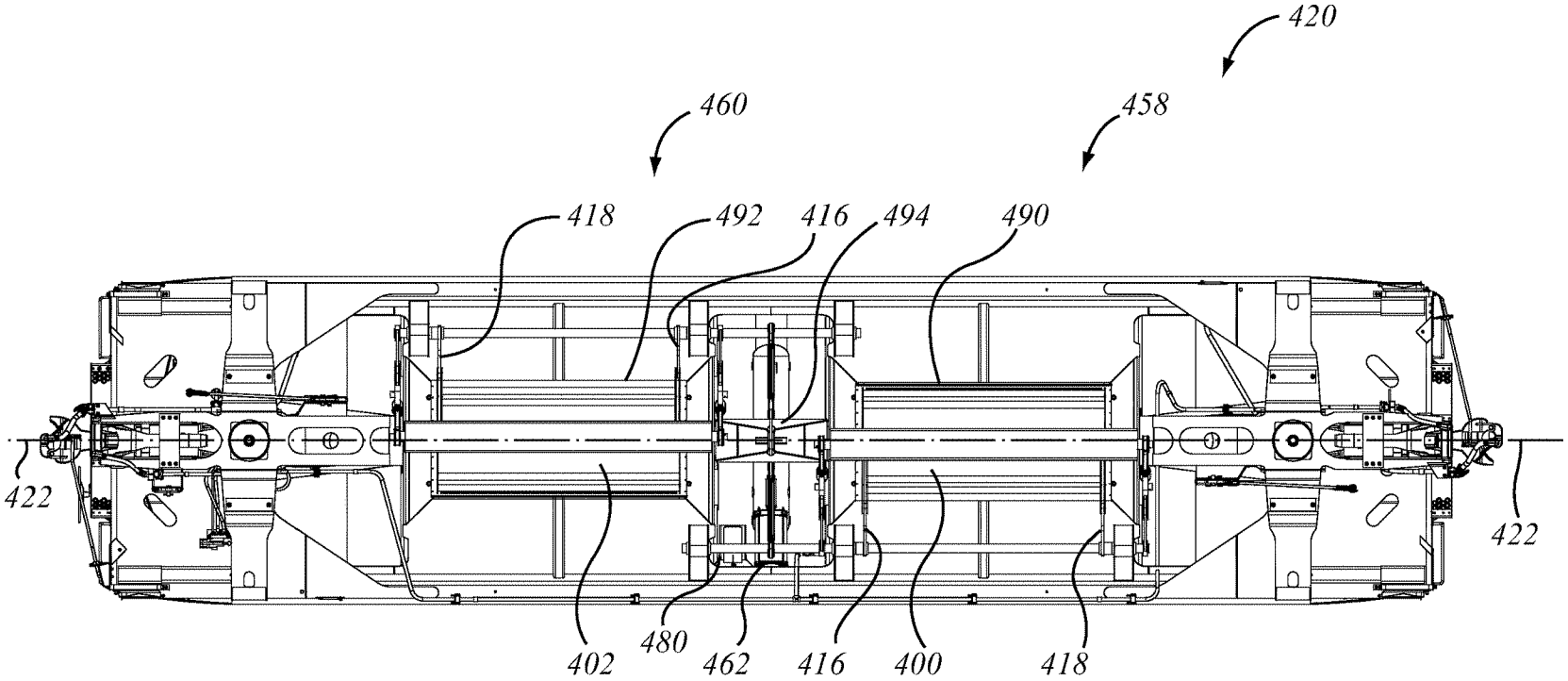
FIG. 5*d* shows a bottom view of the railroad freight car of FIG. 5*a*, with the trucks removed.
Figure 5E:
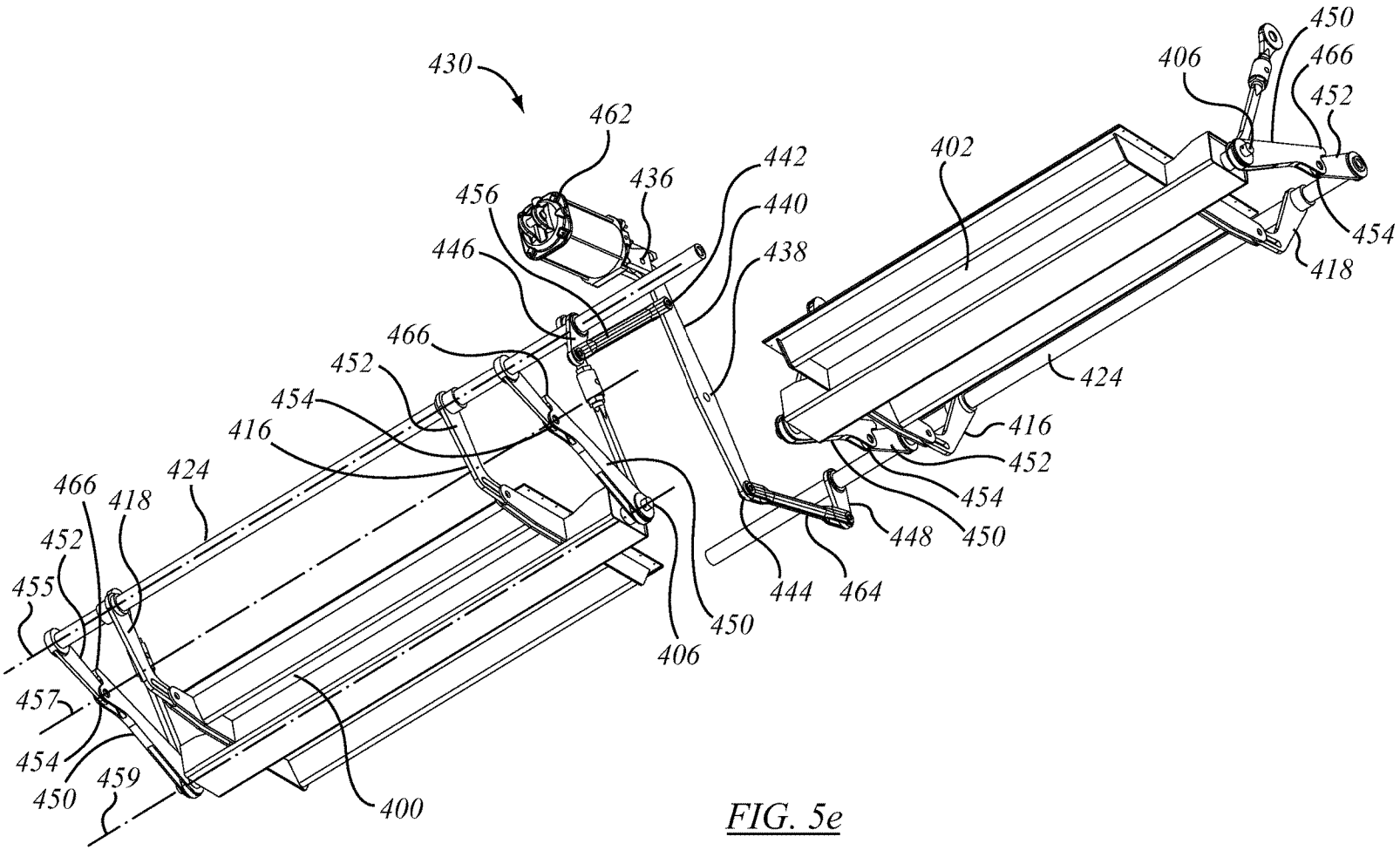
FIG. 5*e* shows a perspective view, from below and to one side and one end, of the doors of FIG. 5*d*, in a closed position and with all surrounding structure removed.
Figure 5F:
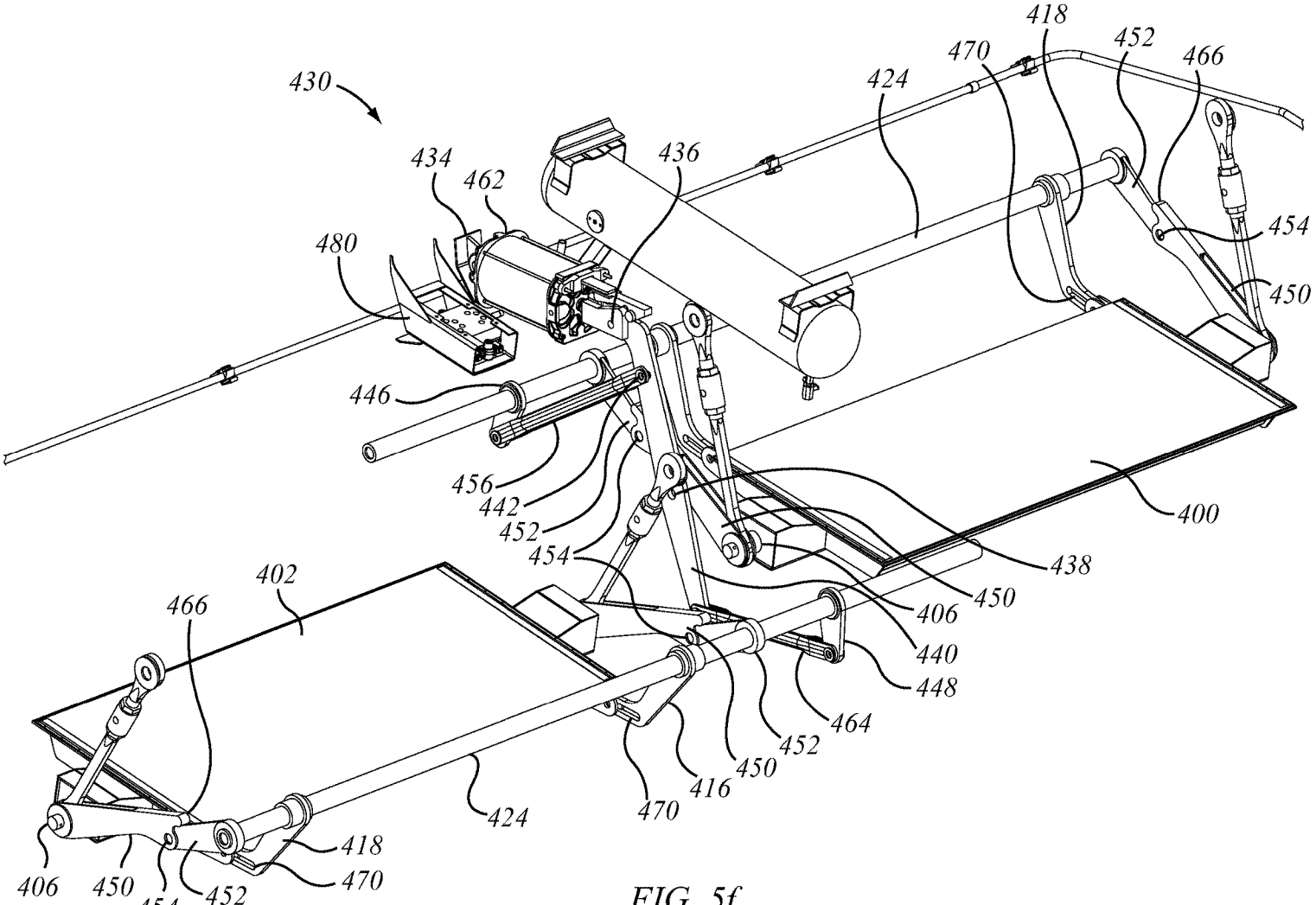
FIG. 5*f* shows a perspective view, from above and to one side and one end, of the doors of FIG. 5*e*, in the closed position.
Figure 5G:
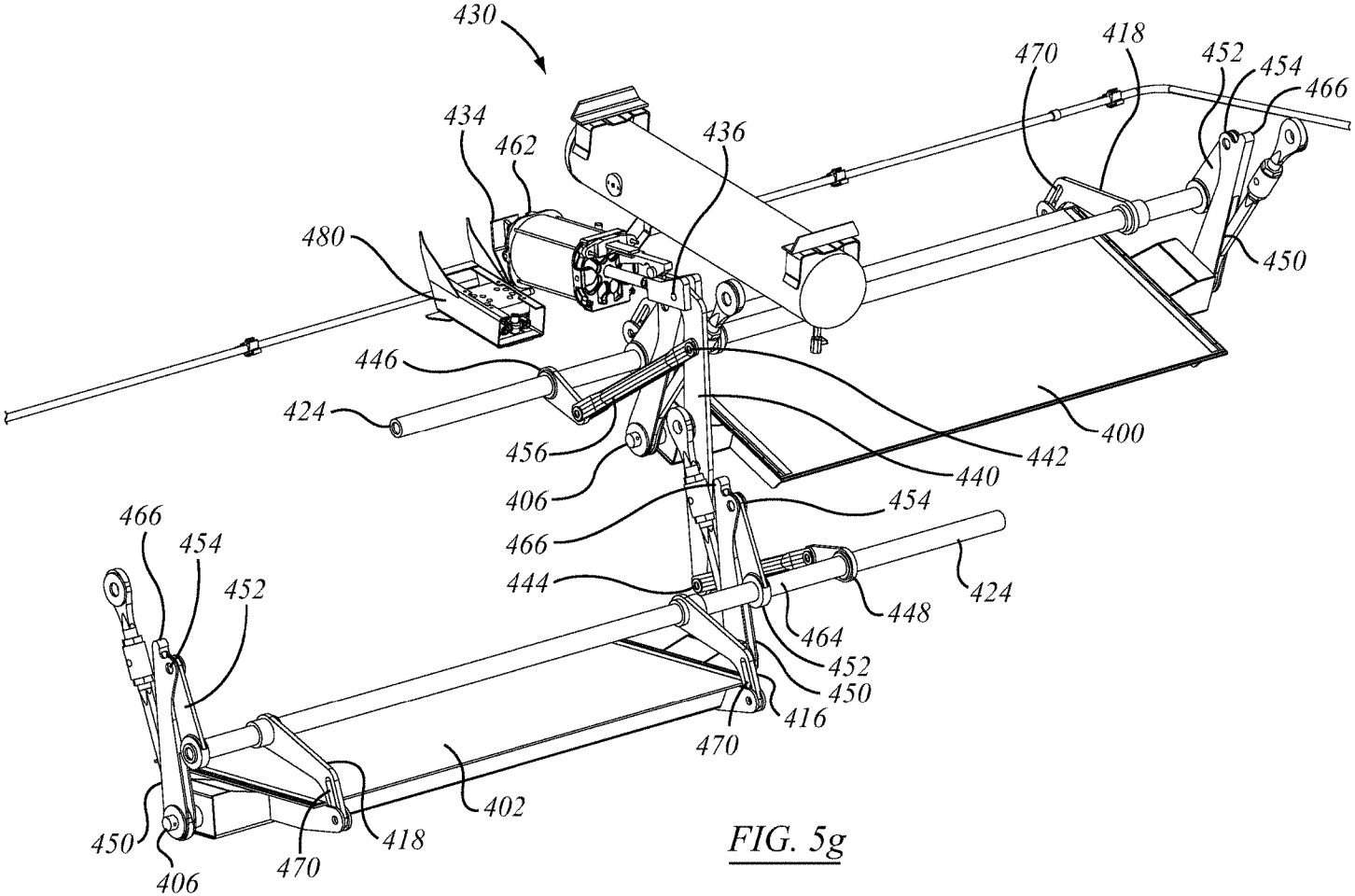
FIG. 5*g* shows a perspective view of the doors of FIG. 5*e*, in an open position.
Figure 6A:
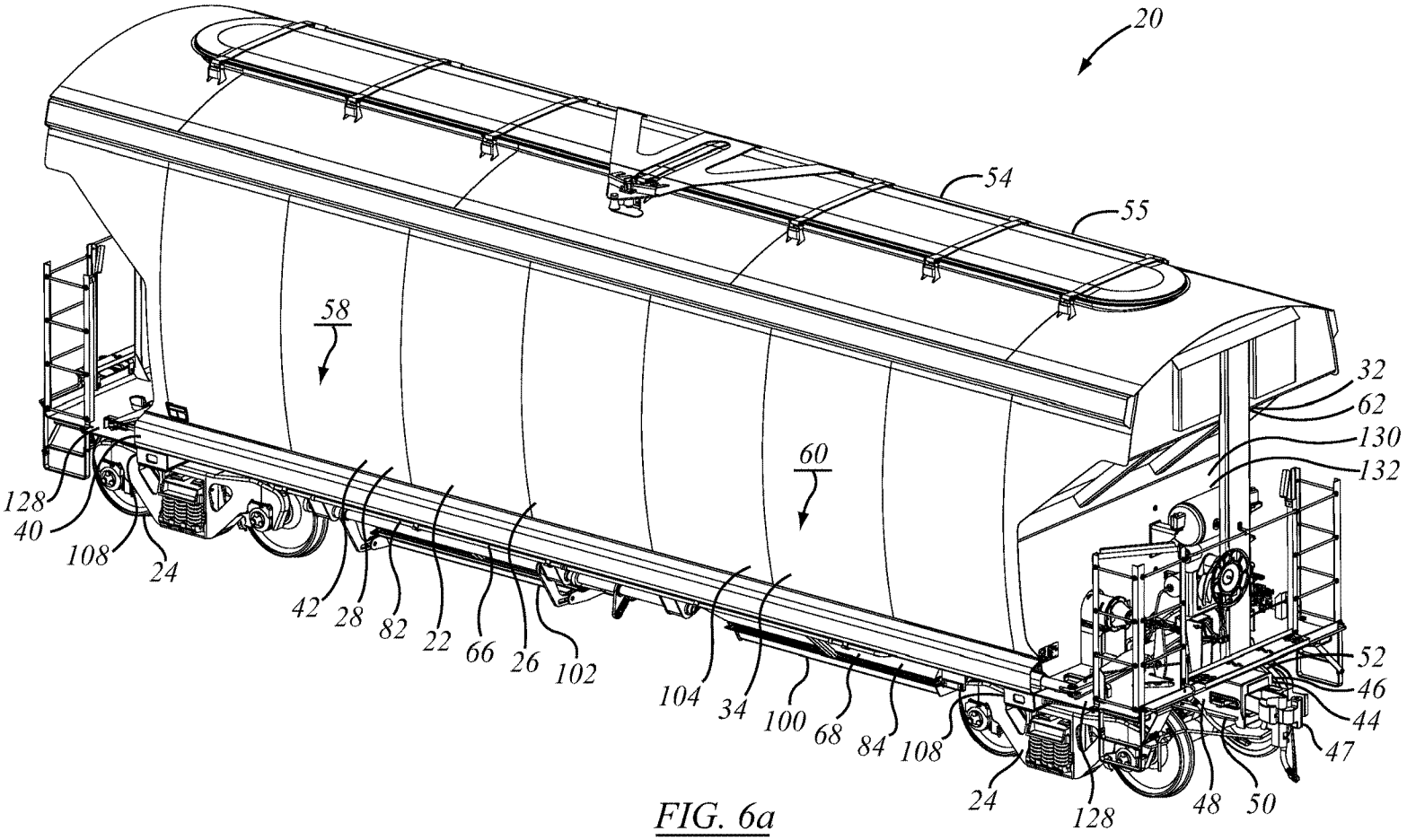
FIG. 6*a* is a general arrangement, perspective view from above and to one corner of an embodiment of a railroad freight car according to an aspect of the invention.
Figure 6B:
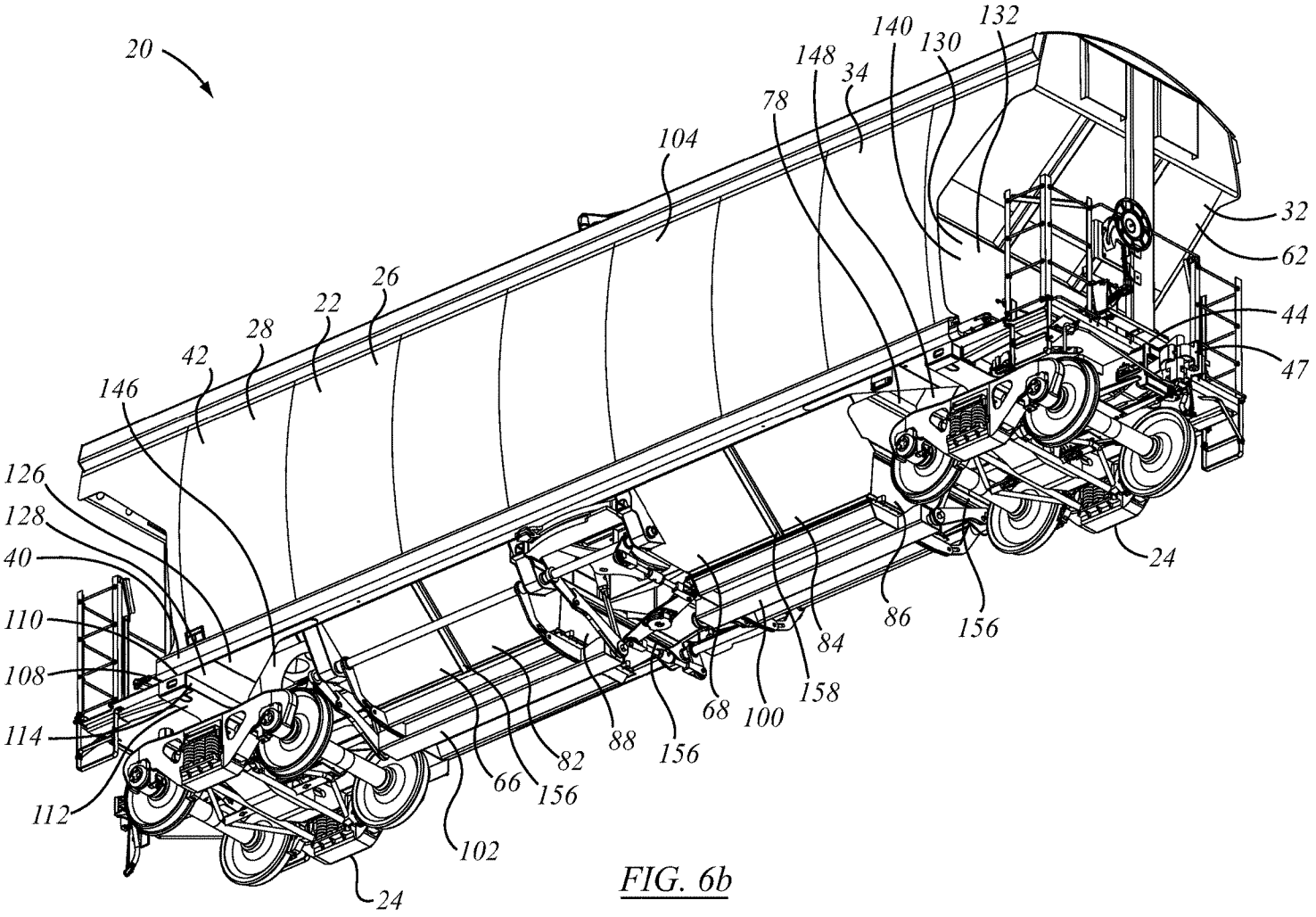
FIG. 6*b* is a perspective view from below and to one corner of the railroad freight car of FIG. 6*a;*
Figure 6C:
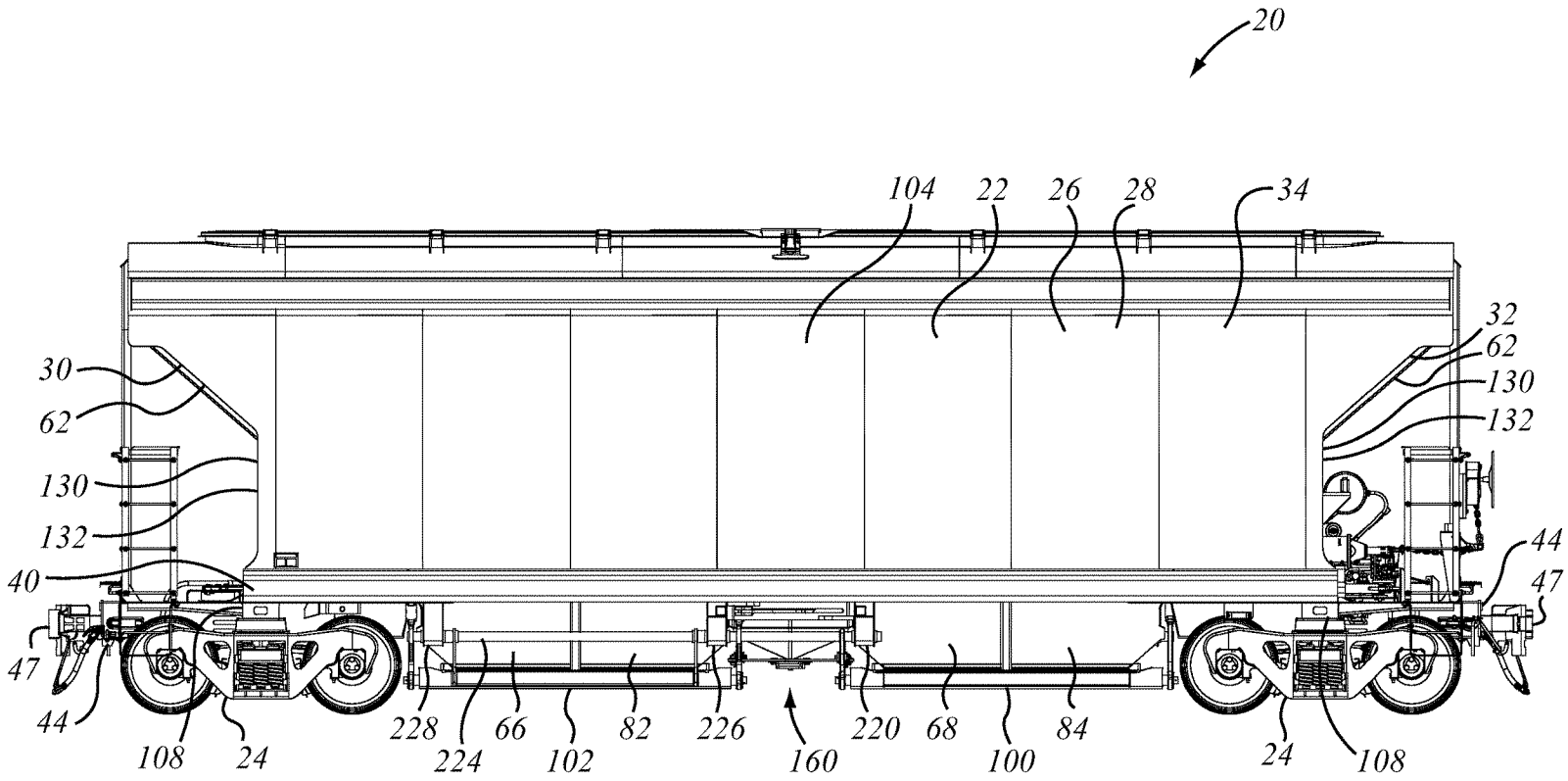
FIG. 6*c* is a side view of the railroad freight car of FIG. 6*a;*
Figure 6D:
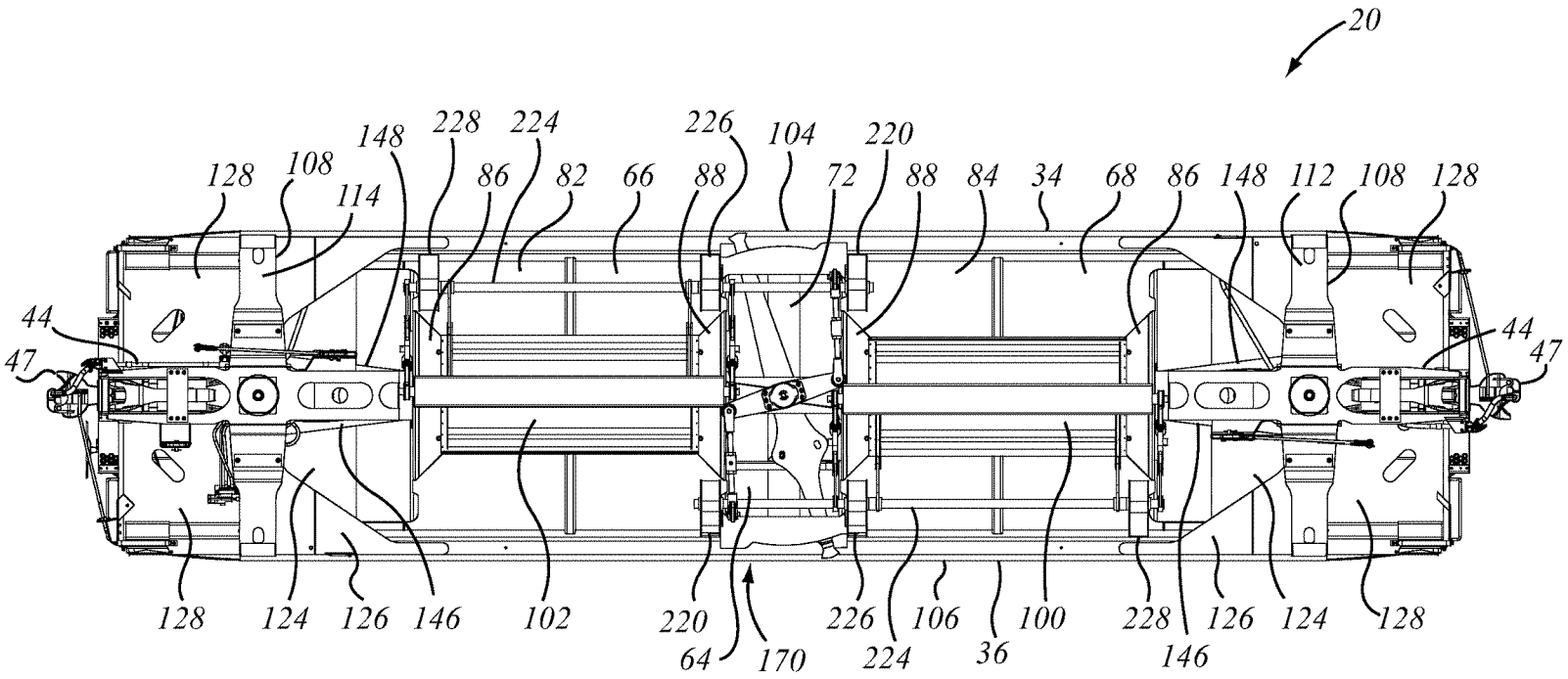
FIG. 6*d* is a bottom view of the railroad freight car of FIG. 6*a*, with the trucks removed.

Other features may also be noted in FIG. 5*f*. For example, short linkages 416, 418 include slots 470 at the end of the linkages distal from the connection between the linkages 416, 418 and the torque tubes 424.

In FIGS. 6*a* to 11*b*, the drive force is imparted by an actuator assembly. The output of the actuator assembly acts through a connecting rod that is mounted to actuate a crank arm, which in turn operates the door it is connected to impart motion and drive power to the door panels. The door assemblies are four bar linkages in which the first or base link is the car body, the door panel forms the third link, the long pivot arms form the second link, and the short pivot arms form the fourth link. The geometry of the various pivot arms gives the door a non-circular arcuate motion between a closed position obstructing egress of lading to an open position permitting egress of lading under the influence of gravity. In the example shown the linkages rotate about their base pivot mounts in parallel y-z planes, the axes of the pivots extending in the x-direction (i.e. longitudinally).

FIGS. 6*a*-6*d* and 10*a*-10*d* show respective views of an example of a railroad freight car indicated as 20 (or 620, as may be). Although a covered hopper car is shown, such as might be used for potash service, the illustrations are intended to convey that the features and aspects of the invention (or inventions, as may be) are pertinent to a range of railroad freight cars, rather than a single embodiment. While car 20 may be suitable for a variety of general purpose uses, it may be taken as being symbolic of, and in some ways a generic example of, flow through cars, in which lading is introduced by gravity flow from above, and removed by gravity discharge through gated or valved outlets below. "Flow through" or "center flow" cars may include open-topped hopper cars, grain cars, plastic pellet cars, potash cars, ore cars, coal gondolas, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. In either case car 20 may be symmetrical about both its longitudinal and transverse, or lateral, centerline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car having releasable couplers at each end, as shown, or it may be a multi-unit car having two or more car body units, where the multiple car body units may be connected at substantially permanent articulated connectors, or draw bars. To the extent that car 20 may carry relatively dense materials, draw bar connections in a unit train might be employed. Car body 22, and the various structural members and fittings described herein may be understood to be typically of metal construction, whether welded or Huck bolted, or riveted together, the metal members being most typically steel, stainless steel, or aluminum, as may be appropriate. Some car builders have also used reinforced plastic composites for car elements, and those materials could also be employed where suitable. Car body 22 may have a lading containment vessel or shell 26 such as may include an upstanding peripheral wall structure 28 which may have a pair of opposed first and second end walls 30, 32 that extend cross-wise, and a pair of first and second side walls 34, 36 that extend lengthwise, the end walls 30, 32 and side walls 34, 36 co-operating to define a generally rectangular form of peripheral wall structure 28 as seen from above. Wall structure 28 may include top chords 38 running along the top of the walls (best seen in FIGS. 10*a* to 10*c*), and side sills 40 running fore-and-aft (i.e., lengthwise) along lower portions the side sheets 42 of side walls 34, 36. Car 20 may have stub center sills 44 at either end, in which case side walls 34, 36 may act as deep beams, and may carry vertical loads to main bolsters 108 that extend laterally from the centerplates. In the case of a single, stand-alone car unit, draft gear and releasable couplers 47 may be mounted at either end of the center sill. Stub center sill 44 has first and second, or left and right hand vertical webs 46, 48, a bottom flange 50, and a top flange or top cover plate 52, those four elements being arranged in the conventional manner to define a substantially rectangular hollow tube. Cover plate 52 is carried at a height in the range of something such as 41 to 43 inches above TOR, such that the coupler and draft gear sit in the coupler pocket with a coupler centerline height for a light (i.e., unladen) car with unworn wheels of 34½ inches above TOR, the standard AAR undeflected coupler height. In a center flow, or flow through car, the upper portion of the car may typically include means by which to admit lading under a gravity drop system. Such an intake 54, or entryway may be a large rectangular opening such as bounded by top chords, or the car be a covered car having a roof and may have one or more hatches 55, whether covered or uncovered.

Looking at the structure generally, car 20 (or 620, as may be) may have two hoppers, or hopper assemblies, or hopper sections, identified generally and generically as a first hopper 58 and a second hopper 60. Each hopper has an end slope sheet 62 sloped in the longitudinal direction, and an intermediate slope sheet 64 (best seen in FIG. 10*a*) also sloped in the longitudinal direction. These slope sheets slope upwardly, and away from, a respective first or second hopper discharge section 66, 68. As may be appreciated, the interior or intermediate slope sheets 64 of hoppers 58 and 60 run upwardly and inwardly toward each other, more or less symmetrically, to meet at what is, roughly speaking, a common apex. More precisely, they engage opposite sides of a ridge plate assembly 70 (best seen in FIG. 10*a*) that runs cross-wise between side walls 34, 36. Ridge plate assembly 70 may be made substantially as shown and described herein or as in US Patent Publication No. 2010/0132587 of Forbes et al., or it may, in a covered hopper car, be a full height partition. In either case it lies along the central plane of car 20. It is not necessary that end slope sheets 62 be inclined at the same angle as intermediate slope sheets 64. Those slopes may be different. That is, the slope of end slope sheet 62 is substantially shallower than the slope of the intermediate slope sheets 64. It may be noted that a flat member, or gusset, or plate 72 (best seen in FIGS. 6*d* and 10*d*) is mounted beneath ridge plate assembly 70 between the two adjacent intermediate slope sheets 64, such that a triangular tube is formed that extends across car 20 (or 620, as may be) from side wall 34 to side wall 36.

In the embodiment shown, the lower margins of slope sheets 62 and 64 terminate at a level corresponding to the height of side sills 40, such that lower margins of slope sheets 62 and 64 and side sills 40 co-operate to define a generally rectangular opening giving on to hopper discharge sections 66, 68 of first hopper 58 or second hopper 60 respectively. A lateral stiffener in the form of a hollow section beam 78, 80 (shown in FIG. 7*e*) runs cross-wise from side sill to side sill along lower margins of slope sheets 62 and 64. Each hopper discharge section 66, 68 has a four sided shape that includes first and second side wall members 82, 84 that depend downward on an inward decline from side sills 40, and first and second end wall members 86, 88 that run cross-wise across the car, and may extend in substantially vertical planes downwardly from the lower margins of slope sheets 62 and 64, respectively. The bottom margins 92, 94, 96 and 98 of wall members 82, 84, 86 and 88 define a generally rectangular opening 90 (shown in FIG. 7*f*). Egress of lading from opening 90 is controlled by governors, namely outlet doors or gates, indicated generally as first and second (or front and back) doors 100, 102. These doors 100, 102 may be symmetrical, such that a description of one serves also to describe the other.

Full Length Side Sills

Side walls 34, 36 act as long deep side beams 104, 106 that carry the vertical loads of hoppers 58, 60, said walls having upper flanges formed by top chords 38, bottom flanges formed by side sills 40 and webs defined by side sheets 42. The vertical loads transferred into the side beams are then carried into stub center sills 44 at the locations of the end stub wall assemblies 130 and main bolsters 108 at the truck centers. Main bolsters 108 each include an upper, or main, flange 110, a lower flange 112, and a web 114.

Car 20 (or 620, as may be) has a shear plate 128 that extends over (or may define) the top flange 110 of stub center sill 44, extending across the full width of car 20 from side sill to side sill, such that it underlies side sills 40 and overlies main bolster 108 (or defines the upper flange thereof). Outboard of main bolster 108, shear plate 128 extends to the end sill of car 20. Inboard of main bolster 108, shear plate 128 has triangular portions 126 that taper outwardly to underlie the side sills, leaving an opening 124 beneath end slope sheet 62.

End Wall Defines Deep Lateral Beam

An end wall, or end wall assembly 130 of car 20 (or 620, as may be) includes a deep, predominantly upwardly extending, transversely running shear web, member, panel or wall, 132. Wall 132 has a lower portion 134 and an upper portion 136. Wall 132 lies in a predominantly vertical cross-wise plane. Upper portion 136 meets end slope sheet 62. The lower margin of wall 132 extends upwardly from shear plate 128. The lower margin of wall 132 is rooted at, or mates with, or is aligned with, upper or main flange 110 of main bolster 108. In effect, end wall top chord 138, end slope sheet 62, beam 78, wall 132, and flange 110 co-operate to define a deep beam or deep beam assembly 140 that extends across car 20 from side sill to side sill. The ends of beam 140 are capped by the wings, or shear web panel extensions 142, 144 of the side wall shear web sheets 42. Further, support webs in the nature of elephant ears 146,148 meet center sill cover plate 52 directly above respective center sill webs 46, 48, and are angled on an outwardly splayed slope slightly away from each other, extending upwardly to meet and reinforce end slope sheet 62 and end wall 132, thus providing load paths by which vertical portions of the shear load from side beams 104, 106 and the lading are resolved into stub center sill 44.

Large, Low, Substantially Horizontal Hopper Discharge Opening

The lower margins of the stationary structure of the hopper discharge sections are reinforced by hollow structural sections, those on end wall members 86, 88 being identified as 156 and those on the sloped, laterally downwardly convergent side wall members 82, 84 being identified as 158. Further, considering the rectangular picture frame defined by the lower margins of the four sheets that define the rectangular discharge opening 90, several features may be noted. First, the opening is longer than wide. That is, it has a length, L, in the lengthwise direction of car 20 (or 620, as may be), and a width, W, in the cross-wise direction. The ratio of L/W may be greater than 3:2 such that each of doors 100, 102 may be three times as long as it is wide. In one embodiment the length of the doors may be over 100 inches, and may be about 103 inches, such that two hoppers have a combined opening length of over 200 inches. In this car of FIGS. 6*a*-6*d* the truck center distance may be less than 500 inches, and in one embodiment is between 385 and 400 inches. Thus the ratio of door length to truck center length is greater than 1:2, and may be in the range of as much as roughly 7:13. The length may be even greater, being roughly 155 inches, such that two doors give a total door length of more than half and in one embodiment as much as roughly ⅝ of the truck center spacing. Nonetheless, the width of the opening is less than 60 inches wide, and in one embodiment is approximately 60 inches wide. Expressed differently, the opening is less than half the overall width of the car, and in one embodiment is roughly 5/11 of the width of the car. Expressed differently, the width is less than the gauge width of the tracks, and, in some embodiments may be in the range of ½ to as much as 1 times the gauge width. Furthermore, the height of the opening above TOR is low. It need not be that the entire opening, or the periphery of the opening defined by lower margins 92, 94, 96, 98 is planar or lies in a unique horizontal plane. For example, the opening of car 20 is not precisely planar, but is angled slightly upwardly away from the car centerline, the angle in one embodiment being of the order of less than 15 degrees. However, taking the opening as being substantially planar and horizontal, the height of the midpoint of the periphery of the opening on the centerline of car 20 the structure may in one embodiment lie as little as 8 inches above TOR. That is to say, the opening width of the discharge over the single doors 100, 102 (or mating double doors, as may be for car 620) is more than four times, and in one embodiment more than seven times, the clearance height from top of rail to the lip of the opening of the stationary structure, and in one embodiment is more than 8½ times the clearance height (i.e., 70" width, 8" clearance). These various ratios are measures of, or proxies for a physical property of functional significance, namely they are measures of the extent to which a very large, substantially horizontal gate opening permits the car to have a low center of gravity while laded, potentially permits the car to have a larger volume of lading than otherwise, (depending on the density of the lading); permits the lading to be discharged more quickly given that the opening is larger and at the same time lower than the center sill, and permits the lading to be discharged with more accuracy and less spread than might otherwise be the case if discharged from a greater height.

Internal Machinery Accommodation Between Hoppers

In terms of stationary structure, it may be recalled that interior slope sheets 64 of hoppers 58 and 60 meet at ridge plate assembly 70. As such there is a sheltered machinery space 170 defined between the two hopper discharge sections beneath, or in the lee of, interior slope sheets 64 of adjacent hoppers 58, 60, and, indeed, below plate 72 which forms the bottom closing member of the triangular tube. Although this description is written in the context of a car having two hoppers, the same commentary would apply to a car having any number of pairs of hoppers where the internal slope sheets of two adjacent hoppers meet to form a somewhat protected space. In existing open topped hopper cars the space under the slope sheets is often where so called "elephant ears" or triangular planar shear plates are located, those planar shear plates having one vertex running along the center sill cover plate (assuming the car has a straight-through center sill) over one of the center sill webs, a second vertex running upwardly on a diagonal along the back of one of the intermediate slope sheets, and a third vertex running upward on a similar diagonal on the back of the other intermediate slope sheet. In the instant car 20 (or 620, as may be), machinery space 170 is free of such shear plates or elephant ears, or planar web members, such as would otherwise obstruct the space.

Since machinery space 170 is unobstructed, a door drive assembly may be mounted therein (discussed in greater detail below). Door drive assembly includes a large lever, or actuation member. Location of an actuator in this accommodation may tend to mean that the actuator is not fit into a tight or difficult machinery space over one of the end sections of the car, competing for space with the brake reservoirs or other equipment. It may also mean that there is better access for servicing and maintenance.

Door Structure (Single Doors)

Referring to FIGS. 6*a* to 9*b*, as noted, the first and second doors 100, 102 are the same, such that a description of one is equally a description of the other. The main portion of door 100 (or 102, as may be) is a sheet or pan 174. The upward face of door pan 174 may also have laterally running edges 181. The door length (in the x-direction, or longitudinal direction) and width (in the y-direction, or transverse direction) of pan 174 is suited to the opening defined by the lower margins of the hopper discharge section, be it 66 or 68, the lateral edges mating with that opening by the fore-and-aft lower margins of the hopper discharge section to form a seal therealong when the door is closed. Pan 174 is reinforced by a long-direction hollow channel 182, oriented parallel to the x-direction of the car. Channel 182 is welded toes-in to form a hollow section. In the embodiment shown, channel 182 is located in the middle of door pan 174, such that when door 100 (or 102) is closed, channel 182 may tend to overlap the longitudinal centerline plane of car 20 more generally, and may be centered on the centerline. Pan 174 is also reinforced longitudinally by further longitudinal stringers 166 and 168 that run parallel to channel 182 adjacent to distal edge 179 and proximal edge 177. Stringers 166 and 168 are made by welding a formed angle toes-in to pan 174.

Pan sheet 174 is also reinforced by, and carried by, first and second transverse reinforcements 184, 186 that run across the outward side thereof from the proximal edge 177 to channel 182. Web continuity gussets (not shown) may be mounted within channels 182, and reinforcement continuations reinforcements, 188, 190, in line with reinforcements 184, 186, extend from channel 182 to the distal edge 179 of doors 100, 102. The proximal ends of reinforcements 184, 186 define mounting lugs 200, 202. Further, spindles, trunnions or stub shafts 204 are mounted at the ends of C-channel 182 and define connection interfaces, or connection points for both the door suspension members and the door drive train.

Door Linkages (Single Doors)

Figure 7A:
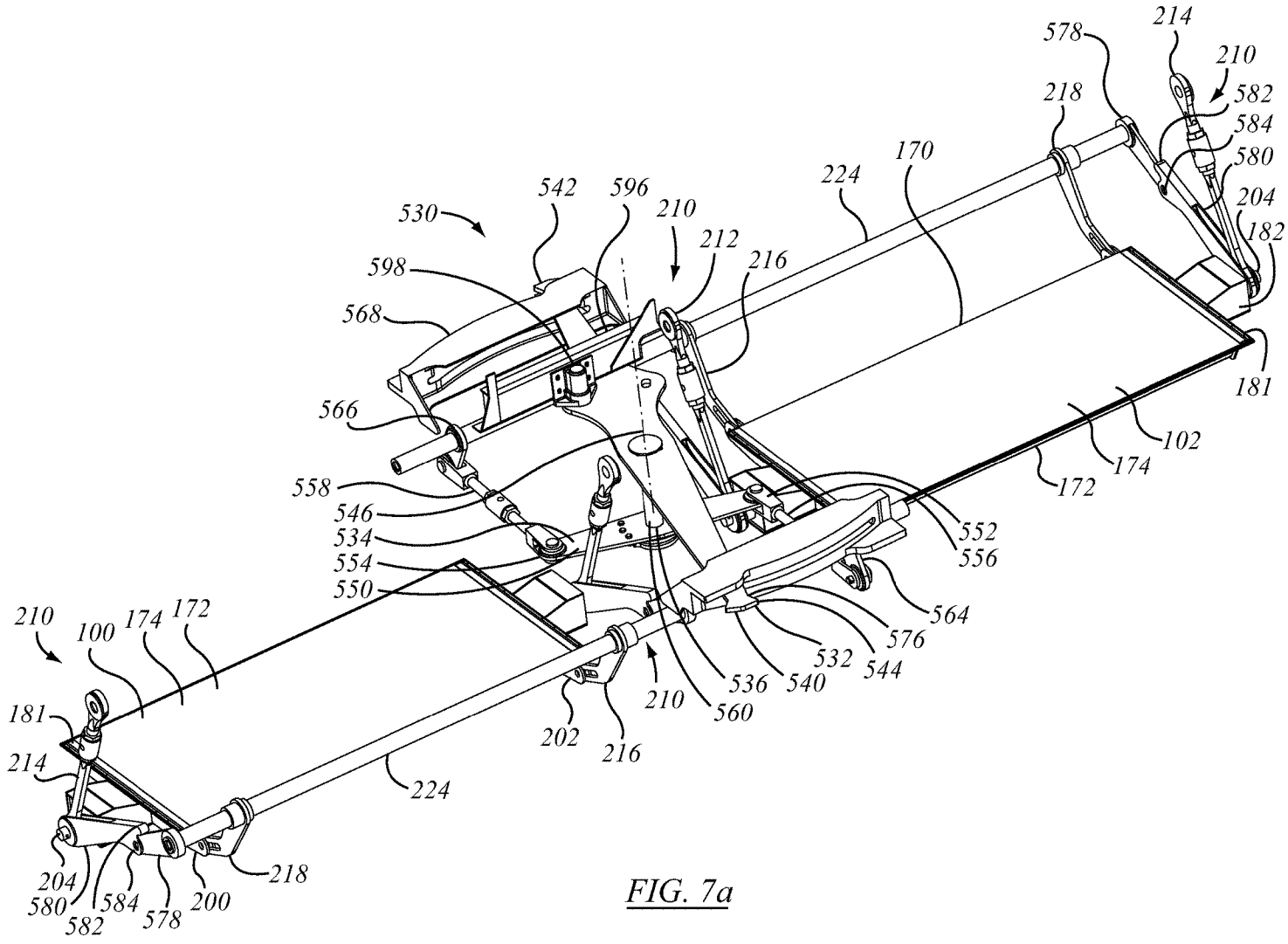
FIG. 7*a* is a perspective view, from above and to one corner of hopper doors and a door operating transmission of the railroad freight car of FIG. 6*a;*
Figure 7B:
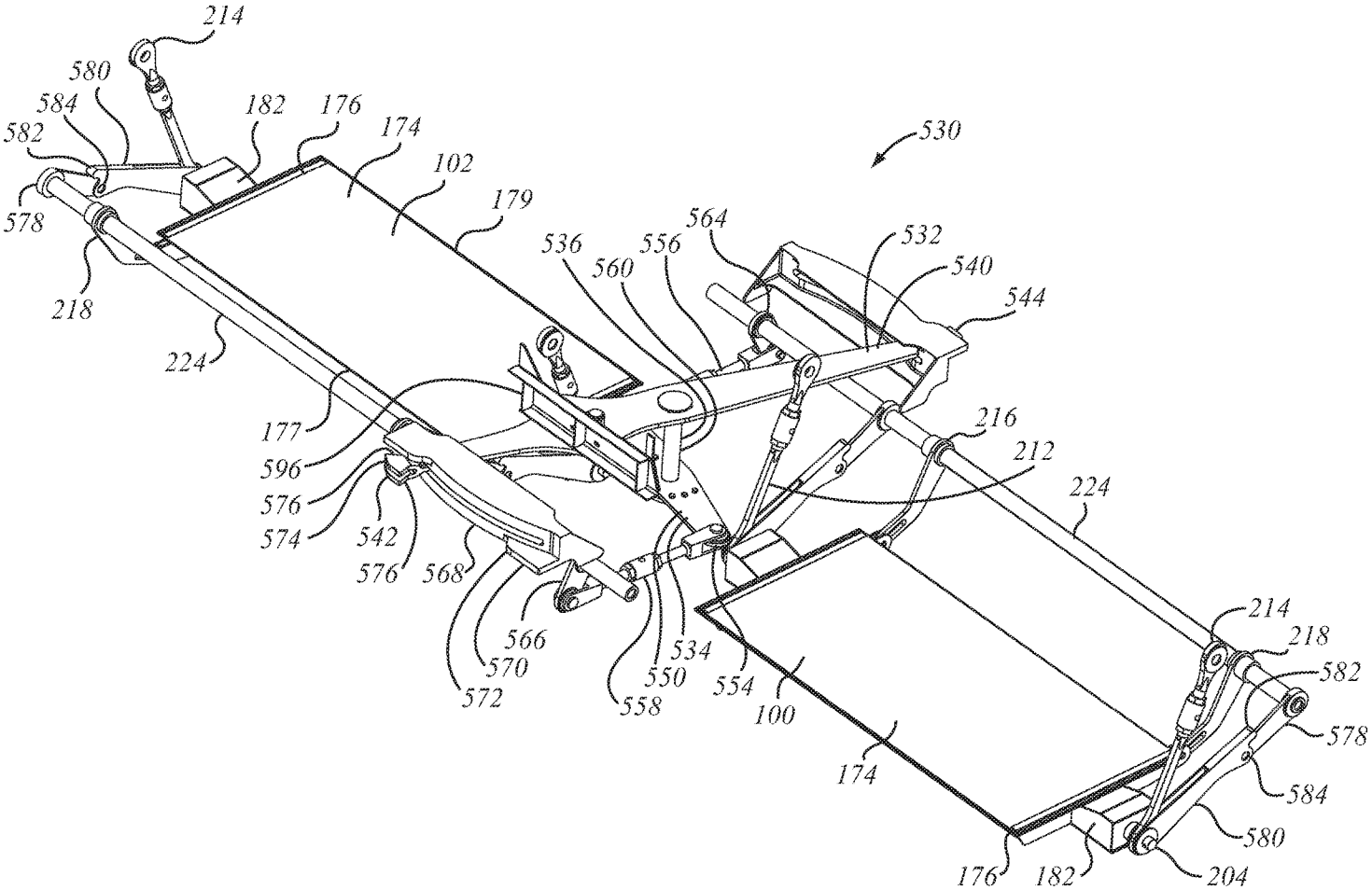
FIG. 7*b* is a perspective view from above and to another corner of the hopper doors and door operating transmission of FIG. 7*a;*
Figure 7C:
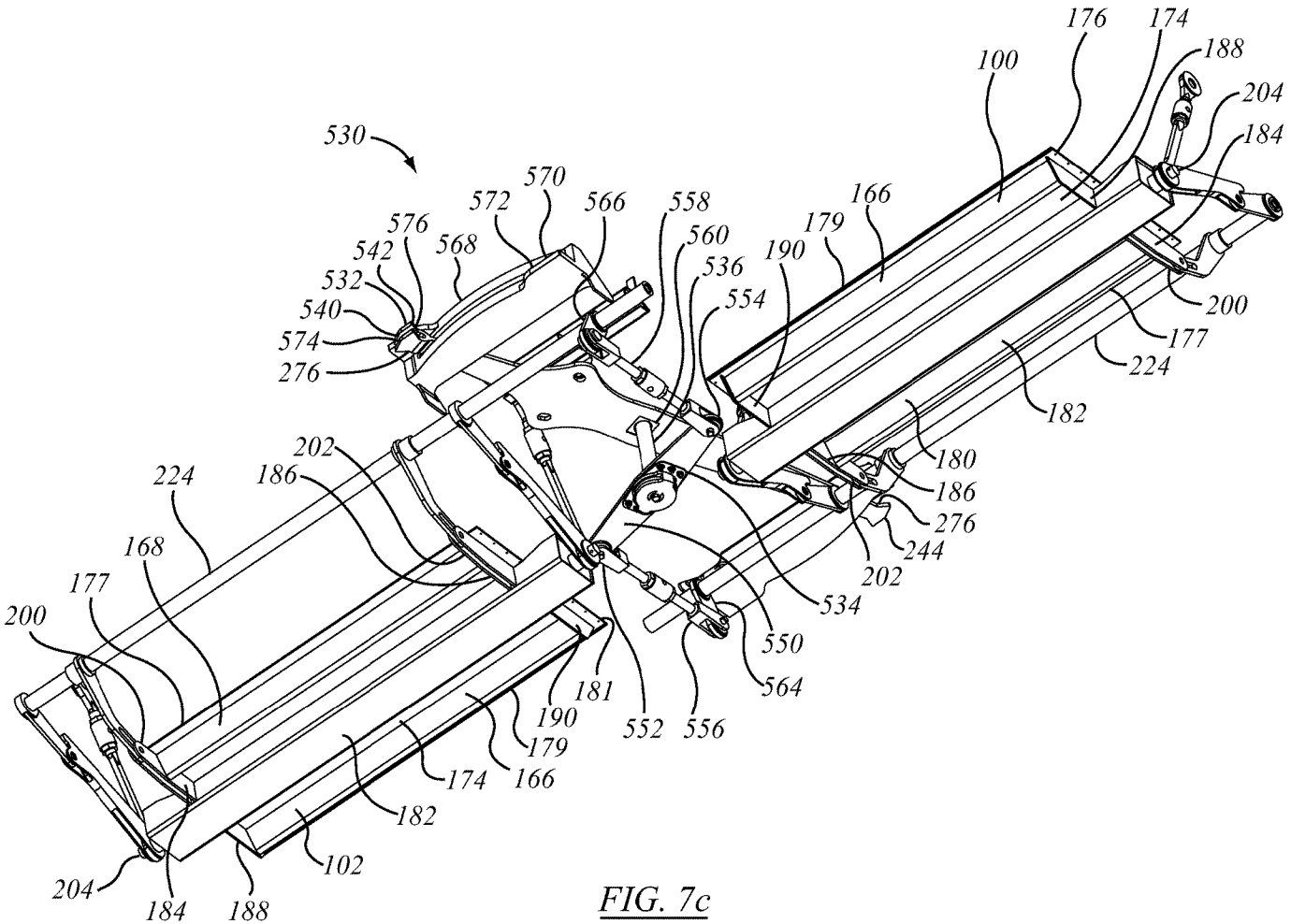
FIG. 7*c* is a perspective view from the opposite side of the hopper doors and door operating transmission of FIG. 7*a;*
Figure 7D:
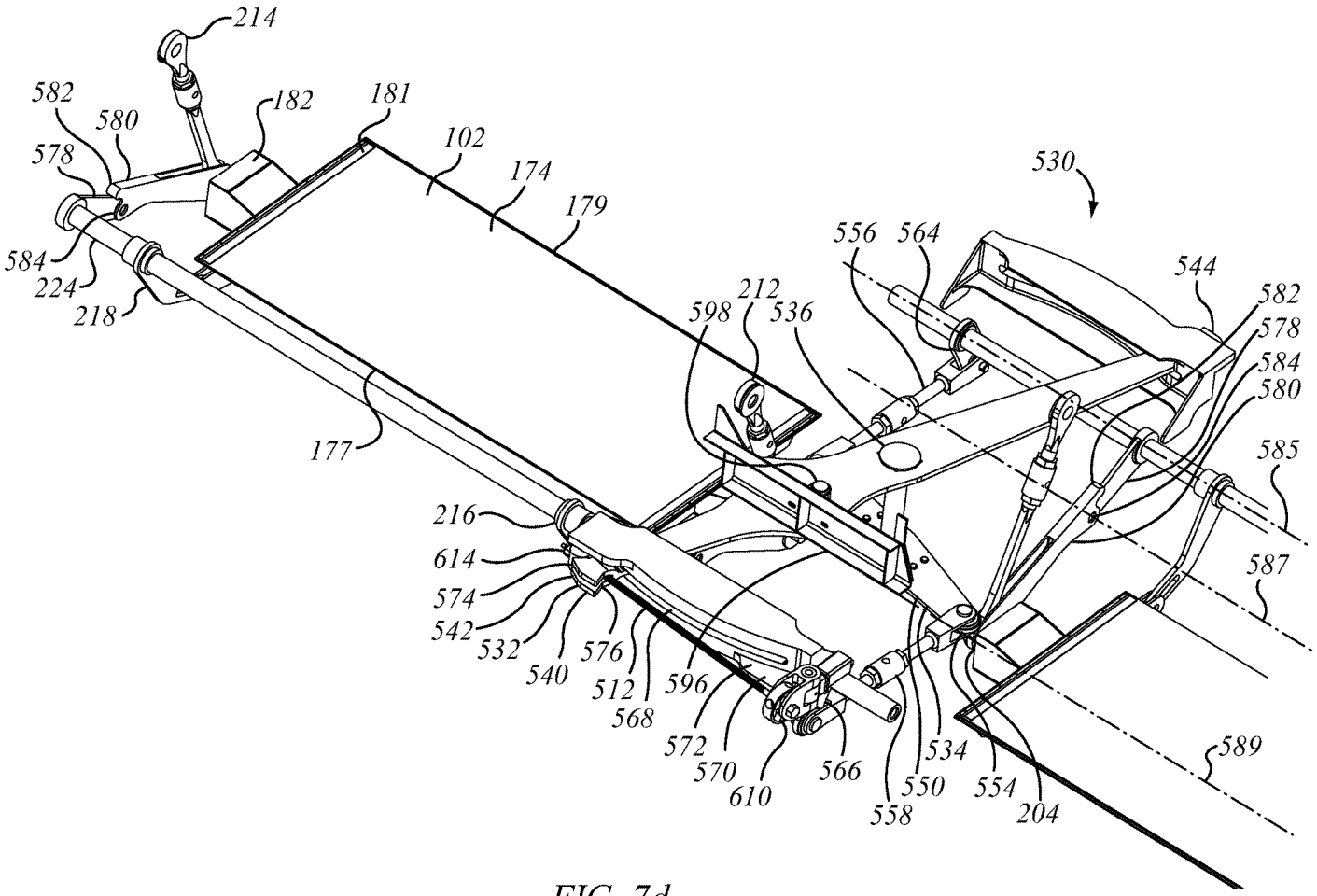
FIG. 7*d* is an enlarged perspective view, from above, of one door and the operating mechanism of FIG. 7*a;*
Figure 7E:
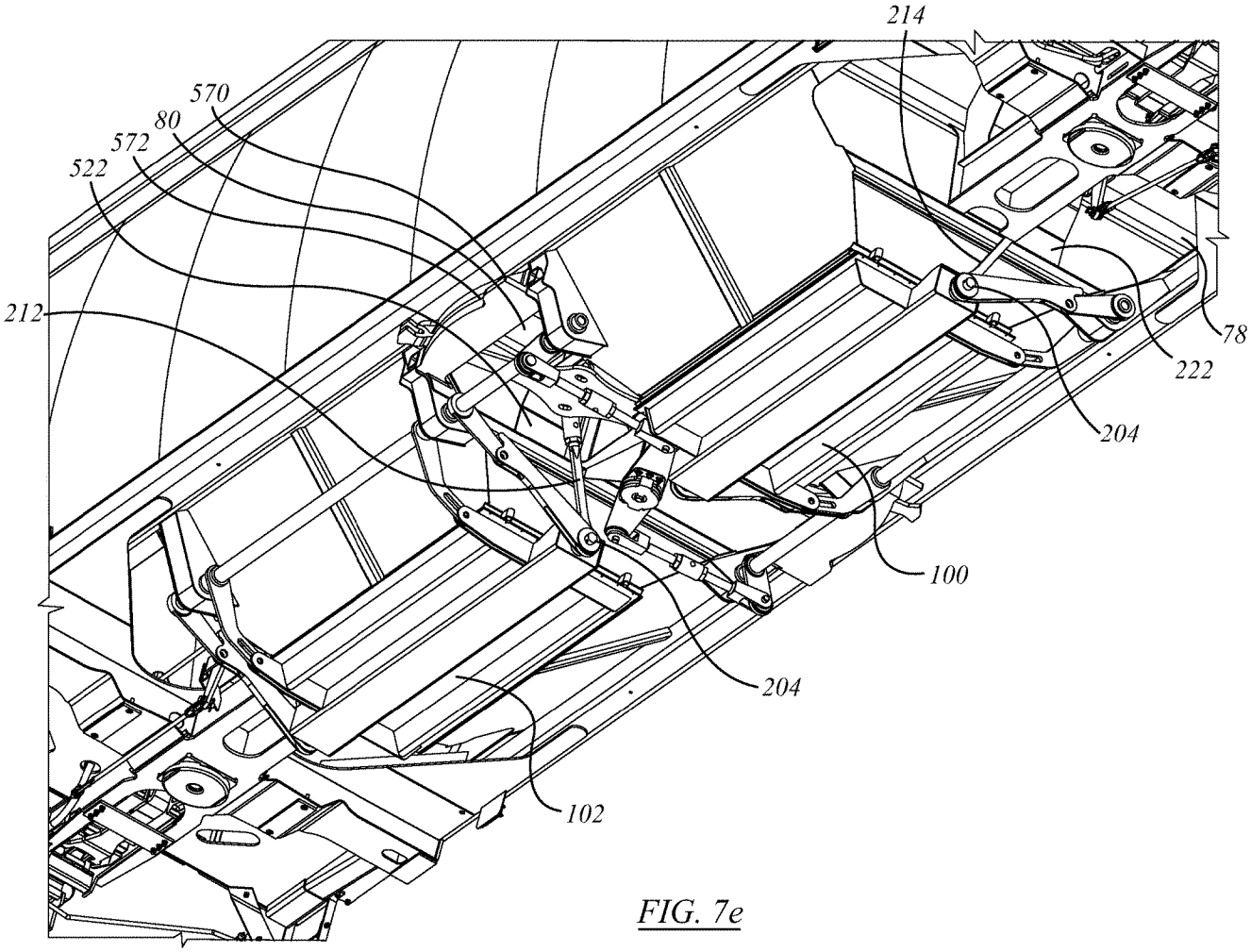
FIG. 7*e* shows a perspective view, from below, of the railroad freight car of FIG. 6*a*, with hopper doors closed.
Figure 7F:
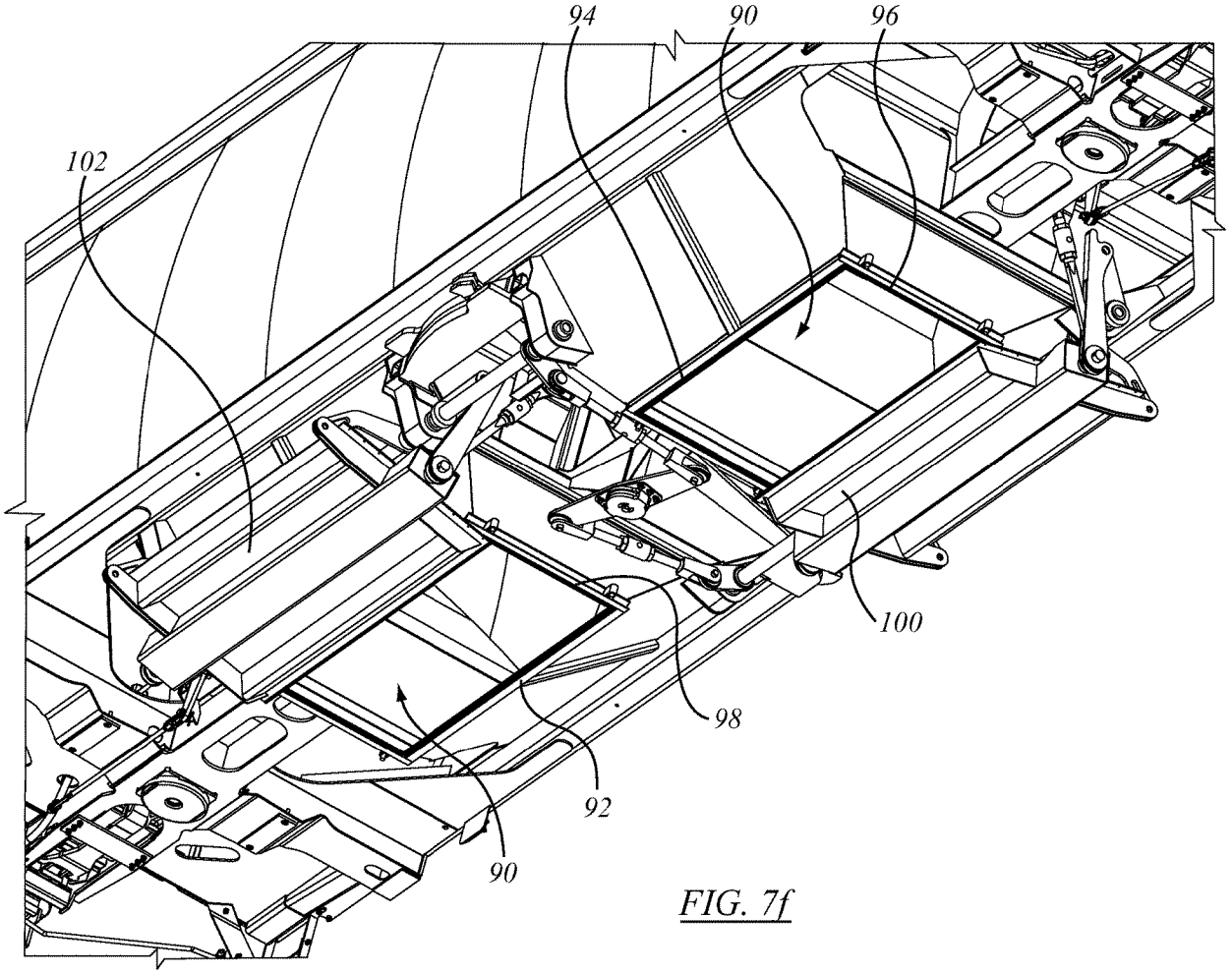
FIG. 7*f* shows a perspective view, from below, of the railroad freight car of FIG. 6*a*, with hopper doors open.

Doors 100 and 102 are suspended from a set of pivotally movable members or links such as may be identified generally as door support linkages 210. Those linkages include a pair of first and second, near end and far end distal door linkages, or arms 212, 214, and a pair of first and second, near and far, proximal, short, door linkages, or arms 216, 218. As may be noted, the distal linkages, or arms, 212, 214 are longer than the proximal arms 216, 218. Distal arms 212, 214 have respective first end pivotally mounted to the upper lateral hopper section support member, namely hollow section beams 80, 78 at mounting lugs, or feet, 222, 522 (as best seen in FIG. 7*e*). This is the stationary, or reference or datum end of the link. The other end of arms 212, 214 is the pivot mount at the connection interface defined at stub shaft 204, which may be termed the distant or swinging end. Similarly, the "fixed" or base, or reference, end of short arms 216, 218 is mounted to a rotational angular motion and torque transmitting member identified as torque tube 224, and the "free" or swinging ends of short arms 216, 218 pick up on mounting lugs 200, 202. Short arms 216, 218 are not rigidly fixed to torque tube 224, but rather are mounted to rotate independently of it. Torque tube 224 is itself mounted for rotation to three mounting fittings or brackets, or pedestals, or reinforcement members or lugs 220, 226, 228, which may themselves have the form of tapering hollow channel sections mounted toes-in to the outside face of the inwardly inclined side sloping sheets 82, 84 of the hopper discharge sections.

As may be noted, the resultant structure defines a four-bar linkage. The first bar, or base, or datum, is the stationary structure whose position is rigidly fixed as part of the car body, namely the stationary structure of discharge section 66, 68, which includes the footings of mounts of the linkages. The long arm pair of arms 212, 214 forms the second bar of the four bar linkage. The short arm pair of arms 216, 218 forms the fourth bar of the four bar linkage, and the door panel itself forms the third bar of the four bar linkage. As may be noted, this four-bar linkage is movable between a first position (namely the closed position, shown in FIG. 8*a*) and a second position (namely the fully open position shown in FIG. 8*b*).

In this motion, the long arm link moves through a significantly smaller angular displacement than the short arm link, the long arm moving through roughly 35 to 45 degrees of arc (e.g. approximately 40 degrees), and the short arm link moving through 120 to 150 degrees of arc (e.g. approximately 135 degrees). At the starting position of the motion, both the short and long arms are on angles inward of vertical, such that as the motion begins, both the short and long arms move toward a vertical orientation, and, in so doing, their respective "free" pivot interfaces move in a direction of motion that has both an outward and downward component of motion. That is, dz/dy at both free pivot interfaces is negative; dy being the movement of the interface in the y, or lateral, direction (with the +y direction being defined as a laterally outboard direction) and dz being defined as the movement of the interface in the z, or vertical, direction (with the +z direction being defined as an upward direction). As will be appreciated, the +y direction for door 100 will be opposite the +y direction for door 102. Thus, since there is a −z component of motion, the initial motion serves to "lift" or "unseat" the pan, i.e., move it away from the seat, while the door is also moving predominantly laterally outboard in the +y direction. In this initial stage of motion, the absolute value of dz/dy is also considerably less than 1; that is, the motion is more strongly horizontal than vertical. This horizontal predominance increases as the swinging arms move toward their respective vertical positions. Once past the vertical, the respective pivot connections (or "free" pivot interfaces) begin to move upward while moving laterally outward. The angular displacement of the short arm is more rapid, and its motion is soon predominantly upward (dz/dy>1), and continues so throughout the remainder of the stroke. While this occurs, the longer arm continues its predominantly horizontal motion on a less rapidly changing angular displacement and less strongly positive dz/dy. The effect is that the door panel itself tilts from a very nearly completely horizontal condition to a tipped, inclined position. At the end of the motion, the inside lip of the door may be positioned substantially directly above the rail, or just laterally shy of the inside of the rail bullnose, such that lading exiting the hopper discharge may tend to fall between the rails.

As will be appreciated, returning the four-bar linkage from the second position (e.g. the fully open position shown in FIG. 8*b*) to the first position (e.g. the closed position, shown in FIG. 8*a*) is substantially the inverse of the motion described above.

Drive Train (Single Doors)

The motion of the four bar linkages of doors 100, 102 may be driven by a transmission or drive train 530, the same drive train being used to close the doors in the other direction once the lading has been discharged.

The drive train includes an input member 532, an output member 534, and a link or transfer member 536. In this instance input member 532 may have the form of a large lever, 540 having a first end 542, a second end 544, and a central pivot axis 546. Output member 534 may similarly have the form of a lever 550 having a first end at a first output interface connection 552, a second end at a second output interface connection 554 and sharing the same central pivot axis 546. Transfer member 536 may have the form of a shaft or torque tube 560 mounted to a reaction frame 562 that is itself rooted to the lateral structural members of the hopper discharge sections. As may be noted, lever 540 is mounted at a level or height just below side sills 40, and lever 550 is mounted lower. Output lever 550 has two other pivotal connections namely first and second output interface connections, 552 and 554. The fulcrum, namely the fixed pivot at central pivot axis 546, is located mid-way between pivotal connections 552 and 554. Push rods, or connecting rods, or links 556 and 558 respectively extend from connections 552 and 554 to the crank arms of the front and back doors. That is, connecting rods 556, 558 carry transmitted motion and force from the respective output interface connections or ends 552 and 554 of output lever 550 to the first and second door cranks, 564, 566 of the drive mechanisms for doors 100 and 102 respectively.

First end 542 of lever 540 extends laterally proud of side sill 40, and is carried in a slot defined in a bell-mouth 568 that has an arcuately formed outer surface, the bottom wall portion thereof defining a cam 570 that includes a lever disengagement portion 572. First end 542 may be split or bifurcated to form a clevis 574, as shown. The leading and trailing sides of end 542 may be broadened or splayed, to form a catch, or notch, or engagement seat 576. Second end 542 of lever 540 may be similarly formed but may not have the clevis feature.

Lever 550 is effectively a force and motion splitting device. That is, the input at torque tube 560 transmits a total input moment equal to the sum of the output at 552 and 554. Inasmuch as the geometry is symmetrical, the output transmitted to the cranks driving doors 100, 102 is also matched. In this embodiment the fulcrum, pivot located at central pivot axis 546, is located on the longitudinal centerline of the car.

Figure 8A:
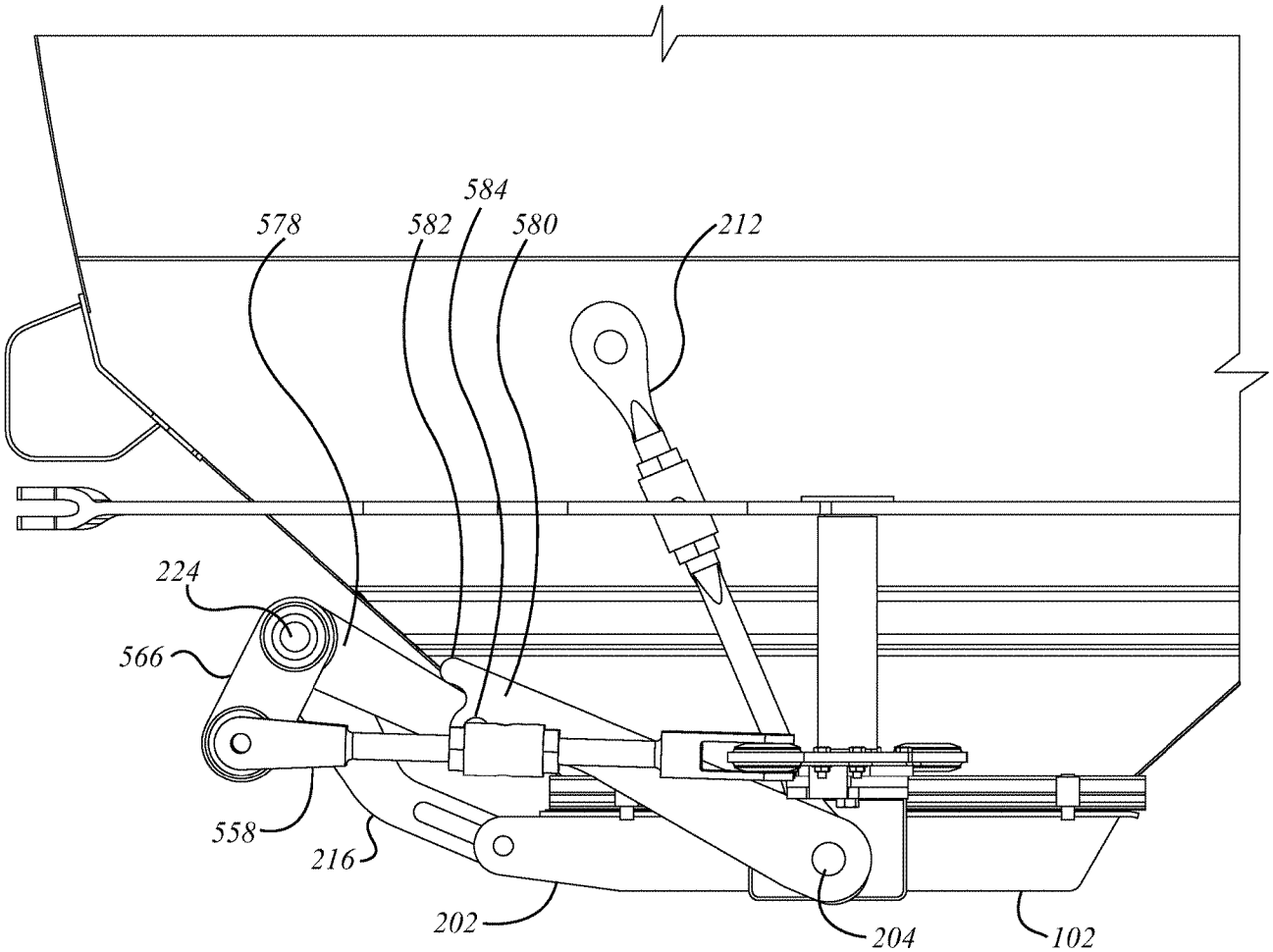
FIG. 8*a* is a view taken on the centerline of the railroad freight car of FIG. 6*a*, showing the door operating apparatus of FIG. 7*a* in the closed position.
Figure 8B:
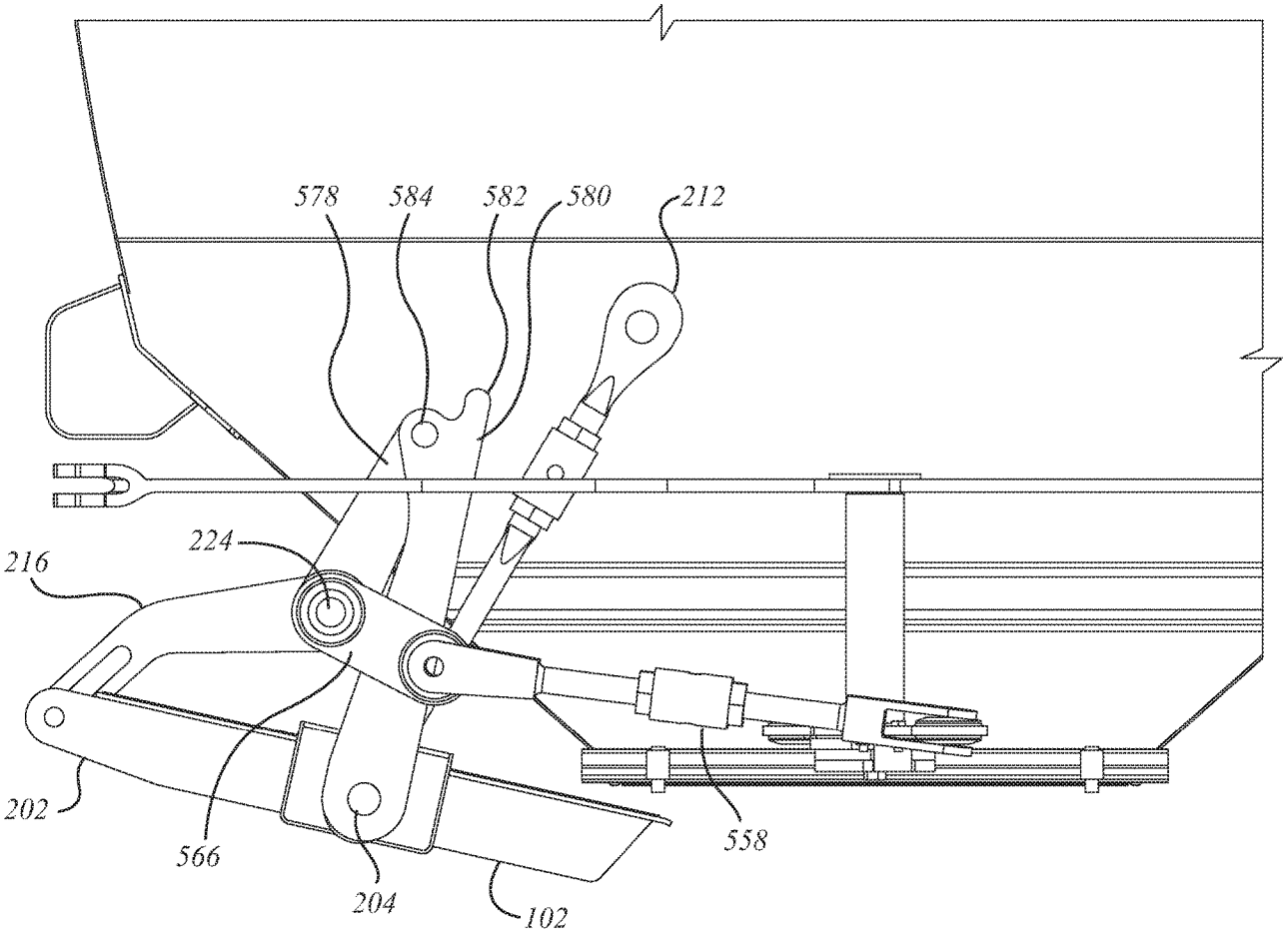
FIG. 8*b* is a view taken on the centerline of the railroad freight car of FIG. 6*a*, showing the door operating apparatus of FIG. 7*a* in a fully open position.
Figure 9A:
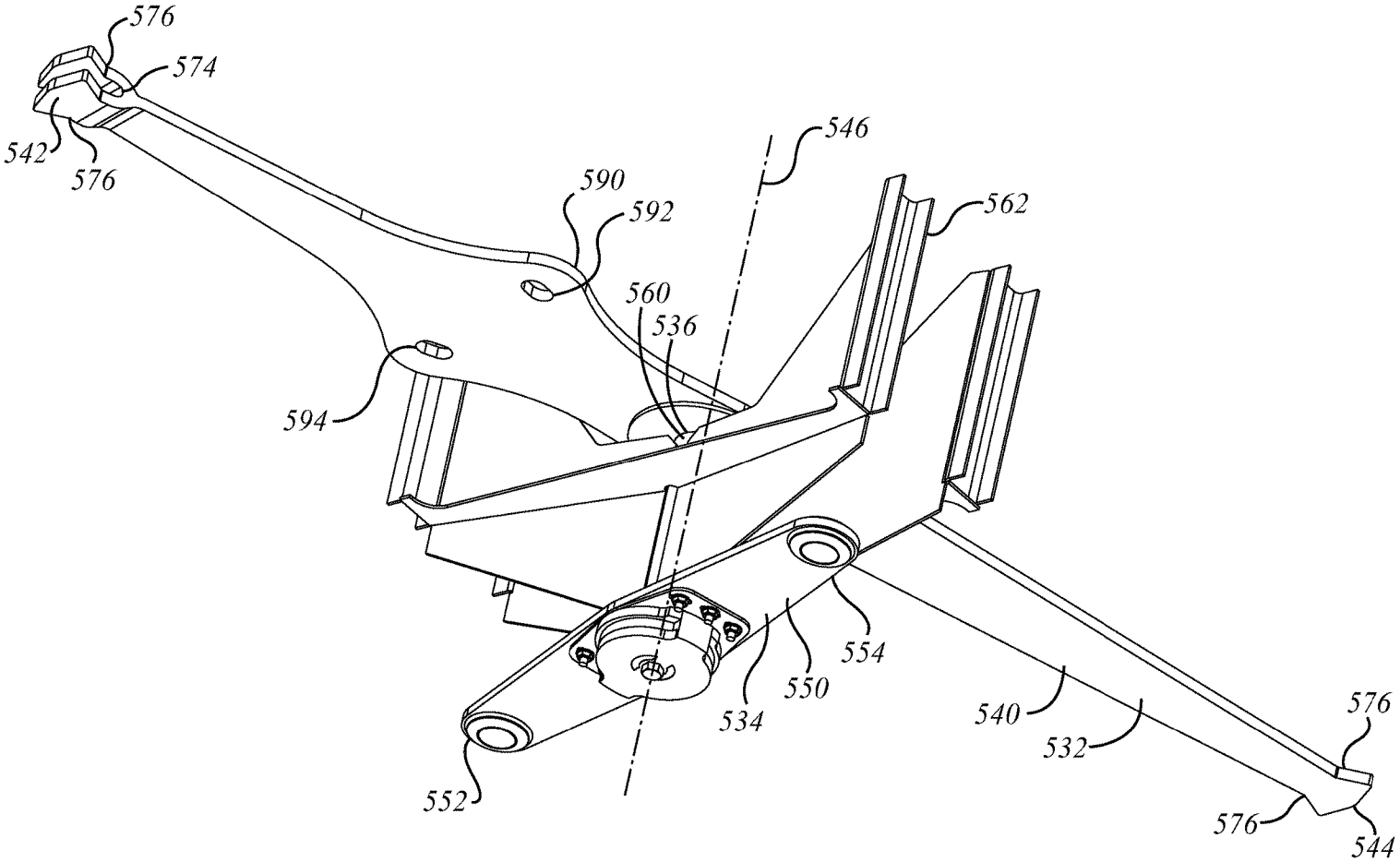
FIG. 9*a* shows a perspective view of a door actuator assembly of the railroad freight car of FIG. 6*a;*
Figure 9B:
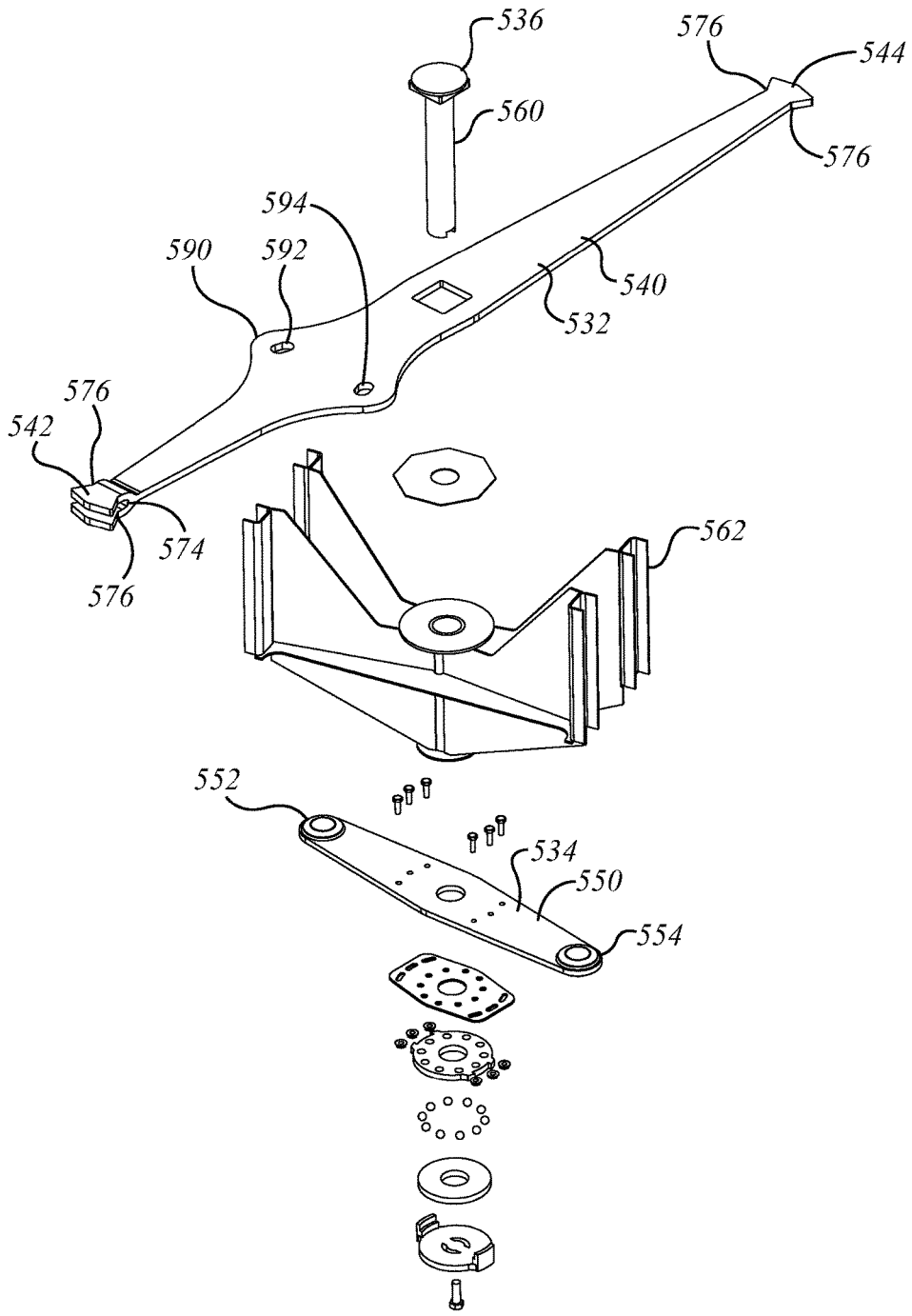
FIG. 9*b* shows an exploded perspective view of the door actuator assembly of FIG. 9*a;*
Figure 10A:
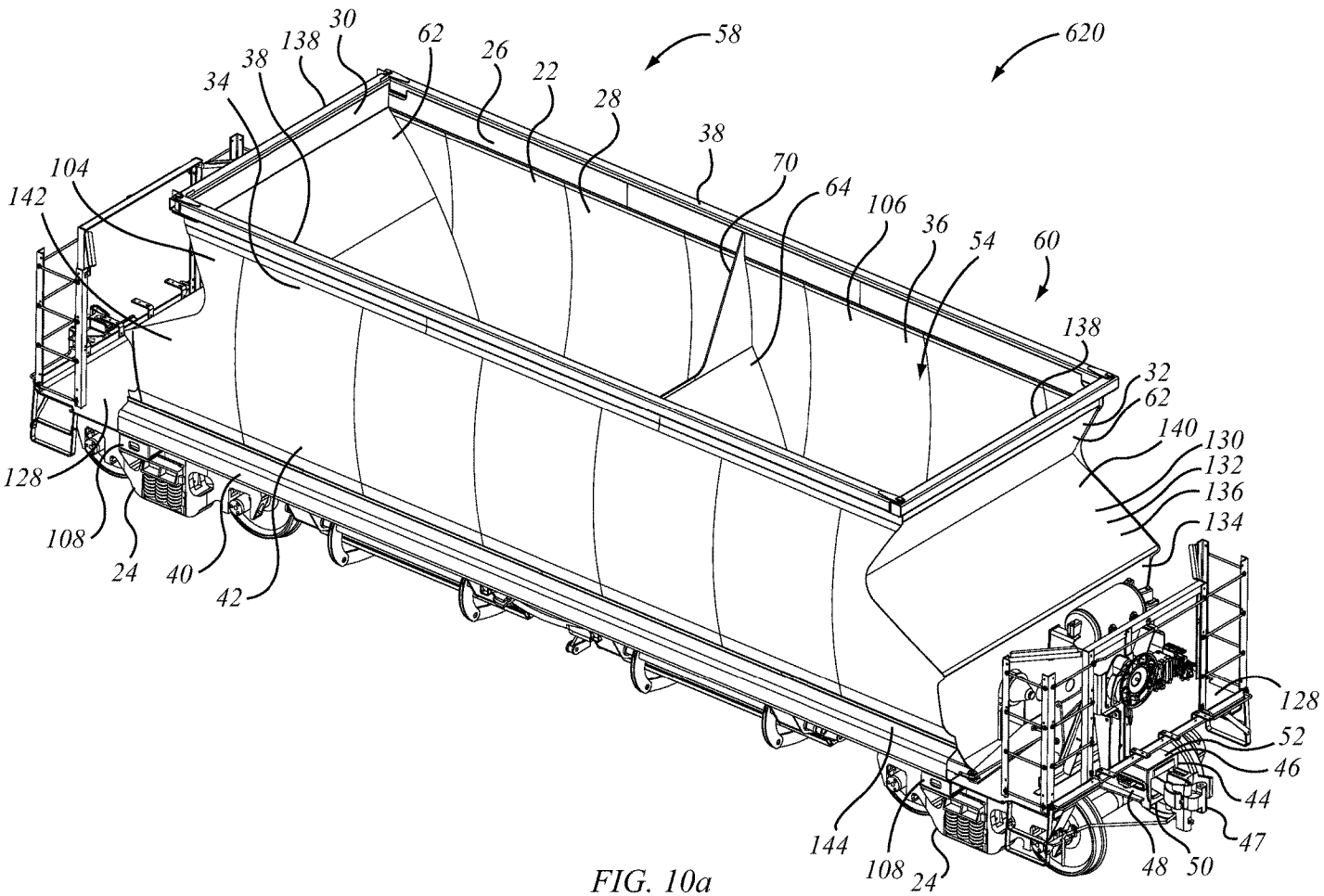
FIG. 10*a* is a general arrangement, perspective view from above and to one corner of a another embodiment of a railroad freight car according to an aspect of the invention.
Figure 10B:
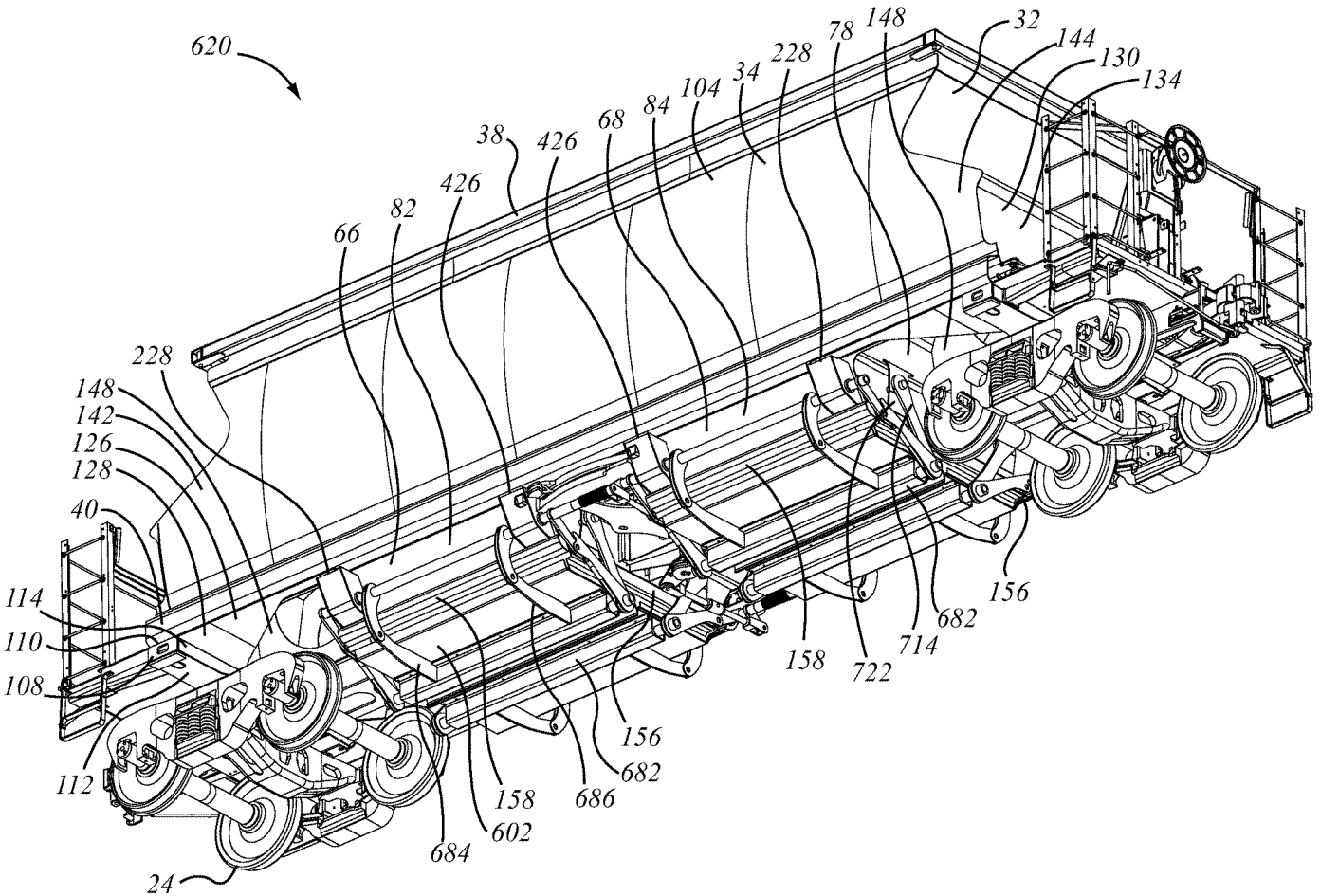
FIG. 10*b* is a general arrangement, perspective view from below and to one corner of the railroad freight car of FIG. 10*a;*
Figure 10C:
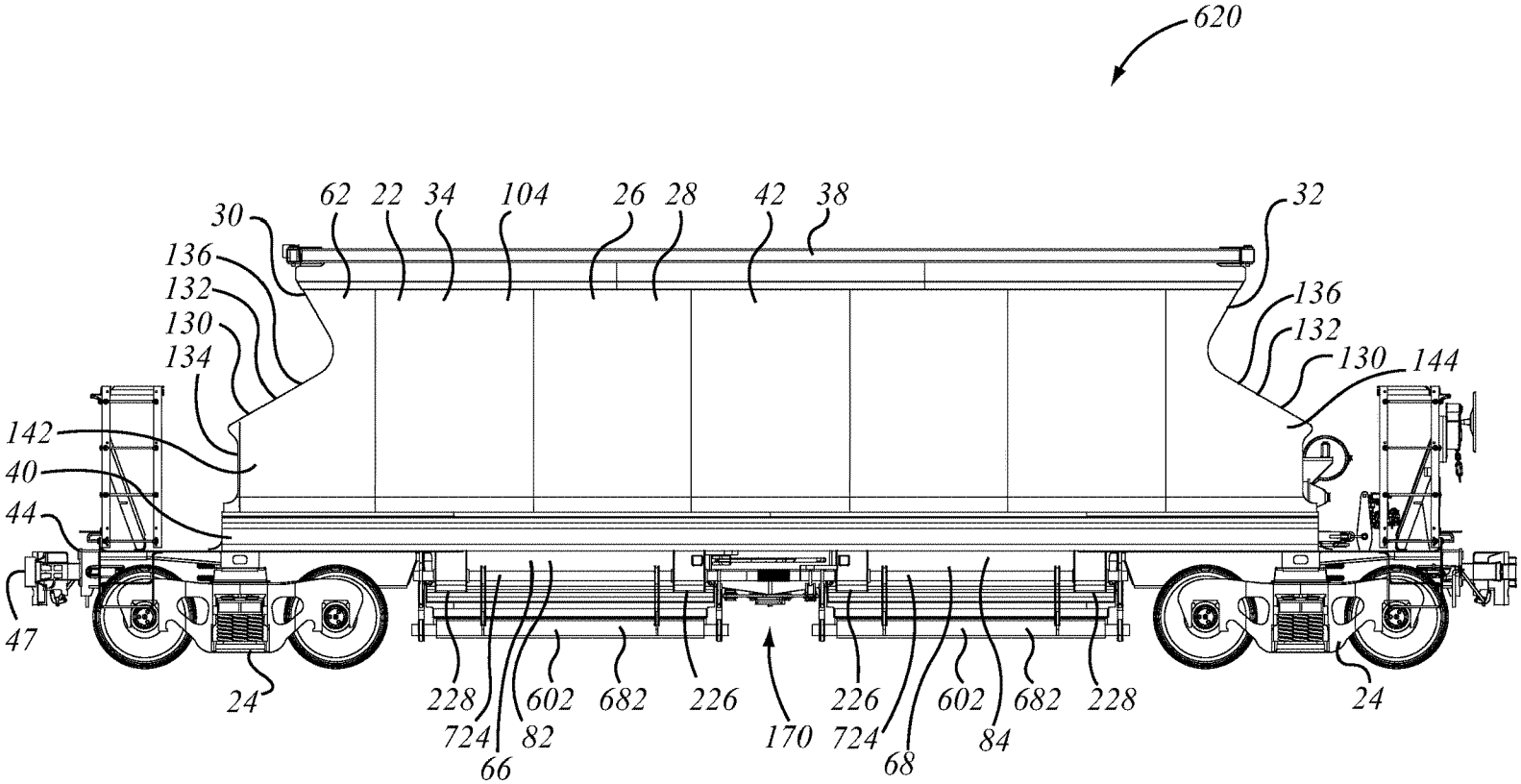
FIG. 10*c* is a side view of the railroad freight car of FIG. 10*a;*
Figure 10D:
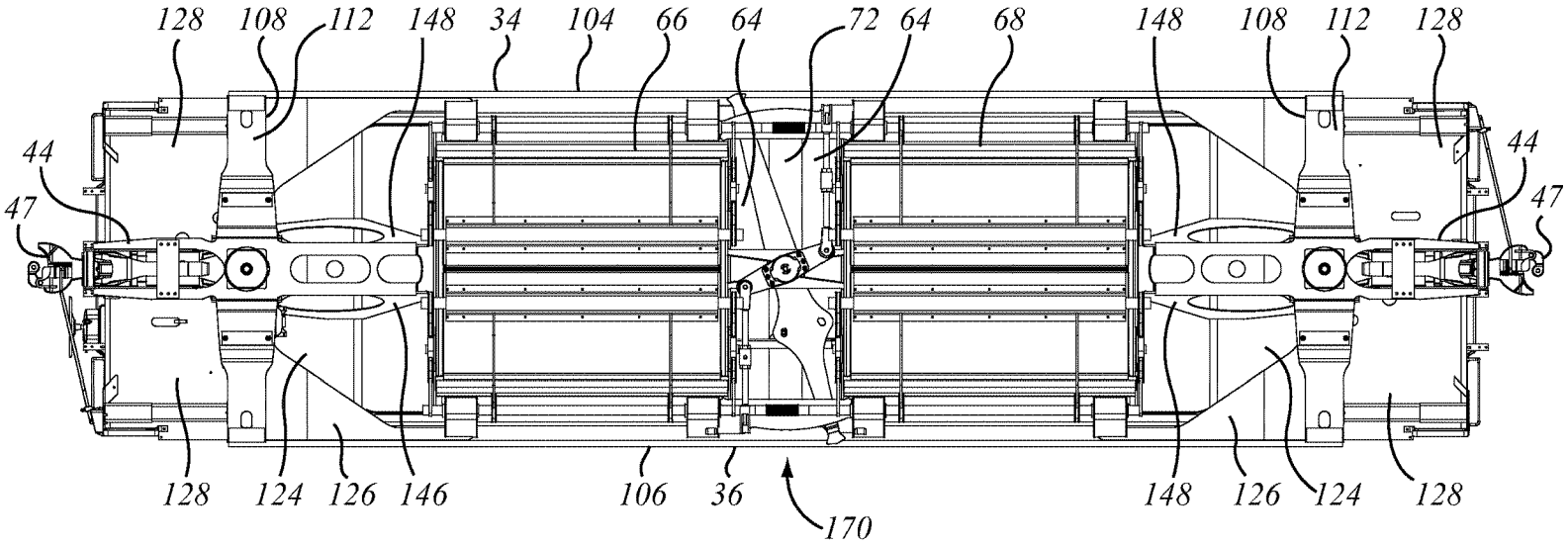
FIG. 10*d* is a bottom view of the railroad freight car of FIG. 10*a*, with the trucks removed.

The door mechanism driving arm or crank arm or crank, be it 564 or 566, is pivotally mounted to the near end of torque tube 224. The drive train includes two further members, the first being a driven arm 578 and the second being a follower or slave link 580 (as seen in FIGS. 7*d*, 8*a*, and 8*b*). In normal, or automatic, or power-driven mode, driven arm 578 is connected to crank 564, (or 566) such that when crank 564 turns, driven arm 578 turns through the same angle and transmits force and motion to slave link 580, which, in turn, drives the door, be it 100 or 102. Motion of lever 540 caused by an input received at one or the other of the input interfaces defined by first and second ends 542, 544 will therefore necessarily cause crank 564 or 566 to move. As may be understood, in tripping door 100 (or 102) to open, member 556 (or 558) acts in tension as a drag line. In closing door 100, member 556 acts in compression as a connecting rod or push rod. Follower 580 is pivotally joined at a connection 584 at one end to the distal tip of driven arm 578, and also pivotally connected to stub shaft 204. Rotation of driven arm 578 will move the location of connection 584, which will, in turn cause stub shaft 204 to move, opening or closing door 100 (or 102). Follower 580 also has an over-center lock in the form of a finger or abutment 582. When driven arm 578 is moved to an over center condition with respect to follower 580 (i.e., the pivot axes at 585, 587 and 589 pass through a condition of planar alignment) abutment 582 engages driven arm 578 preventing further motion. As the near end of door 100 (or 102) moves, consequent motion occurs in the links of the four bar linkage of the door. Torque tube 224 may tend to force driven arms 578 at both ends of torque tube 224 to move in unison, and thereby to discourage twisting of the door.

Thus motion of lever 540 results in laterally inboard motion of drag links 556 and 558 in opposite directions on their respective sides of car 20, such that doors 100 and 102 operate at the same time in a coordinated, substantially symmetrical, though opposite-handed, manner. It may be noted that output lever 550 is also a force divider in the sense that the single force (and motion) received from lever 540 (whichever end 542 or 544 receives the input) is split and distributed to the right and left hand portions of the drive train. As may be noted, in each case the crank counter-rotates relative to the short, outboard, links of the four bar linkage. That is, as crank 564 (or 566) turns clockwise, the short linkage 216, 218 turns counter-clockwise.

Lever 540 may be actuated as car 20 is in rolling motion along railroad tracks. A trackside interface member, being a post, or biased structural member or engaging arm, which may be spring loaded, may be mounted at track-side, and may stand sufficiently upwardly to engage first end 542 of lever 540. As car 20 rolls forward, lever 540 is driven to cause doors 100, 102 to open. As the spring loaded member works its way around the outwardly facing surface of bell-mouth 568, the doors open further. When they reach the fully open position, cam 570 disengages the spring loaded arm from lever 540. When the car has advanced somewhat further, and has discharged its lading (presumably through a floor grid or grating beneath the rails), second end 544 of lever 540 may encounter a similar post or biased structural member on the other side of car 20, reversing the process to move doors 100, 102 to their closed, centered position.

Lever 540 has a widened portion 590 located between axis 546 and first end 542. Widened portion 590 has first and second accommodations, or seats, or apertures 592, 594. A frame, fitting, or beam 596 is mounted to the underside of the internal slope sheets. An indexing member, such as may be in the nature of a spring loaded ball is mounted inside a socket 598. When lever 540 is move to the "closed" position of doors 100, 102, the indexing member, i.e., the spring loaded ball, seats in aperture 592 and discourages lever 540 from moving. When the external trackside engagement member encounters second end 544 of lever 540, the force applied causes the spring loaded ball to disengage from aperture 592. When lever 540 moves to the open position of doors 100, 102, the spring loaded ball member then seats in aperture 594, thus tending releasably to secure the actuator, i.e., lever 540, in the open position.

Door Structure (Double Doors)

In the embodiment shown in FIGS. 10*a* to 11*b*, hopper car 620 is substantially similar to hopper car 20, and may be taken as having the same structural features unless noted otherwise. Hopper car 620 differs from hopper car 20 to the extent that hopper car 620 has a pair of double doors 600, 602 for each hopper 58, 60. To accommodate this configuration, doors 600, 602 extend laterally across only half of rectangular openings 90 of hoppers 58, 60.

Left and right hand doors 600, 602 are symmetrical, such that a description of one is equally a description of the other. Similarly, the first pair of doors for hopper 58 is symmetrical to a second pair of doors for hopper 60, such that a description of one pair is equally a description of the other pair. The main portion of door 600 (or 602, as may be) is a sheet or pan 674, which may have a turned-up proximal flange 676 and a turned-down distal lip 678, as indicated. Door pan 674 may also have turned up lateral edges 680. The door length (in the x-direction, or longitudinal direction) of car 620 being suited to the opening defined by the lower margins of the hopper discharge section, be it 66 or 68, the upturned lateral edges seating to either side of the fore-and-aft lower margins of the hopper discharge section to form a seal therealong when the door is closed. Pan 674 is reinforced by a long-direction hollow channel 682, oriented parallel to the x-direction of the car. Channel 682 is welded toes-in to form a hollow section. Pan sheet 674 is also reinforced by, and carried by, first and second proximal reinforcements 684, 686 that run across the outward side thereof from the proximal edge to channel 682. The proximal ends of reinforcements 684, 686 extend beyond proximal edge flange 676, and curl upwardly partially therearound to define mounting lugs 700, 702. Further, spindles, or stub shafts 704 are mounted at the ends of C-channel 682 and define connection interfaces, or connection points for both the door suspension members and the door drive train.

Door Linkages (Double Doors)

Doors 600 and 602 are suspended from a set of pivotally movable members or links such as may be generally identified as door support linkages 710. Those linkages include a pair of first and second, near end and far end distal door linkages, or arms 712, 714, and a pair of first and second, near and far, proximal, short, door linkages, or arms 716, 718. As may be noted, the distal linkages, or arms, 712, 714 are longer than the proximal arms 716, 718. Arms 712, 714 have respective first ends pivotally mounted to upper lateral hopper section support member 78, 80, respectively, at mounting lugs, or feet, 722. This is the stationary, or reference or datum end of the link. The other end of arms 712, 714 is the pivot mount at the connection interface defined at stub shaft 704, which may be termed the distant or swinging end. Similarly, the "fixed" or base, or reference, end of short arms 716, 718 is mounted to a rotational angular motion and torque transmitting member identified as torque tube 724, and the "free" or swinging ends of short arms 716, 718 pick up on mounting lugs 700, 702. Short arms 716, 718 are not rigidly fixed to torque tube 724, but rather are mounted to rotate independently of it. Torque tube 724 is itself mounted for rotation to two pairs pair of first and second (or near and far) mounting fittings or brackets, or pedestals, or reinforcement members or lugs 226, 228, which may themselves have the form of tapering hollow channel sections mounted toes-in to the outside face of the inwardly inclined side sloping sheets of the hopper discharge sections, those hollow sections also defining discharge section reinforcements extending from one end connected to side sill 40, and a second, lower end welded to lower edge reinforcement 158.

As may be noted, the resultant structure defines a four-bar linkage. The first bar, or base, or datum, is the stationary structure whose position is rigidly fixed as part of the car body, namely the stationary structure of discharge section 66, 68, which includes the footings of mounts of the linkages. The long arm pair of arms 712, 714 forms the second bar of the four bar linkage. The short arm pair of arms 716, 718 forms the fourth bar of the four bar linkage, and the door panel itself forms the third bar of the four bar linkage. As may be noted, this four-bar linkage is movable between a first position (namely the closed position, shown in FIG. 10*b*) and a second position (namely the fully open position, not shown).

In this motion, the long arm link moves through a significantly smaller angular displacement than the short arm link, the long arm moving through roughly 35 to 45 degrees of arc (e.g. approximately 40 degrees), and the short arm link moving through 120 to 150 degrees of arc (e.g. approximately 135 degrees). At the starting position of the motion, both the short and long arms are on angles inward of vertical, such that as the motion begins, both the short and long arms move toward a vertical orientation, and, in so doing, their respective "free" pivot interfaces move in a direction of motion that has both an outward and downward component of motion. That is, dz/dy at both free pivot interfaces is negative; dy being the movement of the interface in the y, or lateral, direction (with the +y direction being defined as a laterally outboard direction) and dz being defined as the movement of the interface in the z, or vertical, direction (with the +z direction being defined as an upward direction). As will be understood, the +y direction for door 600 will be opposite the +y direction for door 602. Thus, since there is a −z component of motion, the initial motion serves to "lift" or "unseat" the pan, i.e., move it away from the seat, while the door is also moving predominantly laterally outboard in the +y direction. In this initial stage of motion, the absolute value of dz/dy is also considerably less than 1; that is, the motion is more strongly horizontal than vertical. This horizontal predominance increases as the swinging arms move toward their respective vertical positions. Once past the vertical, the respective pivot connections (or "free" pivot interfaces) begin to move upward while moving laterally outward. The angular displacement of the short arm is more rapid, and its motion is soon predominantly upward (dz/dy>1), and continues so throughout the remainder of the stroke. While this occurs, the longer arm continues its predominantly horizontal motion on a less rapidly changing angular displacement and less strongly positive dz/dy. The effect is that the door panel itself tilts from a very nearly completely horizontal condition to a tipped, inclined position. At the end of the motion, the inside lip of the door may be positioned substantially directly above the rail, or just laterally shy of the inside of the rail bullnose, such that lading exiting the hopper discharge may tend to fall between the rails.

As will be appreciated, returning the four-bar linkage from the second position (e.g. the fully open position, not shown) to the first position (e.g. the closed position, shown in FIG. 10*b*) is substantially the inverse of the motion described above.

Drive Train (Double Doors)

The motion of the four bar linkages of doors 600, 602 may be driven by a transmission or drive train 730, the same drive train being used to close the doors in the other direction once the lading has been discharged. Drive train 730 is the same as drive train 530, except insofar as each side of the output member 734 in drive train 730 actuates two doors (i.e. both doors 600, or both doors 602, as may be), whereas each side of the output lever 534 in drive train 530 actuated only one door 100 (or 102, as may be).

The drive train includes an input member 732, an output member 734, and a link or transfer member 736. In this instance input member 732 may have the form of a large lever, 740 having a first end 742, a second end 744, and a central pivot axis 746. Output member 734 may similarly have the form of a lever 750 having a first end at a first output interface connection 752, a second end at a second output interface connection 754 and sharing the same central pivot axis 746. Transfer member 736 may have the form of a shaft or torque tube 760 mounted to a reaction frame 762 that is itself rooted to the lateral structural members of the hopper discharge sections. As may be noted, lever 740 is mounted at a level or height just below side sills 40, and lever 750 is mounted lower. Output lever 750 has two other pivotal connections namely first and second output interface connections, 752 and 754. The fulcrum, namely a fixed pivot at central pivot axis 746, is located mid-way between pivotal connections 752 and 754. Push rods, or connecting rods, or links 756 and 758 respectively extend from connections 752 and 754 to the crank arms of the front and back doors. That is, connecting rods 756, 758 carry transmitted motion and force from the respective output interface connections or ends 752 and 754 of output lever 750 to the first and second door cranks, 764, 766 of the drive mechanisms for doors 600 and 602 respectively.

Figure 11A:
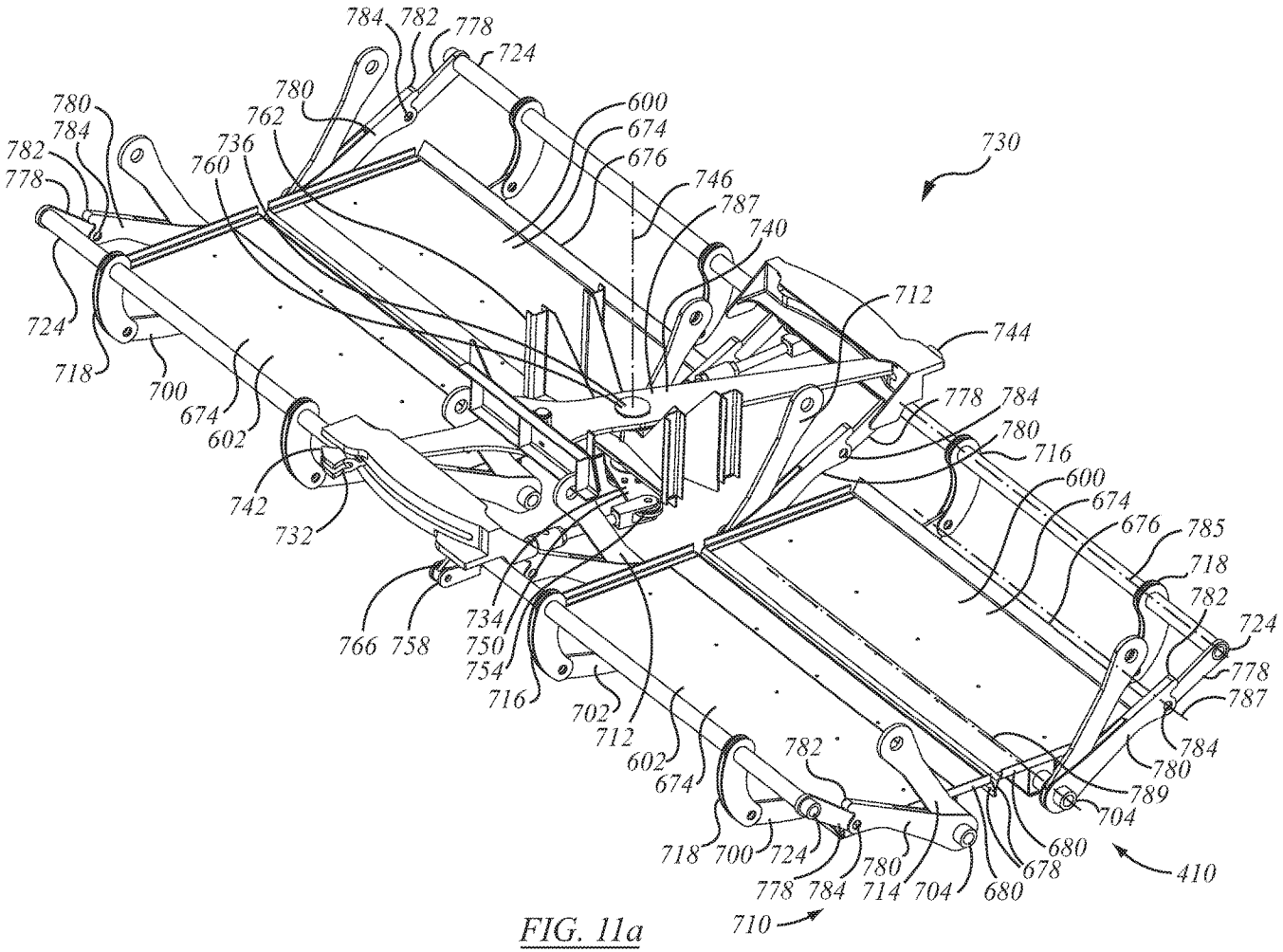
FIG. 11*a* is a perspective view, from above and to one corner of hopper doors and a door operating transmission of the railroad freight car of FIG. 10*a*.
Figure 11B:
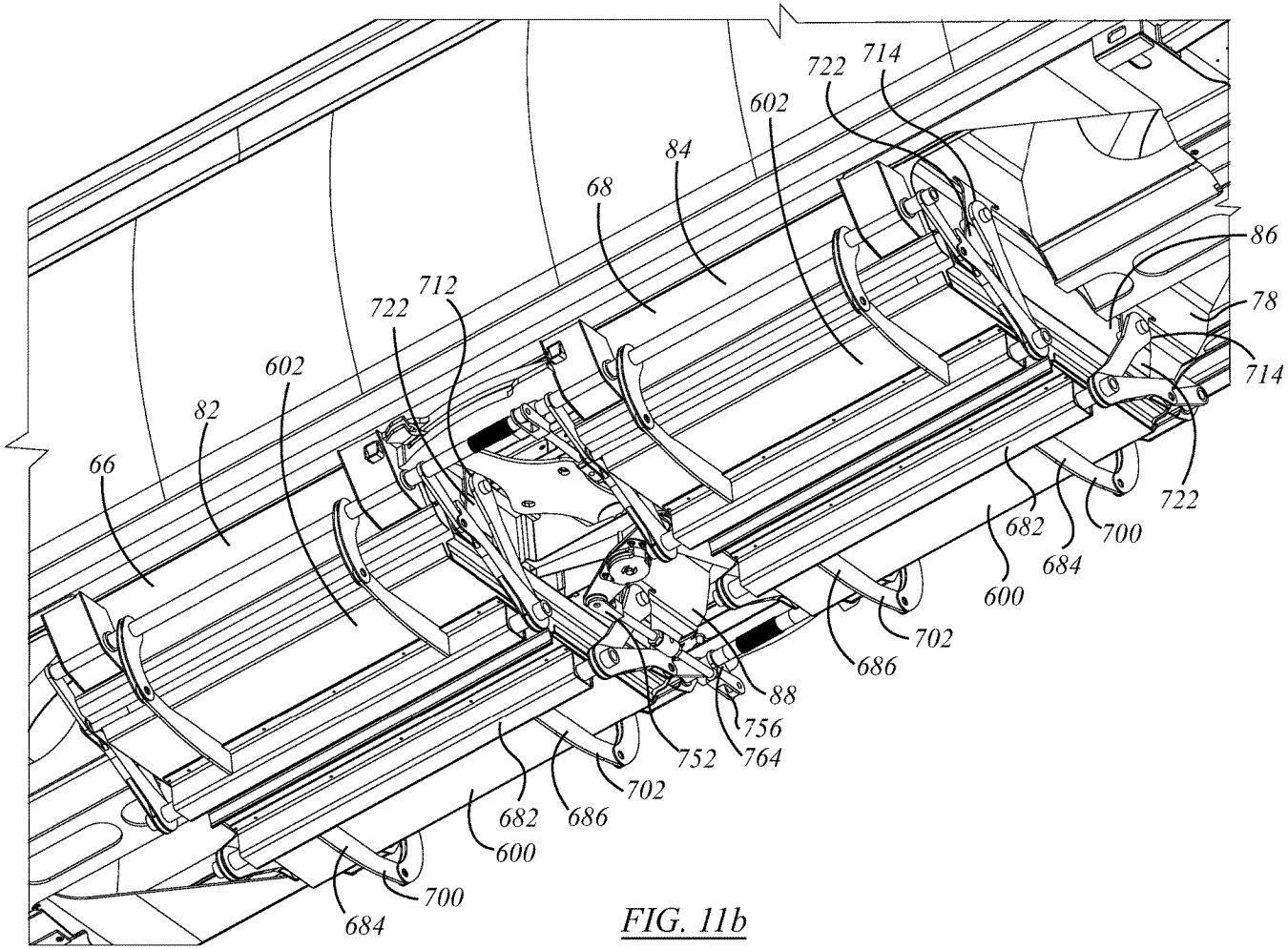
FIG. 11*b* shows a perspective view, from below, of the railroad freight car of FIG. 10*a*, with hopper doors closed.

The door mechanism driving arm or crank arm or crank, be it 764 or 766, is pivotally mounted to the near middle of torque tube 724. The drive train includes two further members, the first being a driven arm 778 and the second being a follower or slave link 780 (as seen in FIG. 11*a*). As will be appreciated, in the embodiment of FIGS. 10*a* to 11*b*, crank 764 (or 766, as may be) drives four driven arms 778 (two for each door attached to torque tube 724); in the previously described embodiment, crank 564 (or 566, as may be) drove two driven arms 578. In normal, or automatic, or power-driven mode, driven arm 778 is connected to crank 764, (or 766) such that when crank 764 turns, driven arm 778 turns through the same angle and transmits force and motion to slave link 780, which, in turn, drives the door, be it 600 or 602. Motion of lever 740 caused by an input received at one or the other of the input interfaces defined by first and second ends 742, 744 will therefore necessarily cause crank 764 or 766 to move. As may be understood, in tripping door 600 (or 602) to open, member 756 (or 758) acts in tension as a drag link. In closing door 600, member 756 (or 758) acts in compression as a connecting rod or push rod. Follower 780 is pivotally joined at a connection 784 at one end to the distal tip of driven arm 778, and also pivotally connected to stub shaft 704. Rotation of driven arm 778 will move the location of connection 784, which will, in turn cause stub shaft 704 to move, opening or closing door 600 (or 602). Follower 780 also has an over-center lock in the form of a finger or abutment 782. When driven arm 778 is moved to an over center condition with respect to follower 780 (i.e., the pivot axes at 785, 787 and 789 pass through a condition of planar alignment) abutment 782 engages driven arm 778 preventing further motion. As the near end of door 600 (or 602) moves, consequent motion occurs in the links of the four bar linkage of the door. Torque tube 724 may tend to force driven arms 778 at both ends of torque tube 724 to move in unison, and thereby to discourage twisting of the door.

Thus motion of lever 740 results in laterally inboard motion of drag links 756 and 758 in opposite directions on their respective sides of car 620, such that doors 600 and 602 operate at the same time in a coordinated, substantially symmetrical, though opposite-handed, manner. It may be noted that output lever 750 is also a force divider in the sense that the single force (and motion) received from lever 740 (whichever end 742 or 744 receives the input) is split and distributed to the right and left hand portions of the drive train. As may be noted, in each case the crank counter-rotates relative to the short, outboard, links of the four bar linkage. That is, as crank 764 (or 766) turns clockwise, the short linkage 716, 718 turns counter-clockwise.

Lever 740 may be actuated as car 620 is in rolling motion along railroad tracks, in the same manner as lever 540, previously described.

Auxiliary Drive

In the event that the doors should become dislodged, or stuck in either the open position or the closed position, and the car is not at an unloading terminal with an appropriate track-side actuator, it may be desirable to be able to open or close the doors with auxiliary power. To that end, car 20 (or 620, as may be) may have an auxiliary door drive 610 (shown in FIG. 7*d*). Drive 610 may have the form of a screw 512 and cross-head 614. Cross-head 614 is shaped to engage notch or engagement seat 576 from either side, i.e., with the screw 512 driven in one direction under axial tension to pull on first end 542 of lever 540 to open doors 100, 102 (or 600, 602, as may be); and driven in the opposite direction in compression to drive doors 100, 102 to the closed position, (with cross-head 614 pushing into the notch on the other side of clevis 574) such as may also be aided by gravity.

Various embodiments have been described in detail. Since changes in and or additions to the above-described examples may be made without departing from the nature, spirit or scope of the invention, the invention is not to be limited to those details but only by a purposive interpretation of the claims as required by law.

We claim:

1. A railroad hopper car for operation in a rolling direction along railroad tracks, said railroad hopper car having:

a first hopper and a second hopper;

said first hopper having a first door through which to discharge lading;

said second hopper having a second hopper door through which to discharge lading;

a lever mounted to said car, said lever being operated by engagement of a trackside interface member that is mounted at trackside, said lever being mounted to pivot as the trackside interface member engages said lever;

said lever being connected to drive said first door toward a first side of said hopper car, thereby to open said first door; and said lever being connected to drive said second door toward a second side of said hopper car, thereby to open said second door.

2. The railroad hopper car of claim 1 wherein said lever is mounted to a pivot fulcrum located between said first and second hoppers.

3. The railroad hopper car of claim 2 wherein said fulcrum has a vertical axis of rotation.

4. The railroad hopper car of claim 2, the railroad hopper car having a longitudinal centerline vertical plane, and wherein said fulcrum is mounted substantially at said longitudinal centerline vertical plane.

5. The railroad hopper car of claim 1, the railroad hopper car having a longitudinal centerline vertical plane; said lever having a fulcrum mounted between said first and second hoppers; said fulcrum being mounted substantially at said longitudinal centerline vertical plane; and said fulcrum has a vertical axis of rotation.

6. The railroad hopper car of claim 1 wherein said lever has a first end extending laterally to a first side of said hopper car; and a second end extending to a second side of said hopper car; said first end providing an actuator interface by which said first and second doors are opened; and said second end providing an actuator interface by which said first and second doors are closed.

7. The railroad hopper car of claim 6 wherein said first door is part of a four-bar linkage.

8. The railroad hopper car of claim 7 wherein said first door moves predominantly sideways during opening thereof.

9. The railroad hopper car of claim 1 wherein said first door is part of a four bar linkage.

10. The railroad hopper car of claim 9 wherein said first door moves predominantly sideways during opening thereof.

11. The railroad hopper car of claim 1 wherein each of said first and second hoppers is a single door hopper.

* * * * *